US005764212A

United States Patent [19]

Nishitani et al.

[11] Patent Number: 5,764,212

[45] Date of Patent: Jun. 9, 1998

[54] MATRIX TYPE LIQUID CRYSTAL DISPLAY DEVICE WITH DATA ELECTRODE DRIVING CIRCUIT IN WHICH DISPLAY INFORMATION FOR ONE SCREEN IS WRITTEN INTO AND READ OUT FROM DISPLAY MEMORY AT MUTUALLY DIFFERENT FREQUENCIES

[75] Inventors: Shigeyuki Nishitani, Yokohama; Hiroyuki Mano, Chigasaki; Tsutomu Furuhashi; Yasuyuki Kudo, both of Yokohama; Tatsuhiro Inuzuka, Odawara; Toshio Futami, Mobara; Satoru Tsunekawa, Higashimuryama, all of Japan

[73] Assignee: Hitachi, Ltd., Tokyo, Japan

[21] Appl. No.: 391,599

[22] Filed: Feb. 21, 1995

[30] Foreign Application Priority Data

| | | | |
|---|---|---|---|
| Feb. 21, 1994 | [JP] | Japan | 6-022295 |
| Jun. 22, 1994 | [JP] | Japan | 6-140387 |
| Jul. 15, 1994 | [JP] | Japan | 6-164360 |

[51] Int. Cl.[6] ..... G09G 3/36

[52] U.S. Cl. ..... 345/98; 345/100

[58] Field of Search ..... 345/87, 89, 92, 345/94, 95, 97, 98, 99, 200, 3, 1, 210, 211; 359/54, 56, 59; 349/33, 34, 36, 41, 42

[56] References Cited

U.S. PATENT DOCUMENTS

| | | | |
|---|---|---|---|
| 4,317,115 | 2/1982 | Kawakami et al. | 345/98 |
| 4,830,467 | 5/1989 | Inoue et al. | 345/97 |
| 5,196,738 | 3/1993 | Takahara et al. | 345/89 |
| 5,218,274 | 6/1993 | Zenda | 345/3 |
| 5,260,698 | 11/1993 | Munetsugu et al. | 345/205 |
| 5,337,070 | 8/1994 | Kitajima et al. | 345/98 |
| 5,404,150 | 4/1995 | Murata | 345/95 |
| 5,412,777 | 5/1995 | Wakimoto | 345/200 |
| 5,434,589 | 7/1995 | Nakamura et al. | 345/98 |

FOREIGN PATENT DOCUMENTS

| | | | |
|---|---|---|---|
| 0368572 | 5/1990 | European Pat. Off. | 345/98 |
| 0 507 061 | 10/1992 | European Pat. Off. . | |
| 52-76897 | 6/1977 | Japan . | |
| 4-57018 | 2/1992 | Japan . | |

(List continued on next page.)

OTHER PUBLICATIONS

"Pulse-Height Modulation (PHM) Gray Shading Methods for Passive Matrix LCD's", Conner, et al, Japan Display '92, pp. 69–72.

"A Generalized Addressing Technique for RMS Responding Matrix LCDs", T. N. Ruckmongathan, 1988 IEEE, pp. 80–85.

"Addressing Techniques for RMS Responding LCSs", T.N. Ruckmongathan, Japan Display '92, pp. 77–80.

"An Eight-Gray-Level Drive Method for Fast-Responding STN-LCDs", Mano et al, SID 93 Digest, pp. 93–96.

"Liquid Crystal Device Handbook", 1990, Section 6, 2nd Paragraph.

*Primary Examiner*—Chanh Nguyen

*Attorney, Agent, or Firm*—Antonelli, Terry, Stout & Kraus, LLP

[57] ABSTRACT

A liquid crystal display device includes N (N is a positive integer except zero) data electrodes, M (M is a positive integer except zero) scan electrodes, a liquid crystal display panel having pixels located at crosspoints between said data electrodes and said scan electrodes, and a data electrode driving circuit. The data electrode circuit has a memory unit from or into which the information information is read or written, a write control circuit for controlling a write of the display information into a memory area of the memory unit, a read control circuit for simultaneously reading the display information corresponding to N data electrodes from the memory area at a different period of the writing period, and an output circuit for converting the display information read from the memory unit into the corresponding voltage and feeding the display voltage to the data electrode.

14 Claims, 68 Drawing Sheets

FOREIGN PATENT DOCUMENTS

| | | |
|---|---|---|
| 5-46127 | 2/1993 | Japan . |
| 6-4049 | 1/1994 | Japan . |
| 6-27904 | 2/1994 | Japan . |
| 6-27905 | 2/1994 | Japan . |
| 6-27906 | 2/1994 | Japan . |
| 6-27907 | 2/1994 | Japan . |
| 6-27908 | 2/1994 | Japan . |
| 6-67628 | 3/1994 | Japan . |

FIG. 10A

BIT PLANE A

| WRITE ADDRESS | | | | | | | | | | | | | | | | READ ADDRESS |
|---|---|---|---|---|---|---|---|---|---|---|---|---|---|---|---|---|
| 0 | $D_{0,0}(0)$ | $D_{0,1}(0)$ | $D_{0,2}(0)$ | $D_{0,3}(0)$ | $D_{0,4}(0)$ | ..... | $D_{0,i}(0)$ | ..... | $D_{0,158}(0)$ | $D_{0,159}(0)$ | 0 |
| 1 | $D_{1,0}(0)$ | $D_{1,1}(0)$ | $D_{1,2}(0)$ | $D_{1,3}(0)$ | $D_{1,4}(0)$ | ..... | $D_{1,i}(0)$ | ..... | $D_{1,158}(0)$ | $D_{1,159}(0)$ | 1 |
| 2 | $D_{2,0}(0)$ | $D_{2,1}(0)$ | $D_{2,2}(0)$ | $D_{2,3}(0)$ | $D_{2,4}(0)$ | ..... | $D_{2,i}(0)$ | ..... | $D_{2,158}(0)$ | $D_{2,159}(0)$ | 2 |
| 3 | $D_{3,0}(0)$ | $D_{3,1}(0)$ | $D_{3,2}(0)$ | $D_{3,3}(0)$ | $D_{3,4}(0)$ | ..... | $D_{3,i}(0)$ | ..... | $D_{3,158}(0)$ | $D_{3,159}(0)$ | 3 |
| 4 | $D_{4,0}(0)$ | $D_{4,1}(0)$ | $D_{4,2}(0)$ | $D_{4,3}(0)$ | $D_{4,4}(0)$ | ..... | $D_{4,i}(0)$ | ..... | $D_{4,158}(0)$ | $D_{4,159}(0)$ | 4 |
| 5 | $D_{5,0}(0)$ | $D_{5,1}(0)$ | $D_{5,2}(0)$ | $D_{5,3}(0)$ | $D_{5,4}(0)$ | ..... | $D_{5,i}(0)$ | ..... | $D_{5,158}(0)$ | $D_{5,159}(0)$ | 5 |
| ..... | ..... | ..... | ..... | ..... | ..... | ..... | ..... | ..... | ..... | ..... | ..... |
| 1 | $D_{1,0}(0)$ | $D_{1,1}(0)$ | $D_{1,2}(0)$ | $D_{1,3}(0)$ | $D_{1,4}(0)$ | ..... | $D_{1,i}(0)$ | ..... | $D_{1,158}(0)$ | $D_{1,159}(0)$ | 1 |
| ..... | ..... | ..... | ..... | ..... | ..... | ..... | ..... | ..... | ..... | ..... | ..... |
| 237 | $D_{237,0}(0)$ | $D_{237,1}(0)$ | $D_{237,2}(0)$ | $D_{237,3}(0)$ | $D_{237,4}(0)$ | ..... | $D_{237,i}(0)$ | | $D_{237,158}(0)$ | $D_{237,159}(0)$ | 237 |
| 238 | $D_{238,0}(0)$ | $D_{238,1}(0)$ | $D_{238,2}(0)$ | $D_{238,3}(0)$ | $D_{238,4}(0)$ | ..... | $D_{238,i}(0)$ | ..... | $D_{238,158}(0)$ | $D_{238,159}(0)$ | 238 |
| 239 | $D_{239,0}(0)$ | $D_{239,1}(0)$ | $D_{239,2}(0)$ | $D_{239,3}(0)$ | $D_{239,4}(0)$ | ..... | $D_{239,i}(0)$ | ..... | $D_{239,158}(0)$ | $D_{239,159}(0)$ | 239 |

FIG. 10B

BIT PLANE B

| WRITE ADDRESS | | |

FIG. 30A

BIT PLANE A

| WRITE ADDRESS | | | | | | | | | | | | | | | | | READ ADDRESS |
|---|---|---|---|---|---|---|---|---|---|---|---|---|---|---|---|---|---|
| 0 | $D_{0.0}(0)$ | $D_{0.1}(1)$ | $D_{0.2}(0)$ | $D_{0.3}(1)$ | $D_{0.4}(0)$ | ..... | $D_{0.i}(1)$ | ..... | $D_{0.158}(0)$ | $D_{0.159}(1)$ | 0 |
| 1 | $D_{1.0}(1)$ | $D_{1.1}(0)$ | $D_{1.2}(1)$ | $D_{1.3}(0)$ | $D_{1.4}(1)$ | ..... | $D_{1.i}(0)$ | ..... | $D_{1.158}(1)$ | $D_{1.159}(0)$ | 1 |
| 2 | $D_{2.0}(0)$ | $D_{2.1}(1)$ | $D_{2.2}(0)$ | $D_{2.3}(1)$ | $D_{2.4}(0)$ | ..... | $D_{2.i}(1)$ | ..... | $D_{2.158}(0)$ | $D_{2.159}(1)$ | 2 |
| 3 | $D_{3.0}(1)$ | $D_{3.1}(0)$ | $D_{3.2}(1)$ | $D_{3.3}(0)$ | $D_{3.4}(1)$ | ..... | $D_{3.i}(0)$ | ..... | $D_{3.158}(1)$ | $D_{3.159}(0)$ | 3 |
| 4 | $D_{4.0}(1)$ | $D_{4.1}(1)$ | $D_{4.2}(0)$ | $D_{4.3}(1)$ | $D_{4.4}(0)$ | ..... | $D_{4.i}(1)$ | ..... | $D_{4.158}(0)$ | $D_{4.159}(1)$ | 4 |
| 5 | $D_{5.0}(1)$ | $D_{5.1}(0)$ | $D_{5.2}(1)$ | $D_{5.3}(0)$ | $D_{5.4}(1)$ | ..... | $D_{5.i}(0)$ | ..... | $D_{5.158}(1)$ | $D_{5.159}(0)$ | 5 |
| ..... | ..... | ..... | ..... | ..... | ..... | ..... | ..... | ..... | ..... | ..... | ..... |
| i | $D_{i.0}(0)$ | $D_{i.1}(1)$ | $D_{i.2}(0)$ | $D_{i.3}(1)$ | $D_{i.4}(0)$ | | $D_{i.i}(1)$ | | $D_{i.158}(0)$ | $D_{i.159}(1)$ | i |
| ..... | ..... | ..... | ..... | ..... | ..... | ..... | ..... | ..... | ..... | ..... | ..... |
| 237 | $D_{237.0}(0)$ | $D_{237.1}(1)$ | $D_{237.2}(0)$ | $D_{237.3}(1)$ | $D_{237.4}(0)$ | ..... | $D_{237.i}(1)$ | ..... | $D_{237.158}(1)$ | $D_{237.158}(1)$ | 237 |
| 238 | $D_{238.0}(1)$ | $D_{238.1}(0)$ | $D_{238.2}(1)$ | $D_{238.3}(0)$ | $D_{238.4}(1)$ | ..... | $D_{238.i}(0)$ | ..... | $D_{238.158}(0)$ | $D_{238.158}(0)$ | 238 |
| 239 | $D_{237.0}(0)$ | $D_{239.1}(1)$ | $D_{239.2}(0)$ | $D_{239.3}(1)$ | $D_{239.4}(0)$ | ..... | $D_{239.i}(1)$ | ..... | $D_{239.158}(1)$ | $D_{239.158}(1)$ | 239 |

FIG. 30B

BIT PLANE B

| WRITE ADDRESS | | | | | | | | | | | | | | | | READ ADDRESS |
|---|---|---|---|---|---|---|---|---|---|---|---|---|---|---|---|---|
| 0 | D0.0(1) | D0.1(0) | D0.2(1) | D0.3(0) | D0.4(1) | ..... | D0.i(0) | ..... | D0.158(1) | D0.159(0) | 240 |
| 1 | D1.0(0) | D1.1(1) | D1.2(0) | D1.3(1) | D1.4(0) | ..... | D1.i(1) | ..... | D1.158(0) | D1.159(1) | 241 |
| 2 | D2.0(1) | D2.1(0) | D2.2(1) | D2.3(0) | D2.4(1) | ..... | D2.i(0) | ..... | D2.158(1) | D2.159(0) | 242 |
| 3 | D3.0(0) | D3.1(1) | D3.2(0) | D3.3(1) | D3.4(0) | ..... | D3.i(1) | ..... | D3.158(0) | D3.159(1) | 243 |
| 4 | D4.0(1) | D4.1(0) | D4.2(1) | D4.3(0) | D4.4(1) | ..... | D4.i(0) | ..... | D4.158(1) | D4.159(0) | 244 |
| 5 | D5.0(0) | D5.1(1) | D5.2(0) | D5.3(1) | D5.4(0) | ..... | D5.i(1) | ..... | D5.158(0) | D5.159(1) | 245 |
| | ..... | ..... | ..... | ..... | ..... | ..... | ..... | ..... | ..... | ..... | |
| i | Di.0(1) | Di.1(0) | Di.2(1) | Di.3(0) | Di.4(1) | | Di.i(0) | | Di.158(1) | Di.159(0) | i |
| | ..... | ..... | ..... | ..... | ..... | ..... | ..... | ..... | ..... | ..... | |
| 237 | D237.0(0) | D237.1(1) | D237.2(0) | D237.3(1) | D237.4(0) | ..... | D237.i(1) | ..... | D237.158(0) | D237.158(0) | 477 |
| 238 | D238.0(1) | D238.1(0) | D238.2(1) | D238.3(0) | D238.4(1) | ..... | D238.i(0) | ..... | D238.158(1) | D238.158(1) | 478 |
| 239 | D237.0(0) | D239.1(1) | D239.2(0) | D239.3(1) | D239.4(0) | ..... | D239.i(1) | ..... | D239.158(0) | D239.158(0) | 479 |

FIG. 50
PRIOR ART
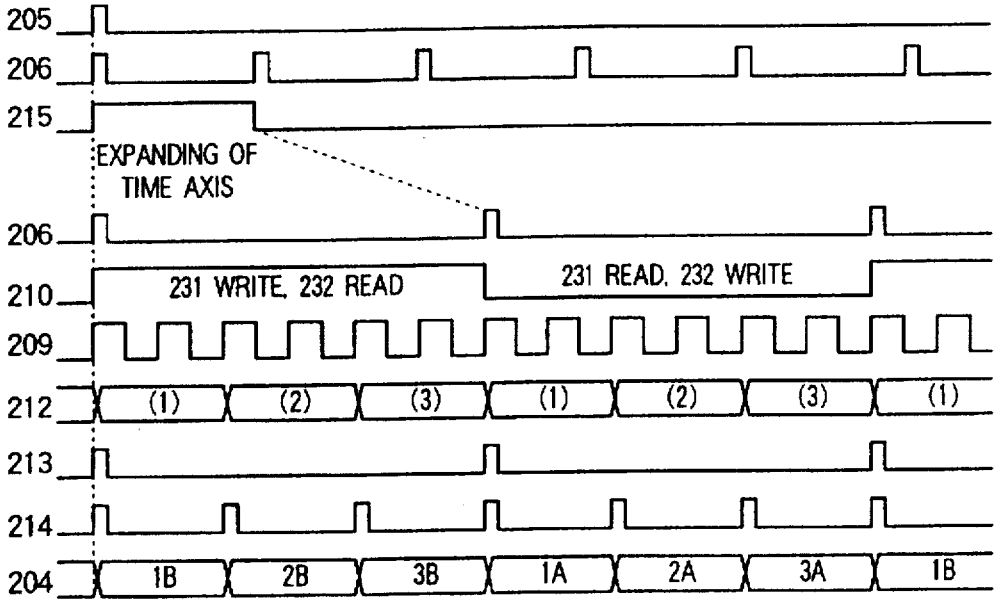
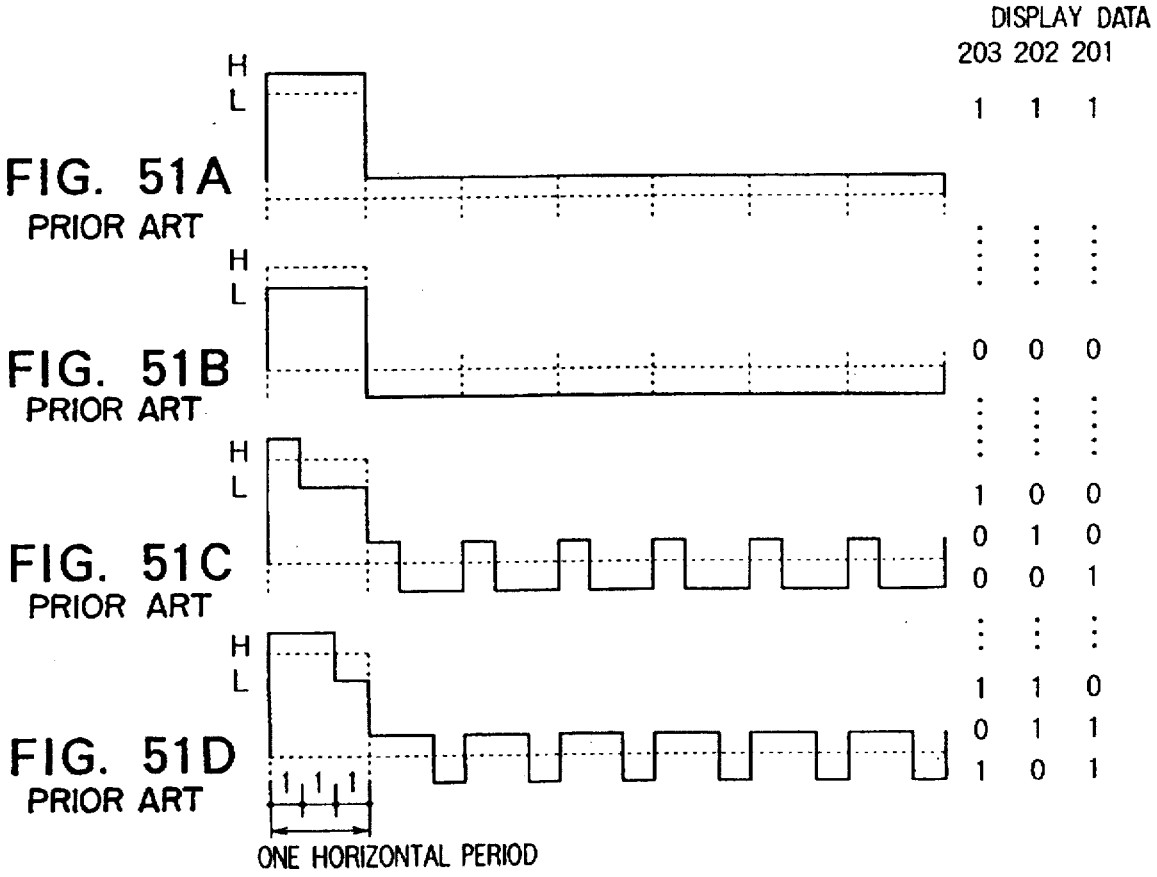

FIG. 52
PRIOR ART
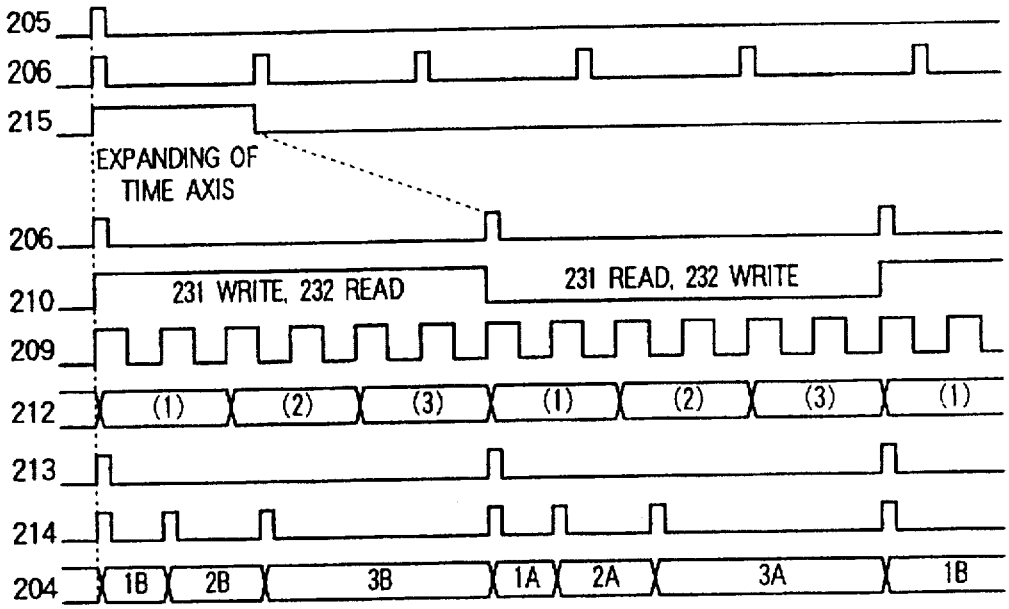
FIG. 53A
PRIOR ART
FIG. 53B
PRIOR ART
FIG. 53C
PRIOR ART
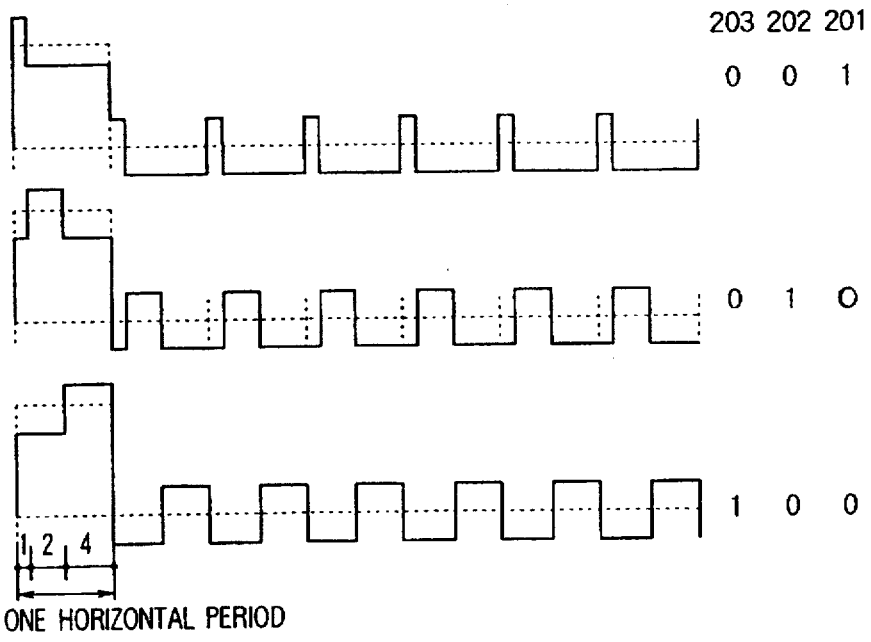

FIG. 70

| FRAME | ADDRESS 198 | SCAN FUNCTION DATA 144 | | | |
|---|---|---|---|---|---|
| | | w0 | w1 | w2 | w3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

| FRAME | ADDRESS 198 | SCAN FUNCTION DATA 144 | | | |
|---|---|---|---|---|---|
| | | w0 | w1 | w2 | w3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 0 | 0 | 0 | 0 |
| | 5 | 0 | 0 | 1 | 1 |
| | 6 | 0 | 1 | 1 | 0 |
| | 7 | 0 | 1 | 0 | 1 |
| | ⋮ | ⋮ | ⋮ | ⋮ | ⋮ |
| | 236 | 0 | 0 | 0 | 0 |
| | 237 | 0 | 0 | 1 | 1 |
| | 238 | 0 | 1 | 1 | 0 |
| | 239 | 0 | 1 | 0 | 1 |

FIG. 71

| FRAME | ADDRESS 198 | SCAN FUNCTION DATA 144 | | | |
|---|---|---|---|---|---|
| | | w0 | w1 | w2 | w3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 0 | 0 | 1 |
| | 6 | 0 | 0 | 1 | 1 |
| | 7 | 0 | 1 | 0 | 1 |
| | ⋮ | ⋮ | ⋮ | ⋮ | ⋮ |
| | 236 | 1 | 1 | 1 | 1 |
| | 237 | 0 | 1 | 1 | 0 |
| | 238 | 1 | 1 | 0 | 0 |
| | 239 | 0 | 1 | 0 | 1 |

| FRAME | ADDRESS 198 | SCAN FUNCTION DATA 144 | | | |
|---|---|---|---|---|---|
| | | w0 | w1 | w2 | w3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 0 | 0 | 0 | 0 |
| | 5 | 0 | 1 | 1 | 0 |
| | 6 | 1 | 1 | 0 | 0 |
| | 7 | 1 | 0 | 1 | 0 |
| | ⋮ | ⋮ | ⋮ | ⋮ | ⋮ |
| | 236 | 0 | 0 | 0 | 0 |
| | 237 | 1 | 0 | 0 | 1 |
| | 238 | 0 | 0 | 1 | 1 |
| | 239 | 1 | 0 | 1 | 0 |

FIG. 72

| FRAME | ADDRESS 198 | SCAN FUNCTION DATA 144 | | | |
|---|---|---|---|---|---|
| | | w0 | w1 | w2 | w3 |
| EVEN | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 0 | 0 | 0 | 0 |
| | 5 | 0 | 0 | 1 | 1 |
| | 6 | 0 | 1 | 1 | 0 |
| | 7 | 0 | 1 | 0 | 1 |
| | ⋮ | ⋮ | ⋮ | ⋮ | ⋮ |
| | 236 | 0 | 0 | 0 | 0 |
| | 237 | 0 | 0 | 1 | 1 |
| | 238 | 0 | 1 | 1 | 0 |
| | 239 | 0 | 1 | 0 | 1 |

| FRAME | ADDRESS 198 | SCAN FUNCTION DATA 144 | | | |
|---|---|---|---|---|---|
| | | w0 | w1 | w2 | w3 |
| ODD | 0 | 0 | 0 | 0 | 0 |
| | 1 | 0 | 0 | 1 | 1 |
| | 2 | 0 | 1 | 1 | 0 |
| | 3 | 0 | 1 | 0 | 1 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

FIG. 73

| FRAME | ADDRESS 198 | SCAN FUNCTION DATA 144 | | | |
|---|---|---|---|---|---|
| | | w0 | w1 | w2 | w3 |
| 1ST | 0 | 1 | 1 | 1 | 1 |
| | 1 | 1 | 1 | 0 | 0 |
| | 2 | 1 | 0 | 0 | 1 |
| | 3 | 1 | 0 | 1 | 0 |
| | 4 | 1 | 1 | 1 | 1 |
| | 5 | 1 | 1 | 0 | 0 |
| | 6 | 1 | 0 | 0 | 1 |
| | 7 | 1 | 0 | 1 | 0 |
| | ⋮ | ⋮ | ⋮ | ⋮ | ⋮ |
| | 236 | 1 | 1 | 1 | 1 |
| | 237 | 1 | 1 | 0 | 0 |
| | 238 | 1 | 0 | 0 | 1 |
| | 239 | 1 | 0 | 1 | 0 |

| FRAME | ADDRESS 198 | SCAN FUNCTION DATA 144 | | | |
|---|---|---|---|---|---|
| | | w0 | w1 | w2 | w3 |
| 2ND | 0 | 0 | 0 | 0 | 0 |
| | 1 | 0 | 1 | 1 | 0 |
| | 2 | 1 | 1 | 0 | 0 |
| | 3 | 1 | 0 | 1 | 0 |
| | 4 | 0 | 0 | 0 | 0 |
| | 5 | 0 | 1 | 1 | 0 |
| | 6 | 1 | 1 | 0 | 0 |
| | 7 | 1 | 0 | 1 | 0 |
| | ⋮ | ⋮ | ⋮ | ⋮ | ⋮ |
| | 236 | 0 | 0 | 0 | 0 |
| | 237 | 0 | 1 | 1 | 0 |
| | 238 | 1 | 1 | 0 | 0 |
| | 239 | 1 | 0 | 1 | 0 |

| FRAME | ADDRESS 198 | SCAN FUNCTION DATA 144 | | | |
|---|---|---|---|---|---|
| | | w0 | w1 | w2 | w3 |
| 3RD | 0 | 1 | 1 | 1 | 1 |
| | 1 | 0 | 0 | 1 | 1 |
| | 2 | 0 | 1 | 1 | 0 |
| | 3 | 1 | 0 | 1 | 0 |
| | 4 | 1 | 1 | 1 | 1 |
| | 5 | 0 | 0 | 1 | 1 |
| | 6 | 0 | 1 | 1 | 0 |
| | 7 | 1 | 0 | 1 | 0 |
| | ⋮ | ⋮ | ⋮ | ⋮ | ⋮ |
| | 236 | 1 | 1 | 1 | 1 |
| | 237 | 0 | 0 | 1 | 1 |
| | 238 | 0 | 1 | 1 | 0 |
| | 239 | 1 | 0 | 1 | 0 |

| FRAME | ADDRESS 198 | SCAN FUNCTION DATA 144 | | | |
|---|---|---|---|---|---|
| | | w0 | w1 | w2 | w3 |
| 4TH | 0 | 0 | 0 | 0 | 0 |
| | 1 | 1 | 0 | 0 | 1 |
| | 2 | 0 | 0 | 1 | 1 |
| | 3 | 1 | 0 | 1 | 0 |
| | 4 | 0 | 0 | 0 | 0 |
| | 5 | 1 | 0 | 0 | 1 |
| | 6 | 0 | 0 | 1 | 1 |
| | 7 | 1 | 0 | 1 | 0 |
| | ⋮ | ⋮ | ⋮ | ⋮ | ⋮ |
| | 236 | 0 | 0 | 0 | 0 |
| | 237 | 1 | 0 | 0 | 1 |
| | 238 | 0 | 0 | 1 | 1 |
| | 239 | 1 | 0 | 1 | 0 |

MATRIX TYPE LIQUID CRYSTAL DISPLAY DEVICE WITH DATA ELECTRODE DRIVING CIRCUIT IN WHICH DISPLAY INFORMATION FOR ONE SCREEN IS WRITTEN INTO AND READ OUT FROM DISPLAY MEMORY AT MUTUALLY DIFFERENT FREQUENCIES

CROSS REFERENCES OF RELEVANT APPLICATIONS

The present application relates to subject matter described in applications Ser. No. 07/395,595 filed on Aug. 18, 1989 issued as U.S. Pat. No. 5,038,139 on Aug. 6, 1991; Ser. No. 07/472,306 filed on Jan. 30, 1990 issued as U.S. Pat. No. 5,206,635 on Apr. 17, 1993; Ser. No. 08/003,448 filed on Jan. 12, 1993; Ser. No. 08/015,896 filed on Feb. 10, 1993; Ser. No. 08/340,485 filed on Nov. 14, 1994; Ser. No. 08/297,058 filed on Aug. 29, 1994; Ser. No. 08/120,551 filed on Sep. 14, 1993; and Ser. No. 07/553,376 filed on Jul. 17, 1990. The disclosures of these applications are incorporated herein by reference.

BACKGROUND OF THE INVENTION

The present invention relates to a liquid crystal display device and more particularly to a liquid crystal driving system which operates to actuate a simple matrix type liquid crystal to achieve a high-contrast and multitone display.

As a method for driving a liquid crystal display device having a simple matrix type liquid crystal display panel, there has been known a voltage averaging method described in "Handbook of Liquid Crystal Device" Chapter six, Section two, edited by the 142th committee of Japan Society for the Promotion of Science. As a tone display system, there has been known a pulse width modulation system. This pulse width modulating system operates to control a pulse width of an on state of the voltage (referred to as an on voltage) given to a signal electrode for a selecting interval of a scan signal (referred to as one horizontal interval) so as to achieve a tone display having a luminance corresponding to the pulse width. As the pulse width modulation system, there may be referred a uniform pulse width modulation arranged to evenly divide one horizontal interval into pulses and combining the proper pulses for achieving a tone display and a weighting pulse width modulation arranged to weight each of the pulse widths into which one horizontal interval is divided and selectively combine the divided pulses for achieving a tone display. These modulations are disclosed in JP-A-52-76897. The summary of these modulations will be described with reference to FIGS. 46 to 53.

FIG. 46 is a block diagram showing one example of a conventional liquid crystal display device. A numeral 225 denotes a liquid crystal panel. A numeral 226 denotes a data electrode driving circuit. A numeral 227 denotes a scan electrode driving circuit. A numeral 228 denotes a voltage generating circuit. A numeral 229 denotes a timing signal generating circuit. A numeral 230 denotes a display data control circuit.

In FIG. 46, the data electrode driving circuit 226 operates to sequentially shift and accumulate liquid crystal display data 204 for series-connected liquid crystal cells (pixels) of one scan electrode (scan electrode for one row of liquid crystal cells of the liquid crystal panel) of the liquid crystal panel 225, the data 204 being fed from the display data control circuit 230, in response to a data shift clock for one scan electrode fed from the timing signal generating circuit 229. When the display data 204 stored in the data electrode driving circuit 226 reaches the data corresponding to one scan electrode, the timing signal generating circuit 229 operates to feed a data latch clock 214, on which the stored display data 204 for one scan electrode is loaded on the output side of the data electrode driving circuit 226.

At a time, the data electrode driving circuit 226 operates to select any one of an on voltage and an off voltage of the display (referred to as an off voltage) 222 fed from the voltage generating circuit 228. Then, the data electrode driving voltage corresponding to the display data 204 for one scan electrode loaded on the output side is applied to the X electrodes X1 to XN (N is a positive integer exept zero) corresponding to the liquid crystal panel 225 at one time.

On the other hand, the scan electrode driving circuit 227 accepts a line clock 213 from the timing signal generating circuit 229. When a head line clock 215 is read from the timing signal generating circuit 229, the head line Y1 of the liquid crystal panel 225 is selected for scanning. Then, the line to be selected for scanning at each time of feeding the line clock 213 shifts to Y2, Y3, . . . Then, if the last line YM (M is a positive integer except zero) is selected for scanning, again, the head line clock 215 is read from the timing signal generating circuit 229 to the scan electrode driving circuit 227. Then, the same operation is repeated. On the selected line, there is selectively applied any voltage of a scan selecting voltage 223 and a non-scan voltage 224 for driving the liquid crystal, those voltages being fed from the voltage generating circuit 228. As a result of this operation, at a display dot for a crosspoint between the selected line and the data electrode on the liquid crystal panel 225, a tone display is achieved so that the tone may conform to a voltage effective value of a difference of the applied voltage between the data electrode and the Y electrode of the display dot.

FIG. 47 shows a display characteristic of liquid crystal. This liquid crystal implements a tone display of luminance so that the luminance is defined in the range from a voltage Voff to Von changing substantially in proportion to the effective value of the applied voltage and the voltage effective value of a difference between a voltage applied to the data electrode and another voltage applied to the scan electrode belongs to the range.

FIG. 48 is a circuit diagram showing an arrangement of the voltage generating circuit 228. As shown, a simple series resistor circuit is provided to divide a reference voltage VLCD into driving voltages 221 to 224.

FIG. 49 is a block diagram showing an arrangement of a display data control circuit 230, in which numerals 231 and 232 denote line memories, numerals 233 and 234 denote data selectors, and a numeral 235 denotes a read selector. The data shift clock 211 also serves as a reading clock for the line memories 231 and 232 in FIG. 49. The data shift clock 211 is a signal having an n (n=3) time as large a frequency as the data clock and is generated from a fast clock 208.

In FIG. 49, the display data of parallel n bits for one horizontal interval is written alternately in the line memories 231 and 232. (Herein, n=3, and three bits forming the display data called 201, 202, 203 in sequence from the lowest bit.) From one of the line memories 231 and 232 in which the data is not now written, the data is read. The reading times in one horizontal interval are n times as great as the writing times. The display data composed of series three bits is read from the line memory. The read selector 235 is controlled by a write enable signal 210 for selecting the corresponding one of data selectors 233 and 234 to the one of the line memories 231 and 232 in which the data is now being read. The data selectors 233 and 234 are controlled by a data selecting signal 212 and operate to select the display data of three bits read out of the line memories 231 and 232 one bit by one bit and compose serial three-bit data. Then, the serial three-bit data is sent to the read selector 235. As a consequence of the above operation, the display data composed of parallel bits is converted into the display data composed of serial bits by the reading and writing operation of the line memories 231 and 232. The read selector 235 operates to feed the display data composed of serial bits to the data electrode driving circuit 226 shown in FIG. 46.

The line memories 231 and 232 are controlled to alternately read and write the display data in response to a write enable 210. The writing operation is done in synchronous to the write clock 209 during one horizontal interval, while the reading operation is done in synchronous to a data shift clock 211 having an n (n=3) times as fast a rate as the write clock 209 during one horizontal interval. The data is read one bit by one bit. Each bit 201, 202 or 203 of the display data is written in each of the line memories 213 and 232. The data is written in these line memories at a time but is read one bit by one bit in sequence. Hence, the read display data is composed of serial three bits.

The data selector 233 or 234 is switched by the data selector signal 212 and selects the bits sequentially read out of the line memory 231 or 232. These serial bits are sent through the read selector 235 to the data electrode driving circuit 226 as the display data.

In turn, with reference to FIGS. 50 and 51, the description will be oriented to the timing signals and the voltage waveforms applied to the liquid crystal in the case of the uniform pulse width modulation as shown in FIG. 46 with n=3.

In FIG. 50, a leading line signal 215 is a signal obtained by latching a vertical synchronous signal 205 with a horizontal synchronous signal 206. The line clock 213 is a signal having the same period as the horizontal synchronous signal 206. A write enable signal 210 is a signal obtained by dividing the horizontal synchronous signal 206. A write clock 209 is equivalent to the data clock 207. A data latch clock 214 is a signal having three times as great a frequency as the line clock 213. A data select signal 212 is a signal generated from the line clock 213 and the data latch clock 214. The display data 204 is read out of the line memory 232 one bit by one bit during one horizontal interval, and the serial read bits are represented as bits 1B, 2B and 3B. During the next horizontal interval, the data is read out of the line memory 231 one bit by one bit, and the serial read bits are represented as bits 1A, 2A and 3A.

FIGS. 51A, 51B, 51C and 51D show waveforms of voltages applied to a certain liquid crystal cell included in the liquid crystal panel 225 when the liquid crystal panel 225 is driven on these timing signals.

In FIGS. 51A, 51B, 51C and 51D, keeping eyes on a certain liquid crystal cell (pixel), one horizontal interval is divided into three parts. Then, each bit of the display data for the liquid crystal cell is allocated to each of the divided parts so that the voltage for each bit (that is, "1" or "0") is applied to the liquid crystal cell.

FIG. 51A shows a voltage waveform indicating an on display state of one horizontal interval when the bits 201, 202 and 203 of the display data are all "1". In this case, at each of the three divided interval parts, the data is kept high.

FIG. 51B shows a voltage waveform indicating an off display state of one horizontal interval when the bits 201, 202 and 203 of the display data are all "0". In this case, at each of the three divided interval parts, the data is kept low.

FIG. 51C shows a voltage waveform of a one-third on display in one horizontal interval if one of the bits 201, 202 and 203 of the display data is "1" and the left two are "0". In this case, one of the three-divided parts of the horizontal interval keeps high, while the other two keep low. Since one horizontal interval is evenly divided into three parts, the effective value of the applied voltage equally indicates a one-third on display of luminance if only one bit is "1". This is independent of the combination of "1" and "0" of the display data bits 201, 202 and 203.

FIG. 51D shows a voltage waveform of a two-thirds on display in one horizontal interval if two of the display data bits 201, 202 and 203 is "1" and the left two bits are "0". Like FIG. 51C, the effective value of the applied voltage equally indicates a two-thirds on display of luminance if two bits are "1". This is independent of the combination of "1" and "0" of the display data bits 201, 202 and 203.

As described above, the display data composed of three bits may provide the display with four tones of on, off, one-third on and two-thirds on.

Next, with reference to FIGS. 52 and 53, the description will be oriented to the timing signals as shown in FIG. 46 and the voltage waveforms applied to the liquid crystal panel 225 in the case of the weighting pulse width modulation.

In FIG. 52, a ratio of a value of three bits forming the display data is $2^0:2^1:2^2$, that is, 1:2:4. Hence, the ratio of the weight applied onto the division of one horizontal interval is 1:2:4 against the three bits. That is, a 1/7 part of one horizontal interval is allocated to the least significant bit. A 2/7 part of one horizontal interval is allocated to one upper bit than the least significant bit. A 4/7 part of one horizontal interval is allocated to the most significant bit.

Then, the data latch clock 214 operates to divide the period of the line clock 213 at a ratio of 1:2:4. The data select signal is generated from the line clock 213 and the data latch clock 214. The data shift clock 211 is a read clock on which data is read out of the line memories 231 and 232. The data shift clock 211 is generated by sequentially switching a clock having seven times as great a frequency as the data clock and a clock having 7/2 times as great a frequency as the data clock in response to the data select signal 212. The data shift clock 211 is a fast clock 208. The leading line signal 215, the line clock 213, the read enable signal 210 and the write clock 209 are the timing signals as in the case of the above uniform pulse width modulation.

FIGS. 53A, 53B and 53C show the waveforms of the voltages applied to the liquid crystal panel 225 on these timing signals.

In FIGS. 53A, 53B and 53C, when one horizontal interval is divided so that the divided part may be allocated to each bit of the display data, FIG. 53A indicates a voltage waveform of one horizontal interval with 1/7 on display when the bit 201 of the display data is "1" and the bits 202 and 203 are "0". In this case, at the first 1/7 part of the horizontal interval, the data is kept at high level, while at the remaining parts, the data is kept at low level.

FIG. 53B indicates a voltage waveform of one horizontal with 2/7 on display when the bits 202 of the display data is "1" and the bits 201 and 203 of the display data are "0". In this case, at the first 1/7 part to the 2/7 part of the horizontal interval, the data is kept at high level, while at the remaining parts, the data is kept at low level.

FIG. 53C indicates a voltage waveform of one horizontal with 4/7 on display when the bit 203 of the display data is "1" and the bits 201 and 202 are "0". In this case, at the first 4/7 parts of the horizontal interval, the data is kept at high level, while at the remaining 3/7 parts, the data is kept at low level.

Though another form may be arranged, in essence, one horizontal interval is divided into three parts at a ratio of 1:2:4. Hence, the combination of "1" and "0" of the bits 201, 202 and 203 of the display data makes it possible to achieve totally eight ($2^3$) tones of the on display state composed of on, off, 1/7 on, 2/7 on, 3/7 on, 4/7 on, 5/7 on and 6/7 on.

As another example of a tone display system as described above, a driving system has been disclosed in JP-A-4-57018. This driving system uses a fast responsive liquid crystal material for realizing high contrast on the display. In recent days, the liquid crystal display is widely used as a display device dedicated to a small information instrument such as a personal computer or a wordprocessor apparatus. The display device for such an information instrument requires the liquid crystal itself to be so fast responsive that the liquid crystal display may quickly follow scrolling of a screen or motion of a mouse. However, the conventional driving system has a disadvantage that it does not offer a sufficiently high contrast if it uses a fast responsive liquid crystal material. To overcome the disadvantage, JP-A-4-57018 has proposed such a technique as driving the liquid crystal on a high frame frequency so that a high contrast may be implemented on the display if it uses a fast responsive liquid crystal material.

In implementing the tone display based on the uniform pulse width modulation, the conventional simple matrix type liquid crystal display device does not implement only (n+1) tones on the display if the display data is outputted on n times as great a frequency as the horizontal frequency of the inputted display data (for example, 4-tone display in the case of n=3). Hence, this type liquid crystal display device cannot offer far more tones as compared to a magnification (n) of an input/output horizontal frequency of the display data.

In implementing the tone display based on the weighting pulse width modulation, on the other hand, as described above, the $2^n$-tone display (for example, 8-tone display is implemented from 3-bit display data) can be achieved according to the n-bit display data. This system, however, needs a considerably fast (seven times the horizontal frequency of the inputted display data) data shift clock on which the data electrode driving circuit reads the display data, so that the data shift clock may be higher than a rated frequency of the data shift clock. In this case, the LCD device may malfunction so that it cannot realize a desired tone display.

Further, the liquid crystal display device, disclosed in the above publication, composed of a fast responsive liquid crystal material is required to have a higher frame frequency for enhancing a display contrast. However, the frequency of the data shift clock on which the data electrode driving means operates is made higher proportionally as the frame frequency becomes higher. Hence, the liquid crystal display device needs such a data electrode driving means as matching to a higher frequency of the data shift clock. The foregoing publication does not suggest such means as matching to a higher frequency. As another disadvantage, the power consumed in the data electrode driving means is raised with the rise of the data shift clock frequency. The foregoing publication does not suggest any means for solving this disadvantage.

Moreover, the conventional liquid crystal display device arranged to use a medium-speed or a slow responsive liquid crystal material widely uses a voltage meaning method. To drive the liquid crystal display screen consisting of 240 lines according to the voltage averaging method, the data electrode driving means and the scan electrode driving means need a withstand voltage of 30 Volt or more.

The liquid crystal material is made degraded in its characteristic if a dc voltage is being applied thereto for a long time. To overcome the degrade, the LCD device is ac driven in a manner that the polarity of the voltage applied to the liquid crystal is reversed in a frame period, a horizontal interval or a magnified period of such a period. The ac driving based on the voltage meaning method brings about a change of about 30 V when the data voltage outputted from the data electrode driving means or the scan voltage outputted from the scan electrode driving means is switched in polarity. As an ac period is made shorter, therefore, the power consumed in the LCD device is disadvantageously increased.

SUMMARY OF THE INVENTION

It is an object of the present invention to provide a liquid crystal display device which is arranged to use a fast responsive liquid crystal material and the driving circuit of the LCD device which operates to drive the liquid crystal at a high frame frequency for realizing high contrast on the display.

It is a further object of the present invention to provide a liquid crystal display device and a driving circuit thereof which are arranged to use a uniform pulse width modulation for realizing a 2n-tone display with about n times as great a data shift clock frequency as a horizontal frequency of the inputted display data.

It is a still further object of the present invention to provide a liquid crystal display device and a driving circuit thereof which are arranged to reduce a power consumption when driving a liquid crystal at a high frame frequency.

It is another object of the present invention to provide a liquid crystal display device and a driving circuit thereof which are arranged to reduce a power consumption if they use the conventional middle-fast or slow responsive liquid crystal.

According to an aspect of the invention, the data electrode driving circuit is provided to have a frame memory in which display data is written and to drive a liquid crystal panel at a high frame frequency by reading the display data from the frame memory at a faster speed than the input speed.

The liquid crystal display device according to the present invention includes N (N is a positive integer except zero) data electrodes and M (M is a positive integer except zero) scan electrodes, a liquid crystal display panel having pixels disposed at cross-points of the data electrodes and the scan electrodes, and a data electrode driving circuit. The data electrode circuit includes a memory device from or into which display information is read or written, a write control circuit for controlling write of the display information into a memory area of the memory device, a read control circuit for reading out the display information corresponding to the N data electrodes from the memory area at a time at a different period from the writing period, and an output circuit for converting the display information read out of the memory device into the corresponding display voltage and feeding the display voltage to the data electrode.

The liquid crystal display device according to an embodiment of the present invention provides a data electrode driving circuit for providing a display voltage corresponding to each of the n-divided parts of one horizontal interval according to the n-bit display data and a scan electrode driving circuit for giving a scan voltage for selectively indicating a scan line. A voltage corresponding to a difference between the scan voltage and the display voltage is applied to a liquid crystal cell at each crosspoint between the scan electrode and the data electrode for achieving a tone display. In order to achieve a multitone display, the scan voltage given to the scan electrode by the scan electrode driving circuit keeps a constant amplitude in one horizontal interval, and the display voltage given to the data electrode by the data electrode driving circuit is changed in amplitude at each of n-divided parts of one horizontal interval.

Further, the liquid crystal display device according to another embodiment of the present invention provides a data electrode driving circuit which operates to generate only a display voltage according to an on or off display state.

Moreover, the liquid crystal display device according to another embodiment of the present invention provides a data electrode driving means which includes a line memory for storing display data corresponding to n lines, scan function data generating means for generating a scan signal, and an operating unit for performing an operation with respect to the display data for n lines and the scan function data. The data electrode driving means operates to select one of (m+1) voltages given as an operated result of the operating unit and give the selected voltage to the liquid crystal panel as a display voltage for implementing the display according to the given voltage.

Since the data electrode driving circuit provides a frame memory in itself, the liquid crystal is allowed to be driven at a high frame frequency as keeping the transfer speed of the display data from the outside as it is. This results in keeping the contrast high when driving the liquid crystal panel made of a fast responsive liquid crystal material and realizing the liquid crystal display device provided with a high-contrast display.

Since one horizontal interval is divided into n parts and the display voltage is changed in amplitude at each divided part, the combination of the amplitudes of the display voltages at the selected parts results in implementing a 2n-tone display.

In addition, since the data electrode driving circuit may be operated at low voltage, its power consumption is made lower.

BRIEF DESCRIPTION OF THE DRAWINGS

FIGS. 10A and 10B show a concrete memory map contained in a display memory shown in FIG. 1;

FIGS. 30A and 30B show a model view exemplarily showing a memory map contained in a display memory included in a liquid crystal display device and method according to a second embodiment of the present invention;

FIG. 50 is a timing view showing a conventional uniform pulse width modulation system;

FIGS. 51A, 51B, 51C and 51D show a driving waveform of the conventional uniform pulse width modulation system;

FIG. 52 is a timing view showing a conventional weighting pulse width modulation system;

FIGS. 53A, 53B and 53C show a driving waveform of the conventional uniform pulse width modulation system;

FIG. 70 is a view showing a concrete data stored in a scan function ROM shown in FIG. 68;

FIG. 71 is a view showing another concrete data stored in the scan function ROM shown in FIG. 68;

FIG. 72 is a view showing another concrete data stored in the scan function ROM shown in FIG. 68;

FIG. 73 is a view showing another concrete data stored in the scan function ROM shown in FIG. 68;

DETAILED DESCRIPTION OF THE PREFERRED EMBODIMENTS

Later, an embodiment of the present invention will be described with reference to the drawings.

Figure 1:
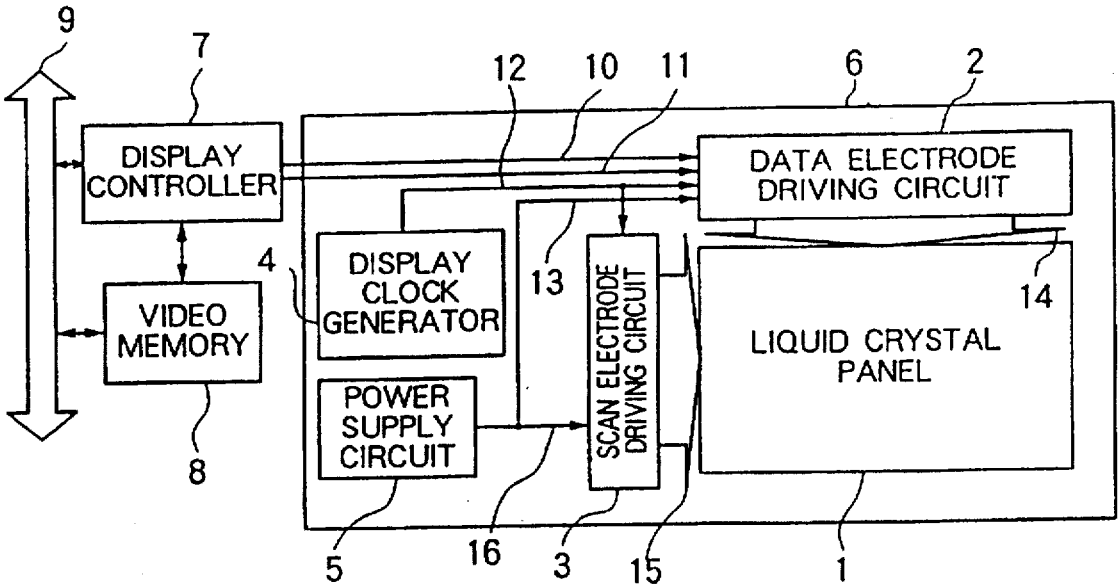
FIG. 1 is a block diagram showing a liquid crystal display device and method according to a first embodiment of the present invention.

FIG. 1 is a block diagram showing a liquid crystal display device and method according to a first embodiment of the present invention. In FIG. 1, a numeral 1 denotes a liquid crystal panel. A numeral 2 denotes a data electrode driving circuit. A numeral 3 denotes a scan electrode driving circuit. A numeral 4 denotes a display clock generator. A numeral 5 denotes a power supply circuit. A numeral 6 denotes a liquid crystal display module. A numeral 7 denotes a display controller. A numeral 8 denotes a video memory. A numeral 9 denotes a system bus.

As shown in FIG. 1, the display controller 7 is a CRT controller HD6845 manufactured by Hitachi, Ltd., for example. The display controller 7 and the video memory 8 composes a display system. The system bus 9 is a basic bus for coupling a personal computer or a wordprocessor apparatus (not shown) to a liquid crystal display device. Under the control of a CPU or a microprocessor (not shown) and a program stored in the memory, the display controller 7 is operated or the display data 10 is stored in the video memory 7.

The liquid crystal panel 1 includes N (N is a positive integer except zero) data electrodes, M (M is a positive integer except zero) scan electrodes, and pixels located at crosspoints of the data electrodes and the scan electrodes. This embodiment concerns with a simple matrix type STN liquid crystal display device provided with N=320 data electrodes and M=240 scan electrodes. The data electrode driving circuit 2 operates to output a data electrode driving signal 14 for driving the liquid crystal panel 1, while the scan electrode driving circuit operates to generate a scan electrode driving signal 15 for driving the liquid crystal panel 1. The power supply circuit 5 operates to generate a data reference voltage 13 which is a reference of the data electrode driving signal 14 outputted from the data electrode driving circuit 2 and a scan reference voltage 16 which is a reference of the scan electrode driving signal 15 outputted from the scan electrode driving circuit 3. The display clock generator 4 operates to generate a display clock 12 which is an operating reference of the data electrode driving circuit 2 and the scan electrode driving circuit 3 for driving the liquid crystal panel 1. The display data 10 (herein, composed of eight bits, which will be called 8-bit display data 10) and the input clock 11 are outputted from the display controller 7 and then sent to the data electrode driving circuit 2. Later, the description will be oriented to the operation of this embodiment.

The display controller 7 operates to read out the display data stored in the video memory 8 and then send it as 8-bit display data 10 out to the liquid crystal display module 6. The display controller 7 operates to send out the input clock 11 corresponding to a reference clock to the liquid crystal display module 6. This input clock is synchronized with the 8-bit display data 10.

Herein, the speed at which the display data 10 is sent out is represented by the times of sending out all the display data composing one screen, that is, a frame frequency. It is a normal frequency of 60 to 70 Hz.

The liquid crystal display module 6 operates to feed to the data electrode driving circuit 2 the 8-bit display data 10 sent out at the frame frequency of 60 to 70 Hz. This data electrode driving circuit 2 provides a data driver having a display memory (to be described later) built therein. The 8-bit display data 10 is temporarily stored in the display memory.

The display clock generator 4 operates to feed the display clock 12 to the data electrode driving circuit 2 and the scan electrode driving circuit 3. The display clock 12 has a higher frame frequency than that of the input clock 11. On this display clock 12, the display data 10 is read out of the data electrode driving circuit 2 and then is converted into the data electrode driving signal 14. Then, the signal 14 is sent to the liquid crystal panel 1. The readout of the display data on the display clock 12 having a higher frame frequency makes it possible to implement the display at a higher frame frequency.

On the other hand, the scan electrode driving circuit 3 operates to generate the scan electrode driving signal 15 on the display clock 12 and then feed the signal 15 to the liquid crystal panel 1. Further, the power supply circuit 5 is a dc voltage generator which enables to generate various dc voltages. The power supply circuit 5 operates to generate reference voltages of the data electrode driving signal 14 and the scan electrode driving signal 15 to be fed to the liquid crystal panel 1, that is, the data reference voltage 13 and the scan reference voltage 16.

Figure 2:
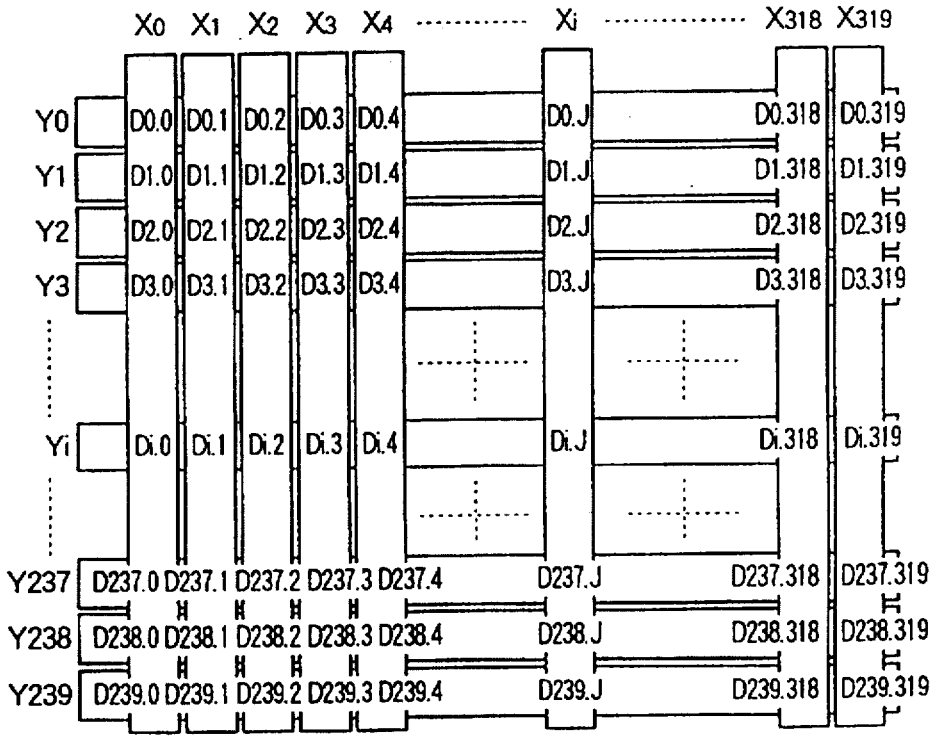
FIG. 2 is a schematic view showing a structure of a liquid crystal panel 1 shown in FIG. 1.

FIG. 2 is a schematic view showing a concrete structure of the liquid crystal panel 1 shown in FIG. 2. In FIG. 2, the liquid crystal panel 1 is composed of 320 data electrodes X0 to X319 and 240 scan electrodes Y0 to Y239 in a matrix manner. A display pixel $D_{ij}$ (wherein i denotes a line scan turn of a horizontal interval and j denotes a turn of a display pixel counted from the left of the screen) is located at each of the crosspoints of the data electrodes and the scan electrodes. In addition, such a number of electrodes is a mere example, and the present invention is not limited to these numbers of electrodes.

The data electrode driving signal 14 composed of 320 dots for one line is applied from the data electrode driving circuit 2 (see FIG. 1) to the data electrodes X0 to X319 at a time. The scan electrode driving signal 15 is applied from the scan electrode driving circuit 3 to each one of the scan electrodes Y0 to the scan electrodes Y239 in sequence each time the data electrode driving signal 14 is applied from the data electrode driving circuit 2 to the data electrodes X0 to X319.

Further, a liquid crystal material is sealed between the data electrodes X0 to X319 and the scan electrodes Y0 to Y239. The liquid crystal material changes its optical characteristic according to the voltage applied to each of those electrodes, for displaying a desired image. Each of the crosspoints of the data electrode and the scan electrode corresponds to a display pixel $D_{ij}$. In the arrangement shown in FIG. 2, 320×240 display pixels are provided. The waveforms of the voltages to be applied to the electrodes will be discussed below.

Figure 3:
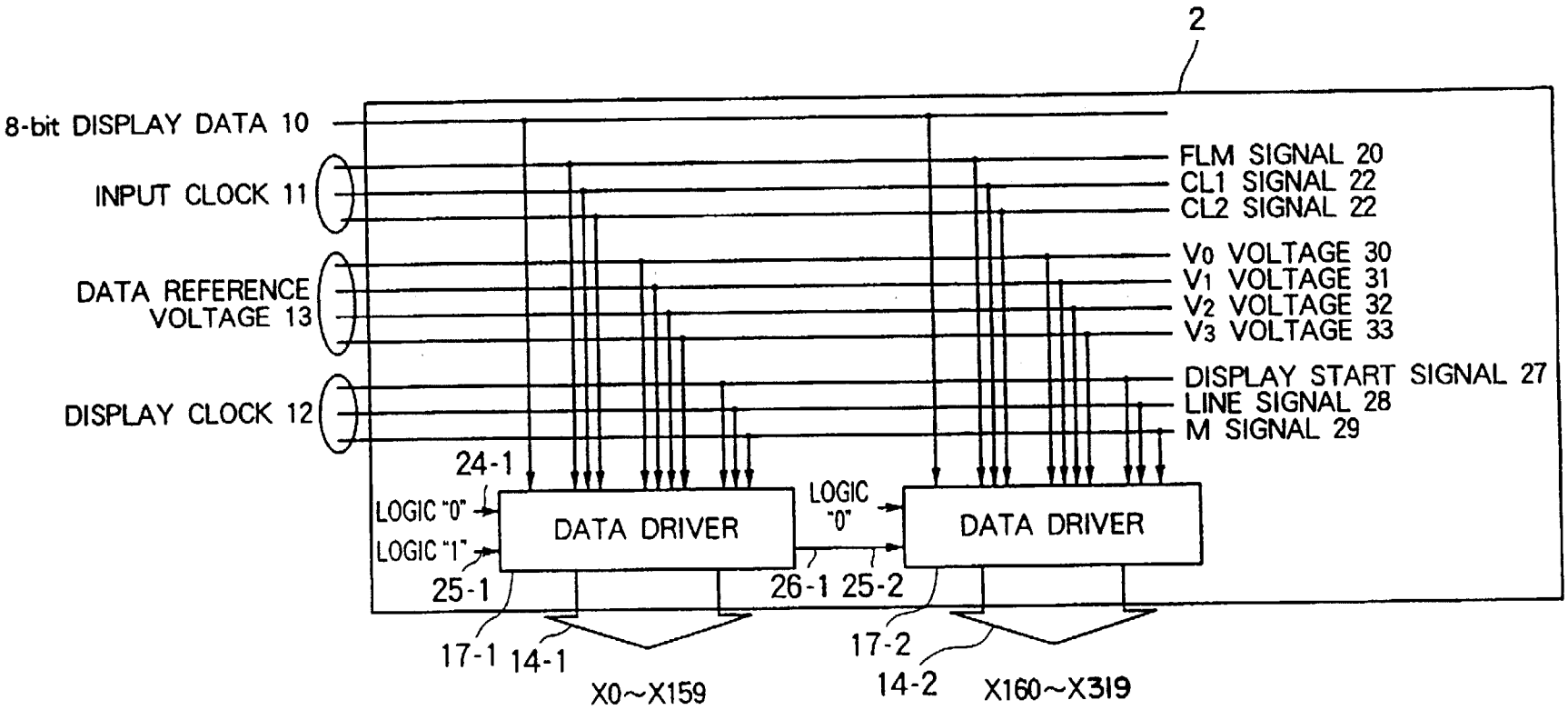
FIG. 3 is a block diagram showing a data electrode driving circuit shown in FIG. 1.

FIG. 3 is a block diagram showing a concrete arrangement of the data electrode driving circuit 2 shown in FIG. 1, in which 17-1 and 17-2 denote data drivers.

In FIG. 3, the data electrode driving circuit 2 is composed of the data drivers 17-1 and 17-2. The data driver 17-1 operates to generate a data electrode driving signal 14-1 to be fed to the data electrodes X0 to X159 of the liquid crystal panel 1, while the data driver 17-2 operates to generate a data electrode driving signal 14-2 to be fed to the data electrodes X160 to X319 of the liquid crystal panel 1. These data drivers 17-1 and 17-2 receive the 8-bit display data 10 and the input clock 11 sent from the display controller 7 (see FIG. 1), the display clock 12 sent from the display clock generator 4 (see FIG. 1), and the data reference voltage 13 sent from the power supply circuit 5 (see FIG. 1). The input clock 11 is composed of a FLM (frame) signal 20 at a period of one frame (one screen) and two clocks, that is, a CL1 signal 21 and a CL2 signal 22.

Figure 4:
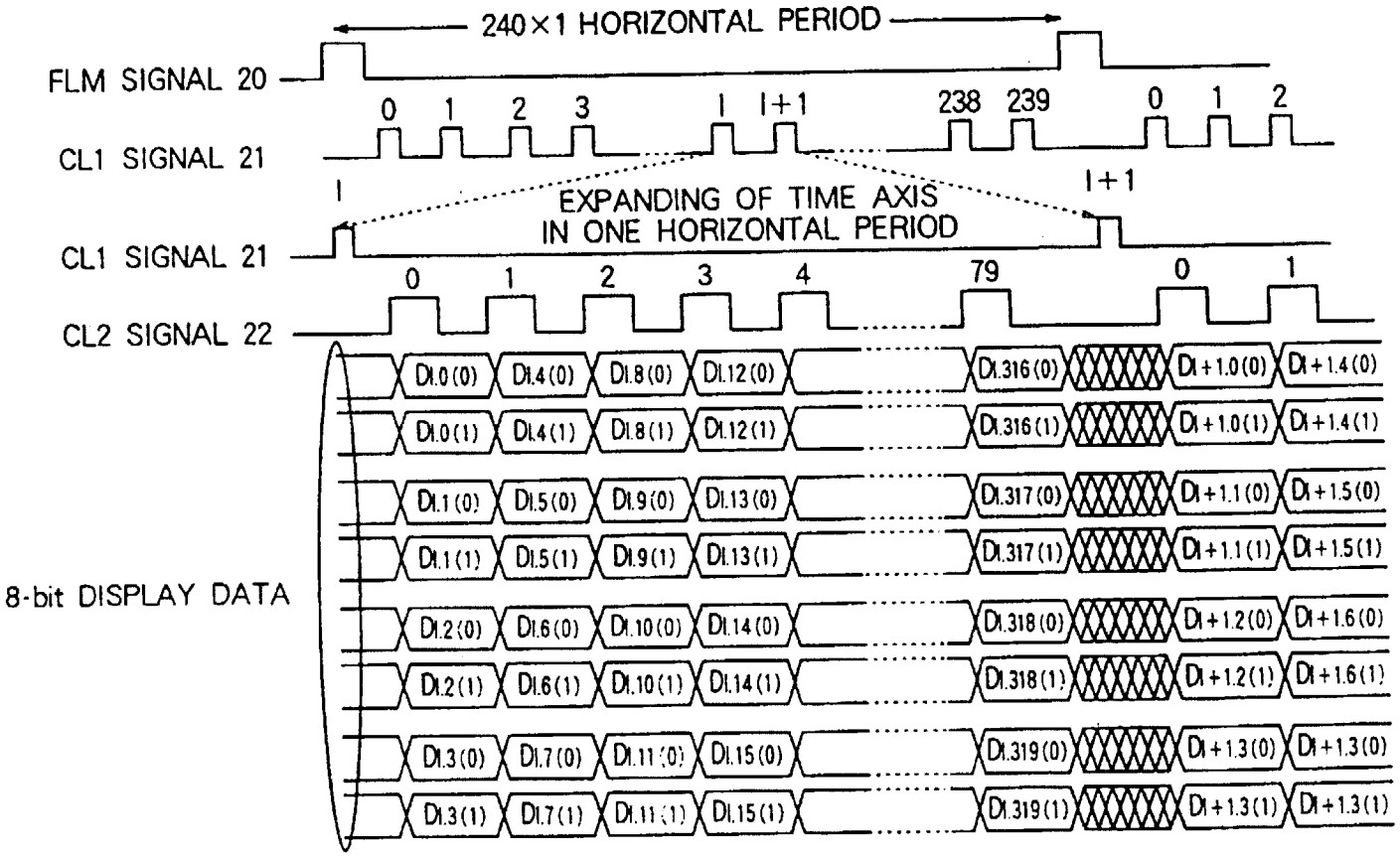
FIG. 4 is a view showing a timing relation among signals of the components shown in FIG. 3.

Next, with reference to FIG. 4, the timing relation among the 8-bit display data 10, the FLM signal 20, the CL1 signal 21, and the CL2 signal 22 will be now described. FIG. 4 shows a signal timing of each component shown in FIG. 3. The same signals in FIG. 4 as those in FIG. 3 have the same reference numbers.

The FLM signal 20 is a signal indicating that the 8-bit display data 10 for one screen (one frame) is sent out. An inverse of a period of the FLM signal 20 corresponds to the frame frequency. In this embodiment, this frame frequency is 60 Hz to 70 Hz as noted above.

During one period of the FLM signal (a one-frame period), the CL1 signal 21 is fed in the form of 240 pulses. The CL1 signal 21 is a clock generated each time the 8-bit display data 10 for one line is sent. One period of the CL1 signal 21 is one horizontal interval, and one frame corresponds to 240 horizontal intervals. The FLM signal 20 and the CL1 signal 21 are used for controlling the timing on which the display data is written to the display memory 43.

During one period of the CL1 signal 21, the CL2 signal 22 is fed in the form of 80 pulses. In synchronous to the CL2 signal, the 8-bit display data 10 is sent. Each 8-bit display data 10 is fed at each CL2 signal 22. One pixel data is composed of two bits. Hence, for each one CL2 signal 22, the 8-bit display data for four pieces of pixel data is sent. Hence, during one horizontal interval, 80 CL2 signals 22 are sent to the data electrode driving circuit 2. That is, the 8-bit display data 10 sent thereto contains totally 320 pixels=4×80. As mentioned above, the display data for one screen is sent to the data electrode driving circuit 2 at a frame frequency of 60 to 70 Hz and in synchronous to the CL1 signal 21 and the CL2 signal 22.

Again, turning to FIG. 3, the data reference voltages 13 fed from the power supply circuit 5 (see FIG. 1) to the data drivers 17-1 and 17-2 consist of four kinds of voltages, that is, V0 voltage 30, V1 voltage 31, V2 voltage 32 and V3 voltage 33. The display data 10, which is temporarily stored in the data drivers 17-1 and 17-2, are read out according to the display clock 12. Based on the data reference voltage 13, the data electrode driving signal 14 is generated, (which will be discussed in detail). A shift direction signal 23 and an enable input signal 25 are fed to the data drivers 17-1 and 17-2 for controlling the drivers, respectively.

Figure 5:
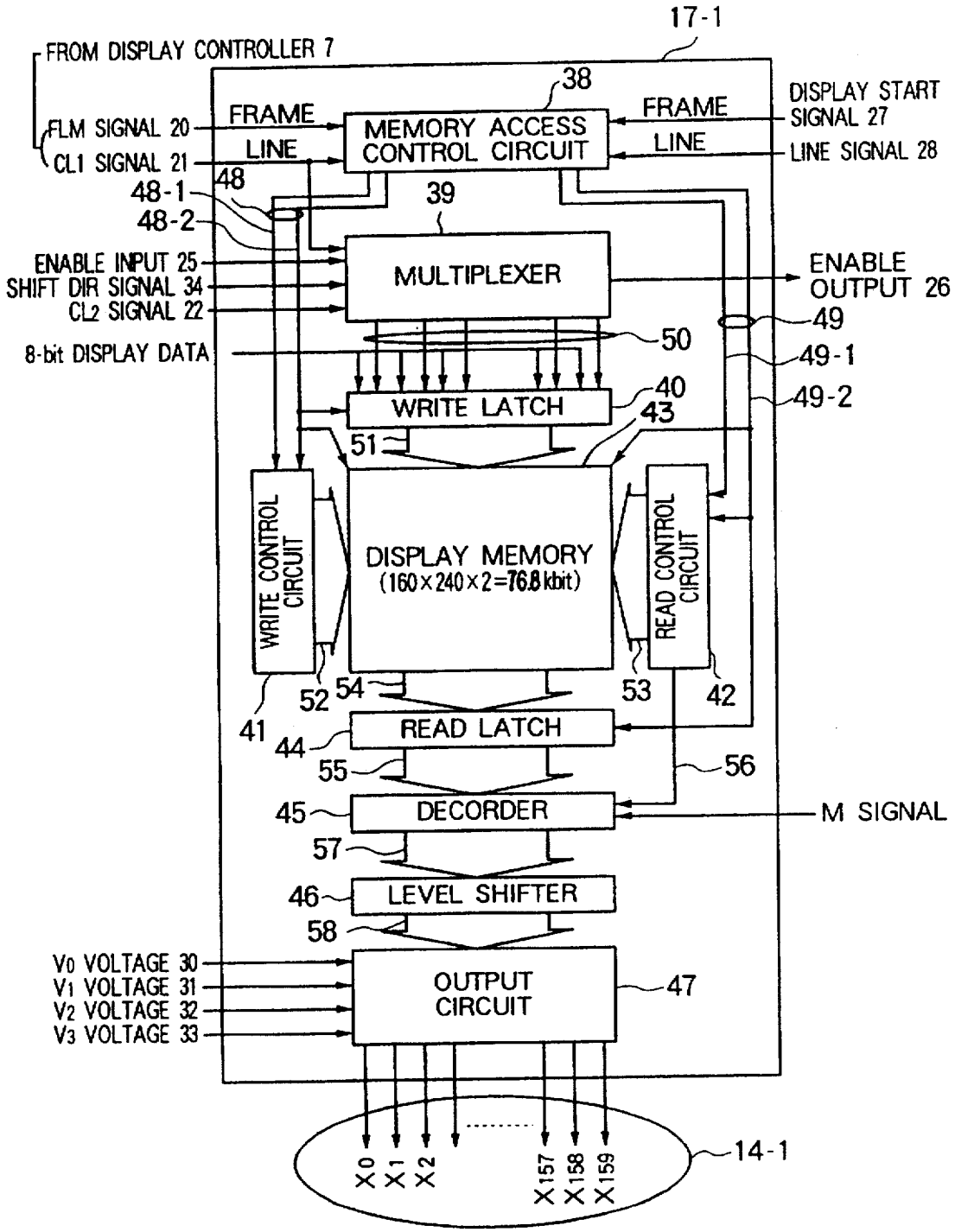
FIG. 5 is a block diagram showing a concrete arrangement of a data driver shown in FIG. 3.

FIG. 5 is a block diagram showing a concrete arrangement of the data driver 17-1 shown in FIG. 3. A numeral 38 denotes a memory access control circuit. A numeral 39 denotes a multiplexer. A numeral 40 denotes a write latch. A numeral 42 denotes a read control circuit. A numeral 43 denotes a display memory. A numeral 44 denotes a read latch. A numeral 45 denotes a decoder. A numeral 46 denotes a level shifter. A numeral 47 denotes an output circuit.

The data driver 17-2 has the same arrangement as described above, except that the enable output signal 26 outputted from the multiplexer 39 is fed as an enable input signal to the similar multiplexer.

In FIG. 5, the memory access control circuit 38 operates to control the write and the read of the display memory 43. The write latch 40 stores the 8-bit display data 10 composed of 160 display pixels corresponding to a half of one horizontal interval (which will be called one line) under the control of the multiplexer 39. In accordance with the indication given by the memory access control circuit 38, the stored display data for one line is fed as the display data 51 to the display memory 43. The display memory 43 stores the display data 51 for one line in a predetermined address according to a write address 52 sent from the write control circuit 41 and outputs the stored display data as memory read data 54 according to the read address 53 sent from the read control circuit 42. The read latch 44 operates to latch this memory read data 54 with a control signal 49 sent from the memory access control circuit 38 and feeds as the read latch output data 55 to the decoder 45. The decoder 45 operates to generate a decode signal 57 from this read latch output data 55, a data bit signal 56 sent from the read control circuit 42, and an M signal 29 to be described later. The decode signal 57 is converted into an output circuit driving signal 58 through the effect of a level shifter 46. Then, the signal 58 is applied to the output circuit 47. The output circuit 47 selects one of a V0 voltage 30, a V1 voltage 31, a V2 voltage 32 and a V3 voltage 33 sent from the power supply circuit 5 (see FIG. 1) in response to the output circuit driving signal 58 and then outputs the selected voltage as the data electrode driving signal 14 for driving each of the data electrodes X0 to X159. Next, the foregoing concrete operation will be described below.

The 8-bit display data 10 is fed to the write latch 40. The write latch 40 is controlled by the multiplexer 39. That is, the multiplexer 39 operates to feed the latching signal to the write latch 40 in response to the CL1 signal 21 and the CL2 signal 22. The 8-bit display data 10 for one line, which is being fed in sequence, is temporarily stored in the write latch 40. The memory access control circuit 38 operates to generate the write control signal 48 from the FLM signal 20 and the CL1 signal 21. Then, the display data for one line temporarily stored in the write latch 40 is fed as the memory write data 51 to the display memory 43. At a time, the write control circuit 41 operates to generate the write address 52 and feed it to the display memory 43 for specifying a write address at which the memory write data 51 is written.

Further, the memory access control circuit 38 operates to generate a read control signal 49 from a display start signal 27 and a line signal 28 for reading out the display data stored in the display memory 43. The display start signal 27 indicates a head of one frame of the display data to be read out. The line signal 28 indicates a head of a line. Based on the read control signal 49, the read control circuit 42 generates a read address 53. In response to the read address signal, the display data for one line is read out of the display memory 43 as the memory readout data 54. This memory readout data 54 is latched and temporarily stored in the read latch 44.

The frequency on which the memory write data 51 is written in the display memory 43 is not necessarily equal to the frequency on which the memory readout data 54 is read out of the display memory 43. In particular, the use of fast responsive liquid crystal makes it possible to enhance the reading frequency, in which case the relevant effect will be discussed in detail.

Next, the memory readout data 54 temporarily stored in the read latch 44 is fed to the decoder 45 as the read latch output data 55. The decoder 45 operates to decode the output data 55 into a decode signal 57 with the data bit signal 56 and the M signal 29. This decode signal 57 is converted into an output driving signal 58 in the level shifter 46 and then fed to the output circuit 47. The output circuit 47 operates to select any one of a V0 voltage 30, a V1 voltage 31, a V2 voltage 32 and a V3 voltage 33 according to the output circuit driving signal 58 and then feed to the liquid crystal panel 1 (see FIG. 1) the selected voltage as the data electrode driving signal 14-1 for driving the data electrodes X0 to X159 shown in FIG. 2.

The data drivers 17-1 and 17-2 are operated as described above. Later, each of those components shown in FIG. 5 will be discussed in detail.

Figure 6:
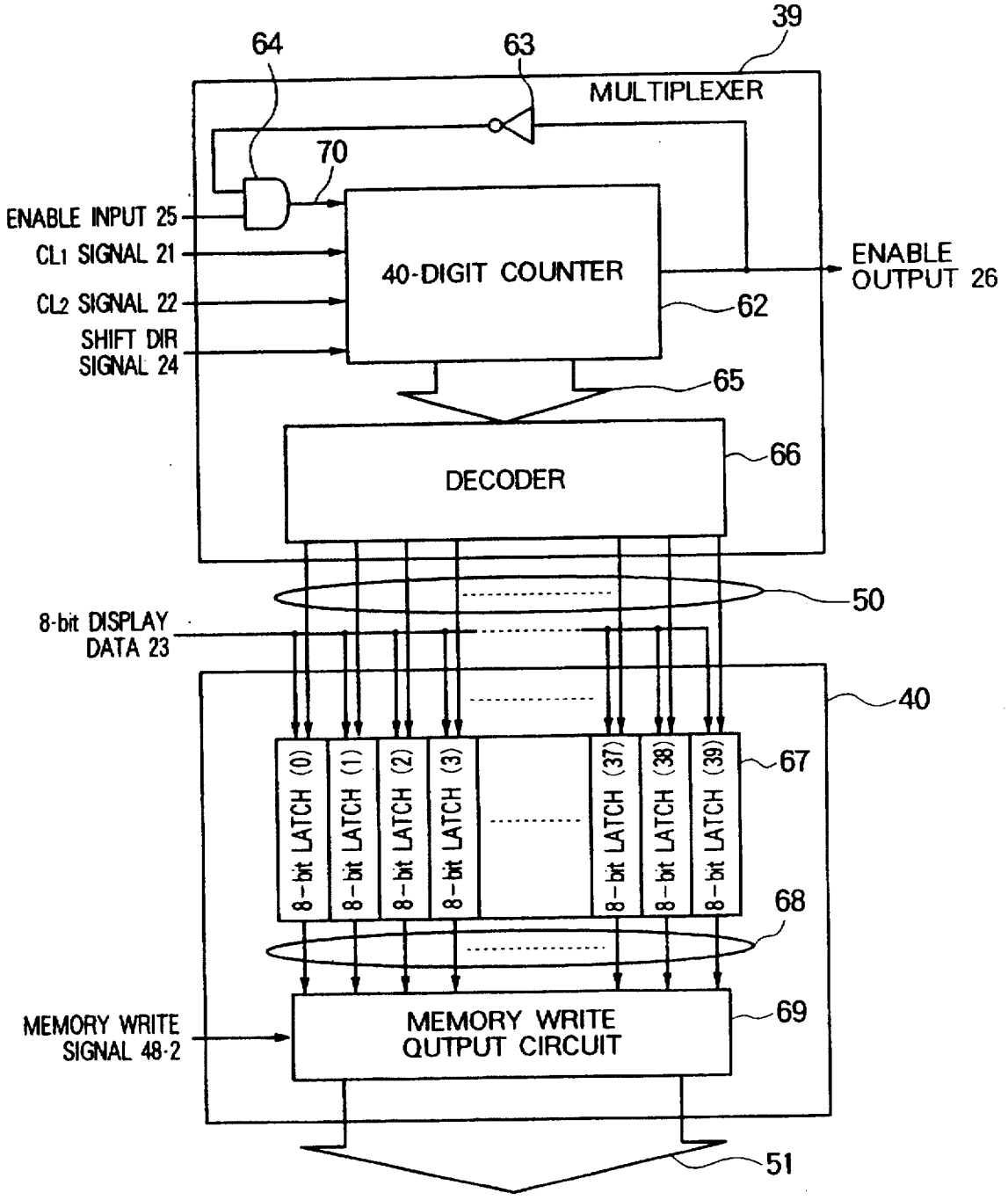
FIG. 6 is a block diagram showing concrete arrangements of a multiplexer and a write latch shown in FIG. 5.

FIG. 6 is a block diagram showing a concrete arrangement of the multiplexer 39 and the write latch 40 shown in FIG. 5. A numeral 62 denotes a 40-digit counter. A numeral 63 denotes a logical NOT circuit. A numeral 64 denotes a logical AND circuit. A numeral 66 denotes a decoder. A numeral 67 denotes forty 8-bit latches. A numeral 69 denotes a memory write feeding circuit. The components of FIG. 6 corresponding to those of FIG. 5 have the same reference numbers.

In FIG. 6, the multiplexer 39 is mainly composed of the 40-digit counter 62 and the decoder 66. The 60-digit counter 62 operates to count the CLS signal 22 and feed a count value 65 to the decoder 66. The enable input signal 25 is fed as a count enable signal 70 to the 40-digit counter 62 through the logical AND circuit 64. This count enable signal 70 is a signal for indicating execution or interruption of the 40-digit counter 62. When the signal has a logic 1, the 40-digit counter 62 starts to count in response to the signal, while when the signal has a logic 0, the counter 62 stops its count in response.

The CL1 signal 21 is a signal for clearing or presetting a count value of the 40-digit counter 62. Clearing or presetting is selected in response to the shift direction signal 24. When the shift direction signal 24 has a logic 0, the 40-digit counter 62 is cleared as zero in response to the CL1 signal 21. Each time the CL2 signal 22 is fed, the count value is sequentially increased in such a manner as 1, 2, 3, . . . When the shift direction signal 24 has a logic 1, the 40-digit counter 62 is preset as a value 40 in response to the CL1 signal 21. Each time the CL2 signal 22 is fed, the count value is decreased in sequence in such a manner as 40, 39, 38, . . . .

The 40-digit counter 62 operates to output the enable output signal 26 of the logic 1 when the CL2 signal 22 is counted 40 times. After the logical NOT circuit 63 determines the signal 26 is at the logic 0, the signal 26 is fed to the logical AND circuit 64 so that the count enable signal 70 is made to have a logic 0. In response to this signal 70, the 40-digit counter 62 stops its counting operation.

Further, the count value 65 of the 40-digit counter 62 is decoded in the decoder 66. Then, the decoded signal is fed as the 8-bit latch signal 50 to the write latch 40.

Figure 7:
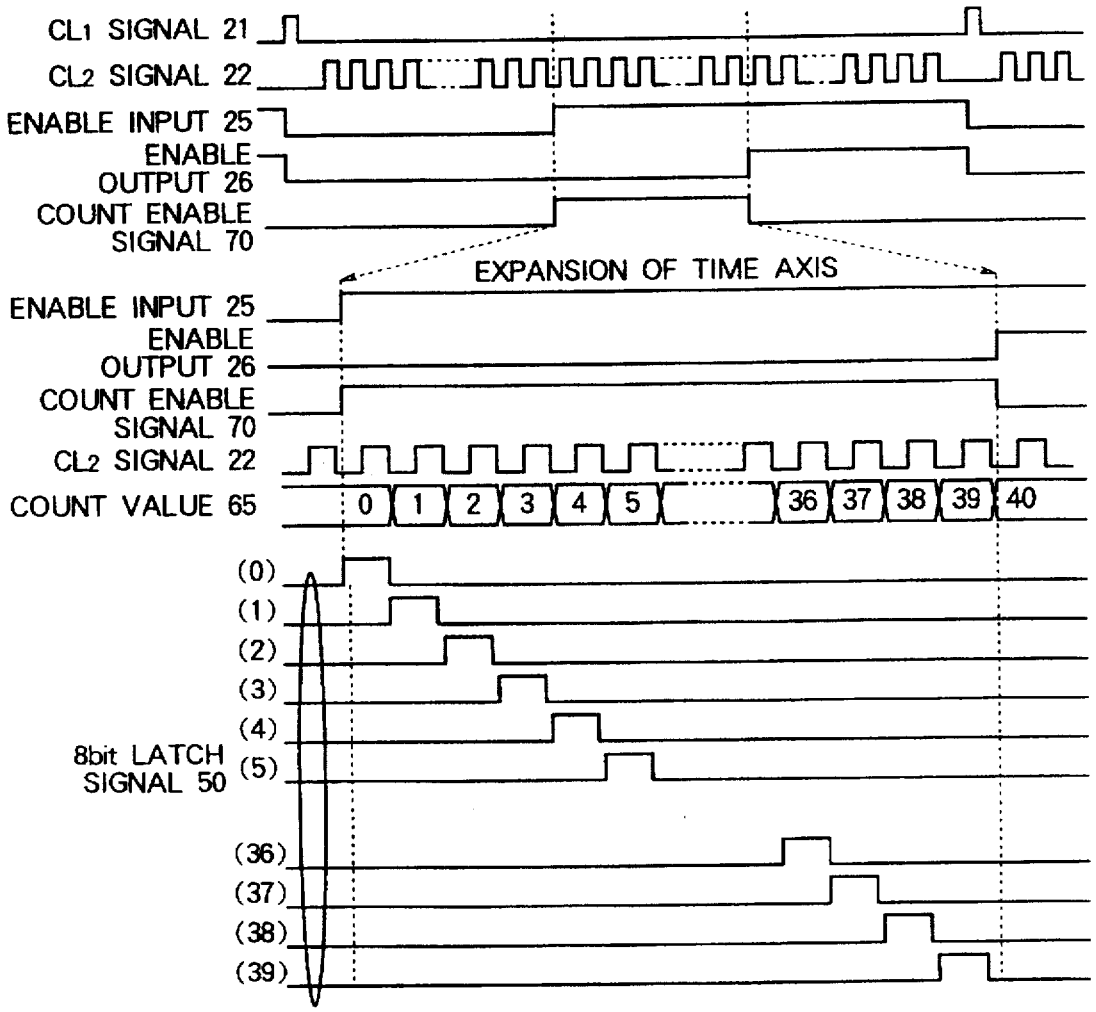
FIG. 7 is a view showing operating timings of a 40-digit counter and a decoder shown in FIG. 6.

FIG. 7 is a view showing an operating timing of the 40-digit counter 62 and the decoder 66.

In FIG. 7, the 40-digit counter 62 is controlled by the enable input signal 25, the CL1 signal 21 and the CL2 signal 22. Given the CL1 signal 21, the 40-digit counter 62 is initialized so that the count value 65 becomes zero. At a time, the enable output signal 26 outputted from the 40-digit counter 62 is initialized to have a logic 0.

Next, the CL2 signal 22 is inputted to the 40-digit counter 62. While the enable input signal 25 keeps its logic 0, the 40-digit counter 62 keeps its count value 65 initialized as zero. That is, since the enable input signal 25 keeps its logic 0, the logical AND circuit 64 operates to fix the count enable signal 70 at the logic 0. Hence, the 40-digit counter 62 keeps its operation stopped.

Then, when the enable input signal 25 is made to have a logic 1, the logical AND circuit 64 causes the count enable signal 70 to have a logic 1. In response to the first CL2 signal being fed thereafter, the count value 65 of the 40-digit counter 62 is increased in sequence in such a manner as 0, 1, 2, 3, 4, . . . each time the CL2 signal 22 is fed. When the count value 65 of the 40-digit counter 62 reaches 40, the enable output signal 26 is made to have a logic 1. Hence, the count enable signal 70 gets to have a logic 0, so that the 40-digit counter 62 stops its operation. This enable output signal 26 is used for operating the data driver 17-2.

During the above-mentioned operation, the count value 65 of the 40-digit counter 62 is decoded by the decoder 66, so that forty 8-bit latch signals 50 are made to have a logic 1 in sequence. These 8-bit latch signals 50 are fed to the write latch 40. The write latch 40 is composed of forty 8-bit latches 67 and the memory write feeding circuit 69. The 8-bit display data 10 is read and temporarily stored in a selected one of these forty 8-bit latches 67 to which selected one the 8-bit latch signal 50 of the logic 1 is fed. Hence, the 8-bit display data 10 is stored in each of the forty 8-bit latches 67 one piece by one piece (8 bits, that is, four display pixels). The temporarily stored 8-bit display data 10 is fed to the memory write output circuit 69 as the 8-bit latch signal 68.

Figure 8:
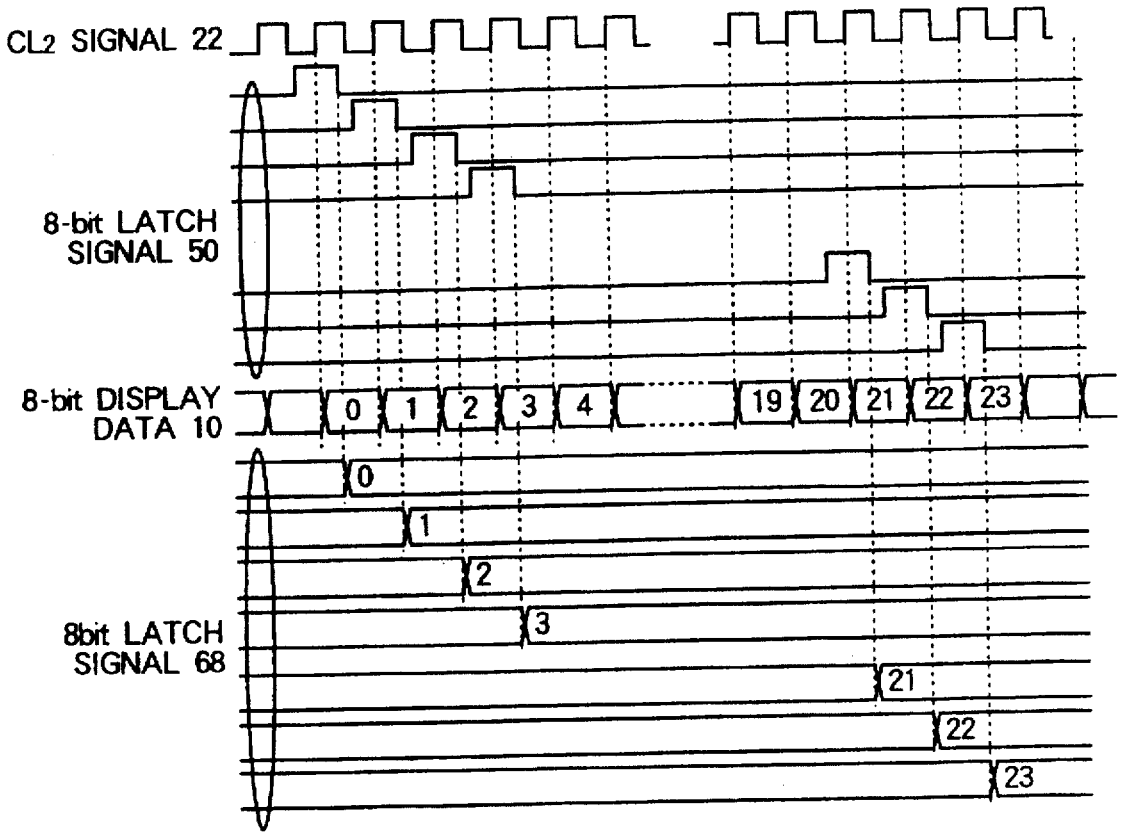
FIG. 8 is a view showing an operation of a 8-bit latch shown in FIG. 6.

With reference to FIG. 8, the operation of the 8-bit latch 67 will be discussed in detail.

With the 8-bit latch signal 50 having a logic 1 being fed in sequence, the 8-bit display data 10 is sequentially latched by the forty 8-bit latches 67, so that the forty latched 8-bit data are outputted as 8-bit latch signals 68. By latching the 8-bit display data 10 being fed in sequence, the forty 8-bit latches 67 temporarily store the 8-bit display data for one overall line (that is, 160 display pixels).

The 8-bit latch signal 68 outputted from each of the 8-bit latch 67 is fed to the memory write output circuit 68. When the memory write signal 48-2 is made to have a logic 1, the 8-bit latch signals are fed as the memory write data 51 to the display memory 43 shown in FIG. 5.

Figure 9:
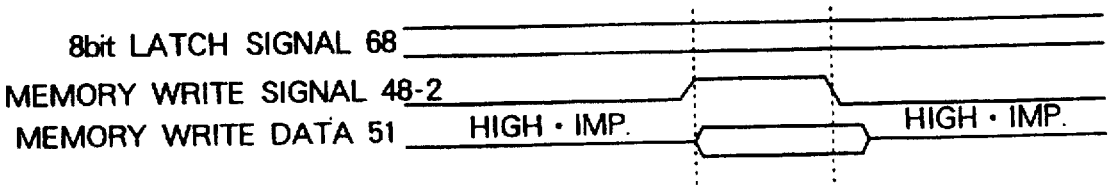
FIG. 9 is a view showing an operating timing of a memory write and output circuit shown in FIG. 6.

The feeding operation will be described with reference to FIG. 9. When the memory write signal 48-2 has a logic 1, the memory write output circuit 69 operates to output the 8-bit latch signal 68 as the memory write data 51. Further, when the memory write signal 48-2 has a logic 0, the memory write output circuit 68 keeps its output at high impedance.

The above description has concerned with the data driver 17-1 shown in FIG. 3. This holds true to the data driver 17-2, except that the enable output signal 26 fed from the 40-digit counter 62 shown in FIG. 6 provided in the data driver 17-1 is fed as an enable input signal to the 40-digit counter and, as shown in FIG. 7, when the enable output signal 26 is made to have a logic 1, the data driver 17-2 operates in the similar manner to the data driver 17-1 for generating the data electrode driving signal 14-2 of the liquid crystal panel 1 (see FIG. 2).

FIGS. 10A and 10B show a concrete arrangement of a memory map indicating a relation between each address of the display memory 43 shown in FIG. 5 and the stored display data.

As shown in FIGS. 10A and 10B, the display memory 43 is composed of two bit planes A and B and has a storage capacity of 76.8 kbit (=160 bits×240 lines×2 bit planes) in total. In addition, since the display memory 43 is composed of two bit planes, the 8-bit display data 10 is composed of four two-bit pixels which represents four tones. Hence, it goes without saying that the storage capacity is made variable according to the number of tone bits, the number of display dots and the number of lines contained in the 8-bit display data 10.

Each bit plane A or B of the display memory 43 corresponds to each tone bit of the display data 10. In writing data, hence, the memory write data 51 for one line sent from the write latch 40 is stored in the display memory 43 under the control of the memory access control circuit 38 and the write control circuit 41. Each tone bit (that is, two bits composing a pixel) is stored in the corresponding bit plane. For example, the bit 0 (that is, the upper bits, represented as $D_{ij}(0)$) of the display data $D_{ij}$ at the i-th row and the j-th column is stored in the corresponding predetermined write address of the bit plane A. The bit 1 (that is, the lower bits, represented as $D_{ij}(1)$) of the display data $D_{ij}$ at the i-th row and the j-th column is stored in the corresponding predetermined write address of the bit plane B.

In addition, the similar display memory in the data driver 17-2 stores the display data consisting of the display pixels $D_{i,160}$ to $D_{i,319}$.

On the other hand, each piece of display data stored in the display memory 43 is read out in sequence under the control of the memory access control circuit 38 and the read control circuit 42. At a time, the reading address is set to each of the bit planes A and B. In the arrangement shown in FIGS. 10A and 10B, the addresses 0 to 239 are set to the bit plane A and the addresses 240 to 479 are set to the bit plane B. Hence, the display data written in the display memory 43 are divided into 480 pieces and then are sequentially read 480 times.

Figure 11:
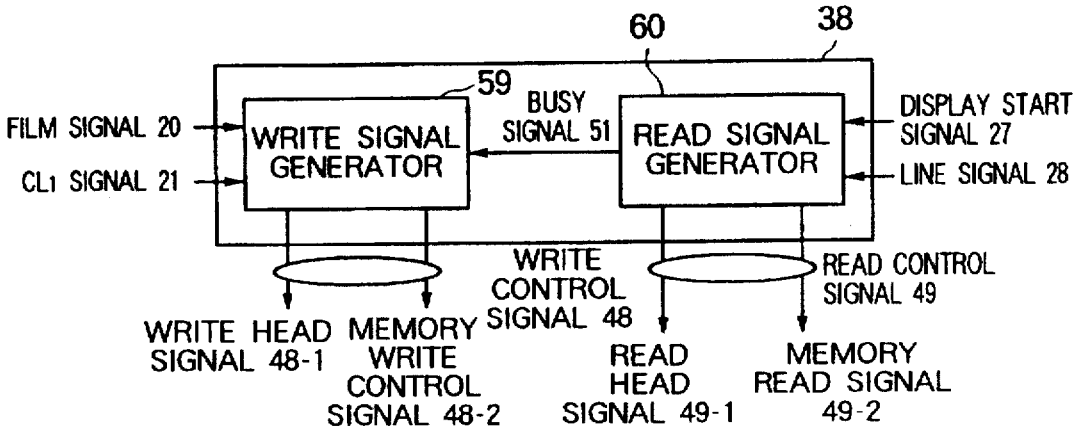
FIG. 11 is a block diagram showing a concrete arrangement of a memory access control circuit shown in FIG. 5.

FIG. 11 is a block diagram showing a concrete arrangement of the memory access control circuit 38 shown in FIG. 5, in which a numeral 59 denotes a write signal generating circuit and a numeral 60 denotes a read signal generating circuit.

In FIG. 11, the memory access control circuit 38 is composed of the write signal generating circuit 59 and the read signal generating circuit 60.

At first, the operation of the read signal generating circuit 60 will be described with reference to FIG. 12.

The read signal generating circuit 60 operates to generate a read control signal 49 and a busy signal 61 from the display start signal 27 and the line signal 28. If the write of the display data to the display memory is asynchronous to the read of the display data from the memory, both, that is, the writing access and the reading access to the memory may compete with each other. In this case, it is necessary to arbitrate both of the accesses so as to give a precedence to any one of the accesses. The busy signal 61 takes place for the arbitration. As shown in FIG. 12, the read head signal 49-1 is generated by logically reversing the display start signal 27. Further, the memory readout signal 49-2 lags behind the line signal 28 by a time $t_{wp}$ and thus is made to have a logic 1. After the time of interval $t_{rp}$, the signal 49-2 returns to the logic 1. Herein, the time of interval $t_{rp}$ is a set up time for reading the display data stored in the display memory 43 and a time required for writing the 8-bit display data 10 to the display memory 43, the latter time of which will be discussed in detail. Further, the busy signal 61 takes a logical OR of the line signal 28 and the memory readout signal 49-2. The busy signal 61 is outputted before the memory readout signal 49-2. With the read head signal 49-1 and the memory readout signal 49-2 being generated as above, the display data is read out of the display memory 43. This operation will be discussed later in detail.

Figure 13:
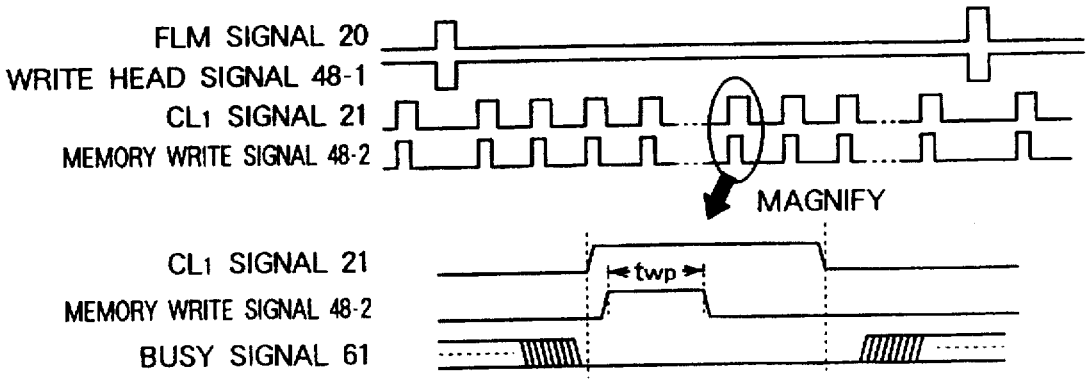
FIG. 13 is a timing view showing an operation of a write signal generating circuit shown in FIG. 11.
Figure 14:
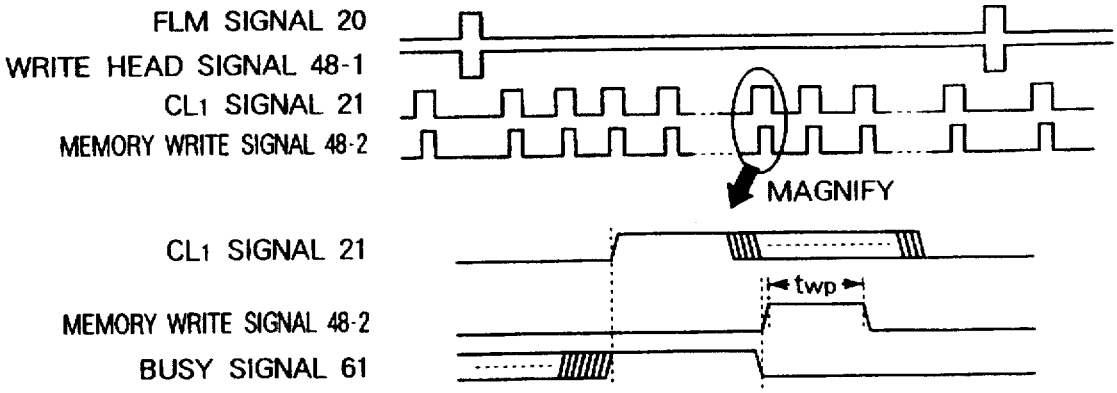
FIG. 14 is a timing view showing another operation of the write signal generating circuit shown in FIG. 11.

Next, the description will be oriented to the operation of the write signal generating circuit 59 with reference to FIGS. 13 and 14.

The write signal generating circuit 59 operates to generate the write head signal 48-1 and the memory write signal 48-2 from the FLM signal 20, the CL1 signal 21 and the CL2 signal 22. The write head signal 48-1 is generated by logically inverting the FLM signal 20. If the busy signal 61 has a logic 0, as shown in FIG. 13, the memory write signal 48-2 is generated as a pulse having a time duration $t_{wp}$ with the rise of the CL1 signal 21. If the busy signal 61 has a logic 1, as shown in FIG. 14, the memory write signal 48-2 is generated as a pulse having a time duration $t_{wp}$ which rises when the busy signal 61 changes its logic from 1 to 0.

Herein, the busy signal 61 having a logic 1 means an operation of feeding the memory readout signal 49-2 from the read signal generating circuit 60 (see FIG. 11) to the display memory 43 and reading the display data out of the display memory 43. Hence, the write of the data to the display memory 43 is awaited during the reading operation, that is, priority is given to the reading operation. In general, since the memory does not perform the read and the write at a time, under the above control of accessing the display memory 43, the write signal and the read signal takes place at a time.

Figure 12:
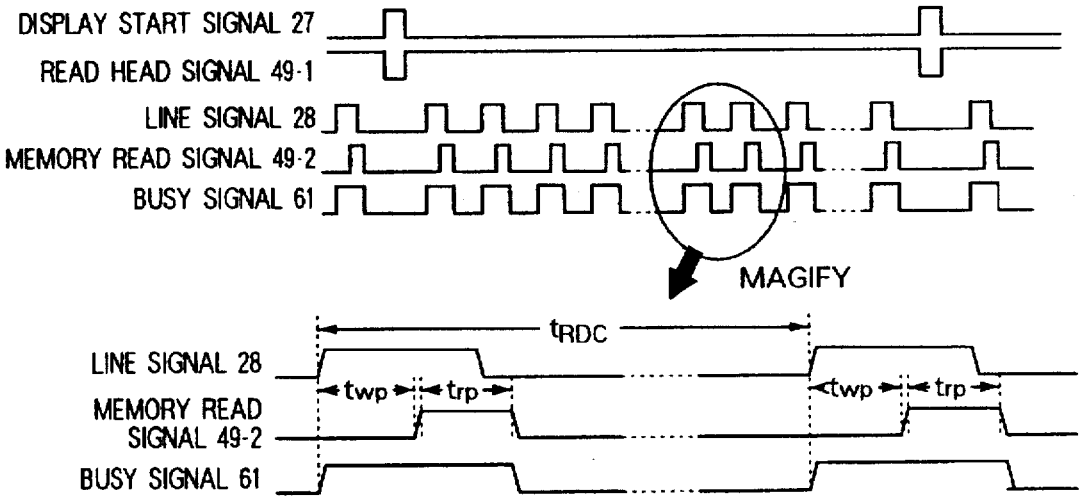
FIG. 12 is a timing view showing an operation of a read signal generating circuit shown in FIG. 11.

Further, as shown in FIG. 12, the busy signal 61 takes place before the memory readout signal 49-2 (that is, the memory readout signal 49-2 lags behind the line signal 28 by a time $t_{wp}$). If the line signal 28 rises during the writing operation to the display memory 43 (that is, at first, the busy signal 61 keeps its logic 0), the readout operation is started later than the rise of the line signal 28 by the time $t_{wp}$ without performing the memory readout operation immediately at the rise of the line signal. This is done for preventing simultaneous occurrence of the write and the read of the data into and from the display memory 43.

As noted above, the read signal generating circuit 60 and the write signal generating circuit 59 operate to control the accesses of reading from or writing into the display memory 43.

Figure 15:
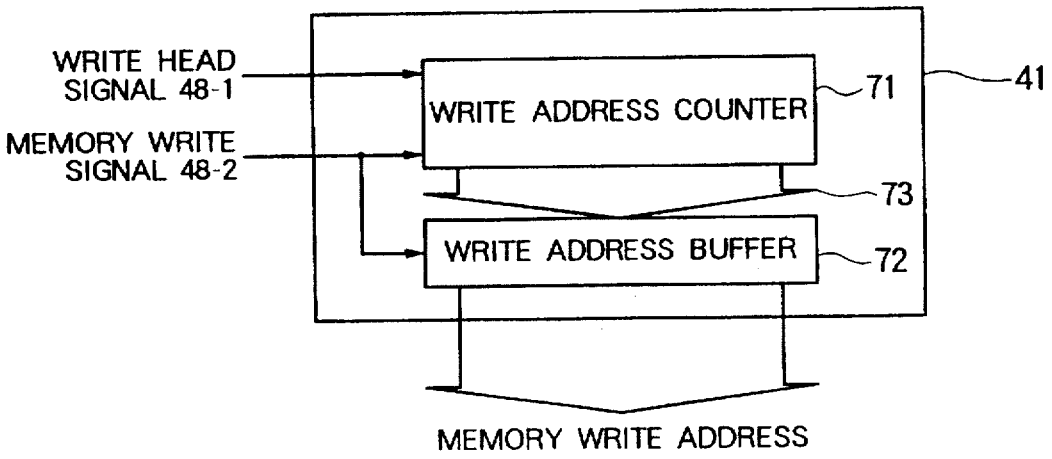
FIG. 15 is a block diagram showing a concrete arrangement of a write control circuit shown in FIG. 5.
Figure 16:
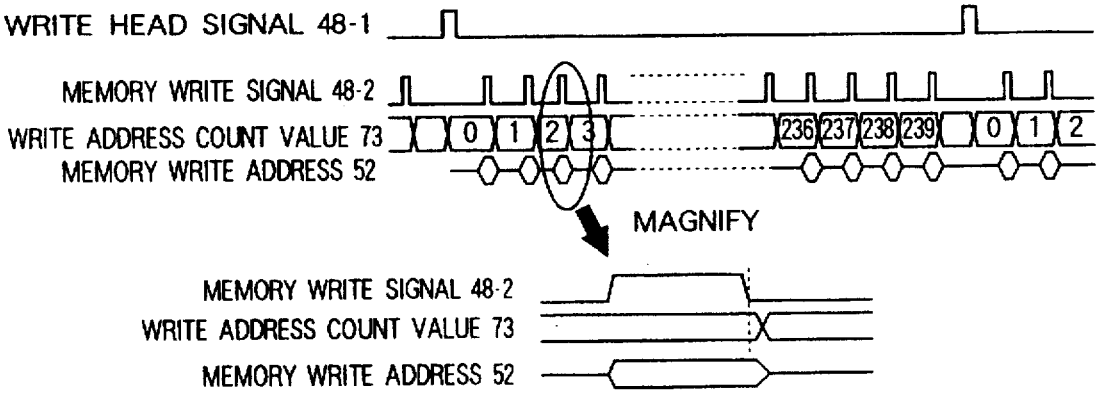
FIG. 16 is a timing view showing a concrete operation of the circuit shown in FIG. 15.

FIG. 15 is a block diagram showing a concrete arrangement of the write control circuit 41 shown in FIG. 5, in which a numeral 71 denotes a write address counter and a numeral 72 denotes a write address buffer. FIG. 16 is a timing view showing the concrete operation of the circuit 41, in which the same signals of FIG. 16 as those shown in FIG. 15 have the same reference numbers.

In FIG. 15, the write control circuit 41 is composed of the write address counter 71 and the write address buffer 72. The write address counter 71, as shown in FIG. 16, is initialized so that the count value is made zero each time the write head signal 48-1 is fed from the memory access control circuit 38 (see FIG. 5). Then, the counter 71 operates to count the memory write signal 48-1 from the memory access control circuit 38 and output the write address counter value 73 such as 0, 1, 2, . . . , increased in sequence.

The write address count value 72 is fed as the memory write address 52 to the display memory 43 (see FIG. 5) through the write address buffer 72. When the memory write signal 48-2 has a logic 0 (that is, during the interval when the memory write signal 48-2 keeps a pulse of logic 1), the write address buffer 72 keeps its impedance high without having to output the memory write address 52. When the memory write signal 48-2 keeps a logic 1, the write address buffer 72 operates to output the write address count value 73 as the memory write address signal 52 to the display memory 43 (see FIG. 5).

As noted above, when the memory write data 51 from the write latch 50 (see FIG. 5) is written in the display memory 43, the write control circuit 41 operates to feed the memory write address signal 52 to the display memory in response to the memory write signal 48-2.

Figure 17:
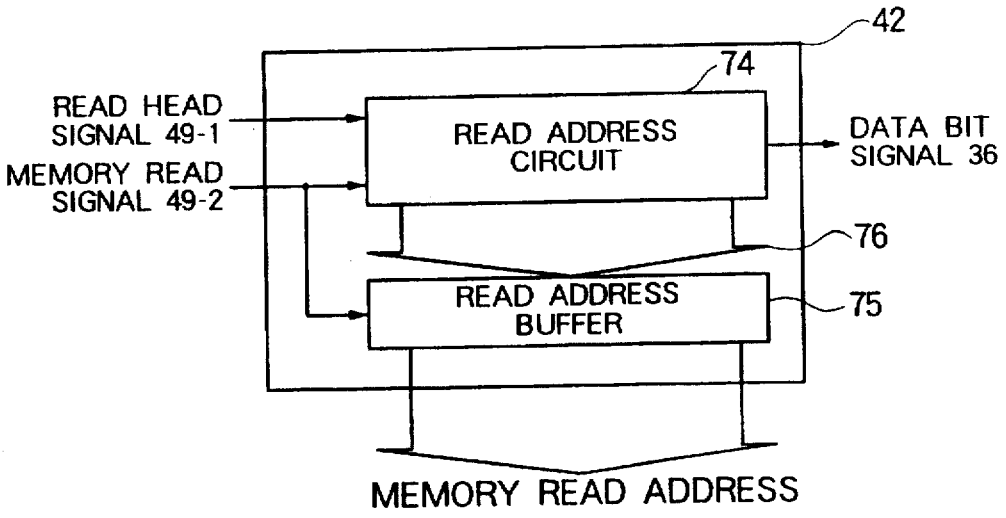
FIG. 17 is a block diagram showing a concrete arrangement of a read control circuit shown in FIG. 5.
Figure 18:
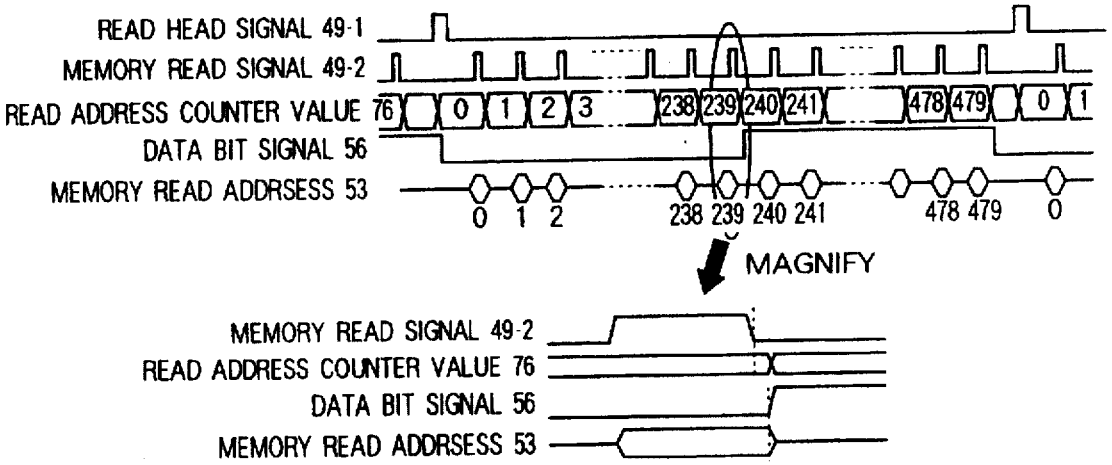
FIG. 18 is a timing view showing a concrete operation of the circuit shown in FIG. 17.

FIG. 17 is a block diagram showing a concrete arrangement of the read control circuit 42 shown in FIG. 5, in which a numeral 74 denotes a read address counter and a numeral 75 denotes an address buffer. FIG. 18 is a timing view showing the concrete operation of the read control circuit 42, in which the same signals of FIG. 18 as those shown in FIG. 17 have the same reference numbers.

In FIG. 17, the read control circuit 42 is composed of a read address counter 74 and a read address buffer 75. The read address counter 74, as shown in FIG. 18, is initialized so that its count value is made zero each time the memory access control circuit 38 (see FIG. 5) feeds the read head signal 49-1. Then, the counter 74 operates to count the number of the memory readout signal 49-2 sent from the memory access control circuit 38 and output the read address count value 76 in such a manner as 0, 1, 2, . . . increased one by one.

The read address count value 76 is fed as the memory readout address 53 to the display memory 43 (see FIG. 5) through the read address buffer 75. The read address buffer 75 keeps its impedance high without having to output the memory readout address 53 when the memory readout signal 49-2 has a logic 0 (that is, during the interval when the memory readout signal 49-2 keeps its pulse at the logic 1). When the memory readout signal 49-2 has a logic 1, the read address buffer 75 operates to output the read address count value 76 as the memory readout address signal 53 to the display memory 43.

As described above, the read control circuit 42 operates to feed the memory readout address signal 53 to the display memory 43 in response to the memory readout signal 49-2 on the same timing as that where the memory readout data 54 is read out of the display memory 43.

Further, the read address counter 74 generates a data bit signal 56. The data bit signal 56 indicates which of the bit planes A and B (see FIG. 10) of the display memory 43, from which the display data is being read. As shown in FIG. 18, when the read address count value 76 ranges from 0 to 239, the data bit signal 56 has a logic 0, while when the read address count value 76 ranges from 240 to 479, the data bit signal 56 has a logic 1. That is, when the data bit signal 56 has a logic 0, the display data is read out of the bit plane A. When it has a logic 1, the display data is read out of the bit plane B. This data bit signal 56 is fed to the decoder 45 (see FIG. 5).

Based on the memory readout address signal 53 generated as described above, the display data is read out of the display memory 43. Next, the reading operation will be described with reference to FIG. 19.

Figure 19:
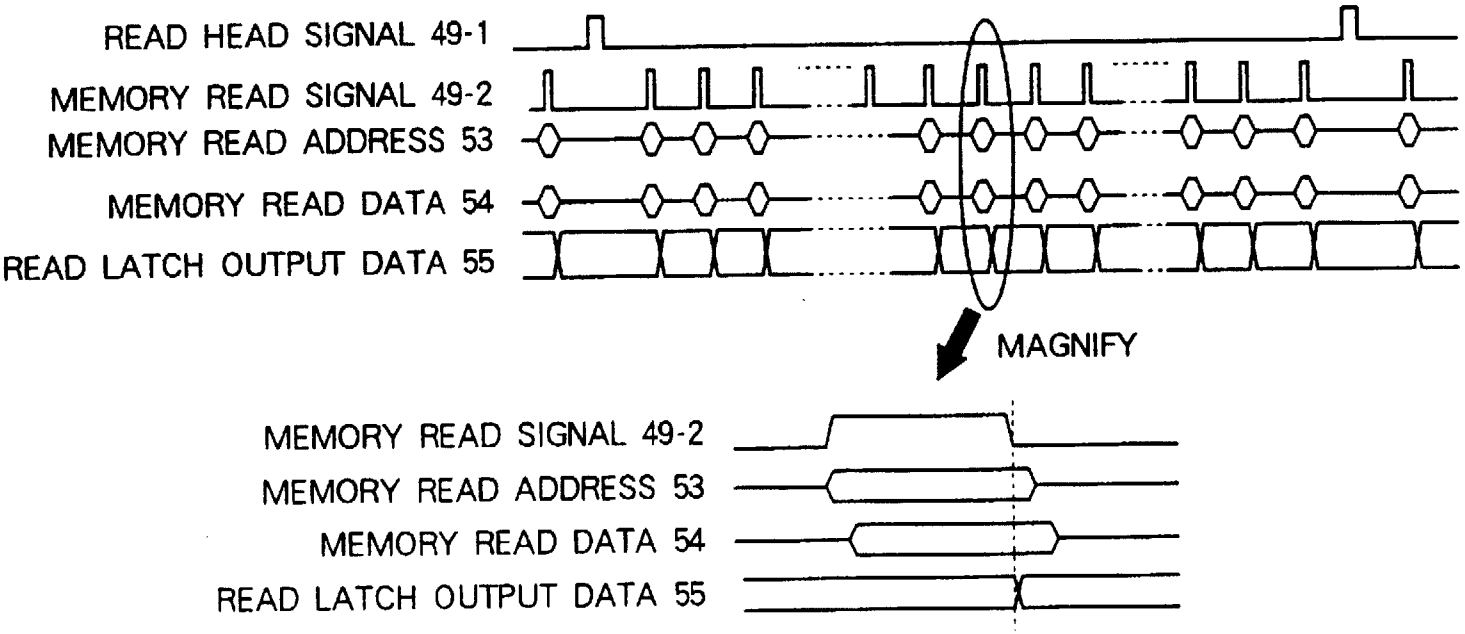
FIG. 19 is a timing view showing an operation of a read latch shown in FIG. 5.

With reference to FIGS. 15 and 19, the memory readout data 54 is read out of the display memory 43 in response to the memory readout signal 49-2 generated in the memory access control circuit 38 and the memory readout address signal 53 generated in the read control circuit 42. Then, the memory readout data 54 is fed to the read latch 44. When the memory readout signal 49-2 changes its logic from 1 to 0, the read latch 44 operates to latch the memory readout data 54 and feed it as the read latch output data 55 to the decoder 45.

Figure 20:
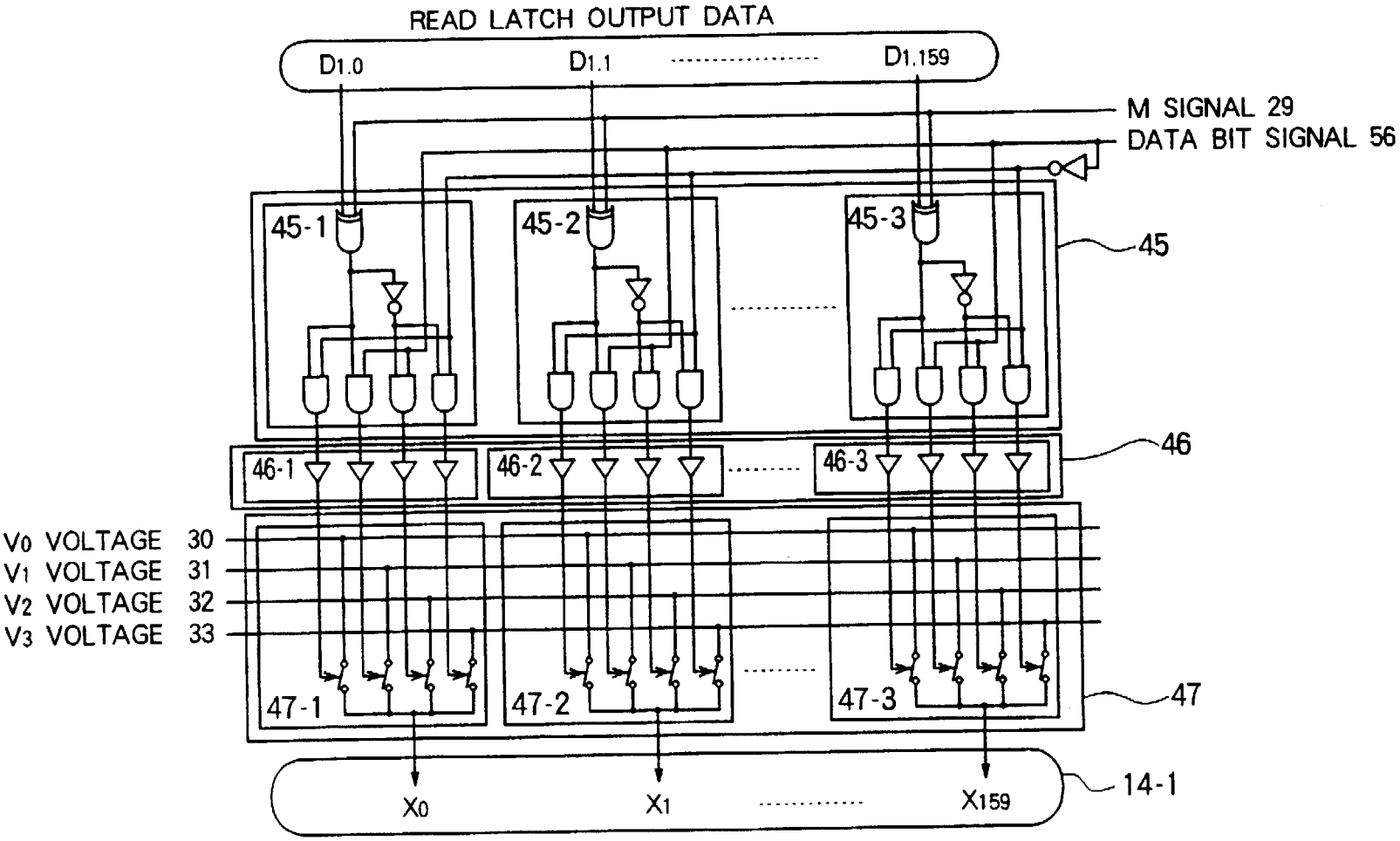
FIG. 20 is a circuit diagram showing a concrete arrangement of a decoder, a level shifter and an output circuit shown in FIG. 5.

FIG. 20 is a circuit diagram showing a concrete arrangement of the decoder 45, the level shifter 46 and the output circuit 47 shown in FIG. 5.

In FIG. 20, the read latch 44 feeds the read latch output data 55 to the decoder 45. The decoder 45 operates to generate the decode signal 57 from this read latch output data 55, the data bit signal 56 sent from the read control circuit 42 (see FIG. 5), and the M signal which is a reference signal for switching the polarity of the voltage applied to the liquid crystal. The decode signal 57 is fed to the level shifter 46.

The level shifter 46 is a circuit for converting this decode signal 57 into a signal for driving the output circuit 47 composed of a transistor, for example. In response to the converted signal, the output circuit 47 operates to select one of four-level voltages, that is, a V0 voltage 30, a V1 voltage 31, a V2 voltage 32 and a V3 voltage 33 and then apply the selected voltage as the data electrode driving signal 14-1 to the data electrodes X0 to X159 of the liquid crystal panel 1 (see FIG. 2).

The relation among the read latch output data 55, the data bit signal 56, the M signal 29 and the data electrode driving signal 14 will be shown in Table 1.

TABLE 1

| M Signal 29 | Data Bit Signal 56 | Read Latch Output Data 55 $D_{ij}$ | Output 14-1, 14-2 $X_j$ |
|---|---|---|---|
| 0 | 0 | 0 | $V_0$ |
| 0 | 0 | 1 | $V_3$ |
| 0 | 1 | 0 | $V_1$ |
| 0 | 1 | 1 | $V_2$ |
| 1 | 0 | 0 | $V_3$ |
| 1 | 0 | 1 | $V_0$ |
| 1 | 1 | 0 | $V_2$ |
| 1 | 1 | 1 | $V_1$ |

Table 1 is an output truth table of the data electrode driving signals 14 generated by the decoder 45, the level shifter 46 and the output circuit 47.

The above description holds true to the data driver 17-2 shown in FIG. 3. The similar operation provides a data driving signal 14-2 to be applied to the data electrodes X160 to X319 of the liquid crystal panel 1.

Figure 21:
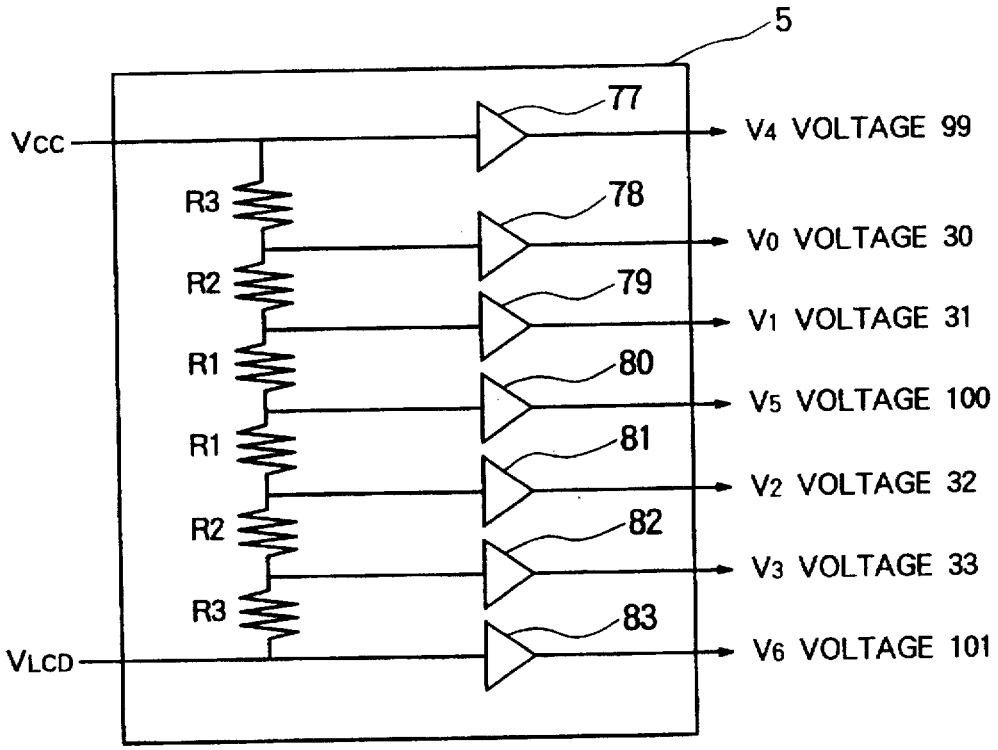
FIG. 21 is a circuit diagram showing a concrete arrangement of a power supply circuit 5 shown in FIG. 1.

FIG. 21 is a circuit diagram showing a concrete arrangement of the power supply circuit 5 shown in FIG. 1, in which numerals 77 to 83 denote buffer amplifiers and R1 to R3 denote resistors.

In FIG. 21, the power supply circuit 5 is composed of potential dividing resistors R3, R2, R1, R1, R2 and R3 connected in series and buffer amplifiers 77 to 83. A voltage $V_{cc}$ is applied to one terminal of the series-connected resistors and a voltage $V_{LCD}$ is applied to the other terminal thereof. As such, the power supply circuit 5 obtains seven kinds of voltages, that is, the voltage $V_{CC}$, five voltages between the voltages $V_{cc}$ and $V_{LCD}$, and the voltage $V_{LCD}$. These voltages are fed to the buffer amplifiers 77 to 83, respectively. Then, the power supply circuit 5 outputs a V4 voltage 39, a V0 voltage 30, a V1 voltage 31, a V5 voltage 100, a V2 voltage 32, a V3 voltage 33, and a V6 voltage 101, in which the relation of V4>V0>V1>V5>V2>V3>V6 is established. To give these output voltages the predetermined values, the voltage dividing ratio is set by the resistors R1 to R3.

Figure 22:
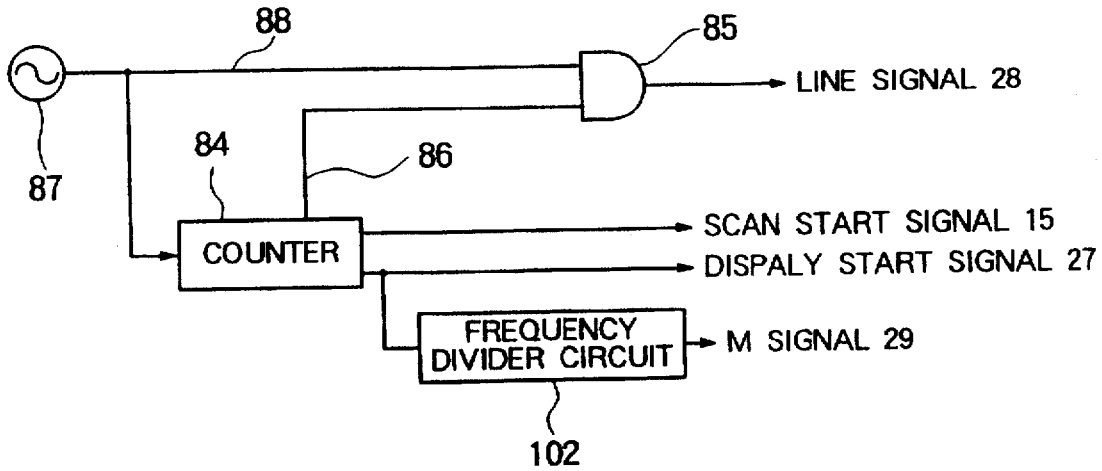
FIG. 22 is a block diagram showing a concrete arrangement of a display clock generator shown in FIG. 1.

FIG. 22 is a block diagram showing a concrete arrangement of the display clock generator 4 shown in FIG. 1, in which a numeral 84 denotes a counter, a numeral 85 denotes a logical AND circuit, a numeral 87 denotes a reference clock generator, and a numeral 102 denotes a frequency divider.

Figure 23:
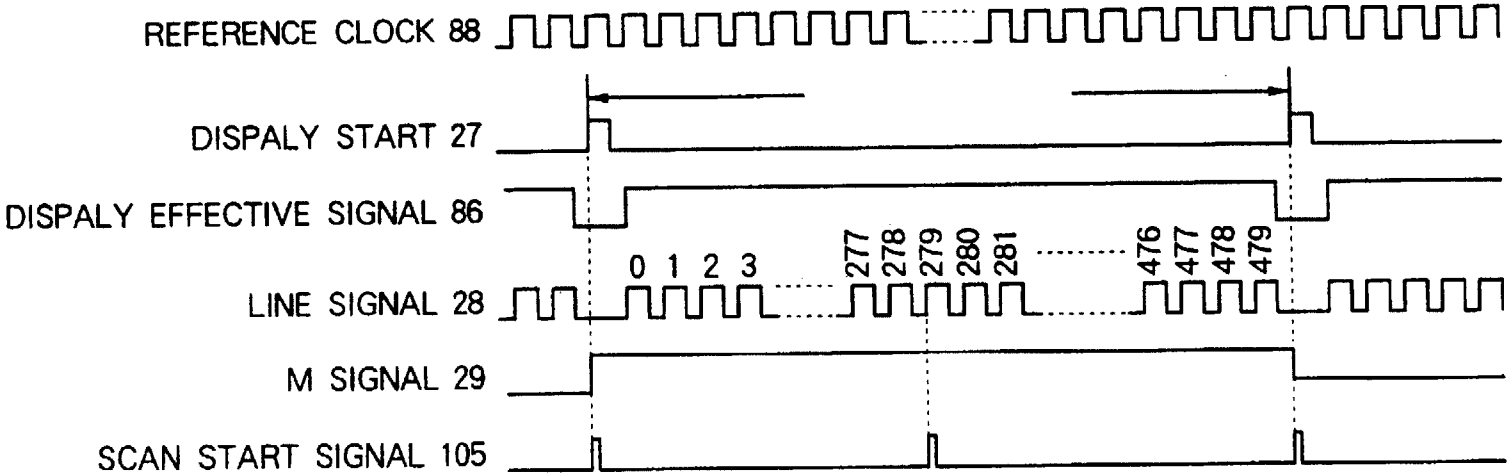
FIG. 23 is a timing view showing a concrete operation of the clock generator shown in FIG. 22.

FIG. 23 is a timing view showing the signals applied to the components shown in FIG. 22. The same signals of FIG. 23 as those of FIG. 22 have the same reference numbers.

In FIGS. 22 and 23, the reference clock generator 87 operates to generate a reference clock 88. The reference clock 88 has a period equal to one horizontal interval and is a clock on which the 8-bit display data 10 stored in the display memory 43 is read out for generating the data electrode driving signal 14.

This reference clock 88 is fed to the counter 84 in which the clock 88 is frequency-divided. As a result, the counter 84 operates to output the display start signal 27, the scan start signal 105 and a display effective signal 86. The display start signal 27 is a signal indicating the reading start of the display data stored in the display memory 43 (see FIG. 5). In one period of the signal 27, the overall display data for one frame is read out. The scan start signal 105 is a signal indicating the scan start of the scan electrodes Y0 to Y239 of the liquid crystal panel 1 (see FIG. 2). In this embodiment, in one period of the display start signal 27, the scan start signal 105 takes place twice.

Further, the display effective signal 86 is a signal indicating an effective period of the actual display after the display start signal 27 takes place. The logical AND of the display effective signal 86 and the reference clock 88 results in generating the reference clock, that is, the line signal 28 in the display effective period.

The frequency divider 102 operates to divide the display start signal 27 into two and generate an M signal 29 which changes its logic from 0 to 1 for each display start. The M signal 29 is a reference signal for switching the polarity of the voltage to be applied to the liquid crystal. The liquid crystal is mainly composed of high-molecular compound, whose characteristic is degraded if a dc voltage is applied thereto for a considerably long time. This requires the polarity of the voltage applied to the liquid crystal to be switched. In this embodiment, the switching of the polarity of the voltage applied to the liquid crystal for each of the display start signal 27 is performed for preventing the characteristics of the liquid crystal from being degraded.

Figure 24:
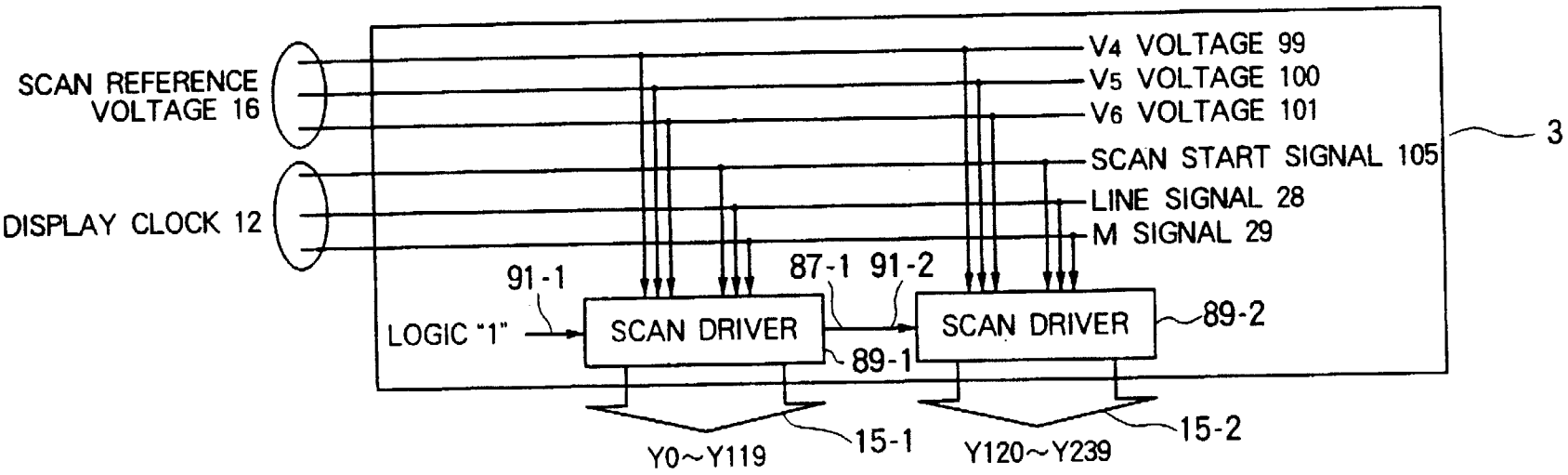
FIG. 24 is a block diagram showing a concrete arrangement of a scan electrode driving circuit shown in FIG. 1.

FIG. 24 is a block diagram showing a concrete arrangement of the scan electrode driving circuit 3 shown in FIG. 1, in which numerals 89-1 and 89-2 denote scan drivers.

In FIG. 24, the scan electrode driving circuit 3 is composed of the scan drivers 89-1 and 89-2. These scan drivers 89-1 and 89-2 receive the display clock to be sent from the display clock generator 4 (see FIG. 22) and the scan reference voltage 16 to be sent from the power supply circuit 5 (see FIG. 21). Herein, the display clock 21 is composed of the scan start signal 105, the line signal 28 and the M signal 29, which are all described with reference to FIG. 23. The scan reference voltage 16 is composed of a V4 voltage 99, a V5 voltage 100 and a V6 voltage 101 as shown in FIG. 21.

Figure 25:
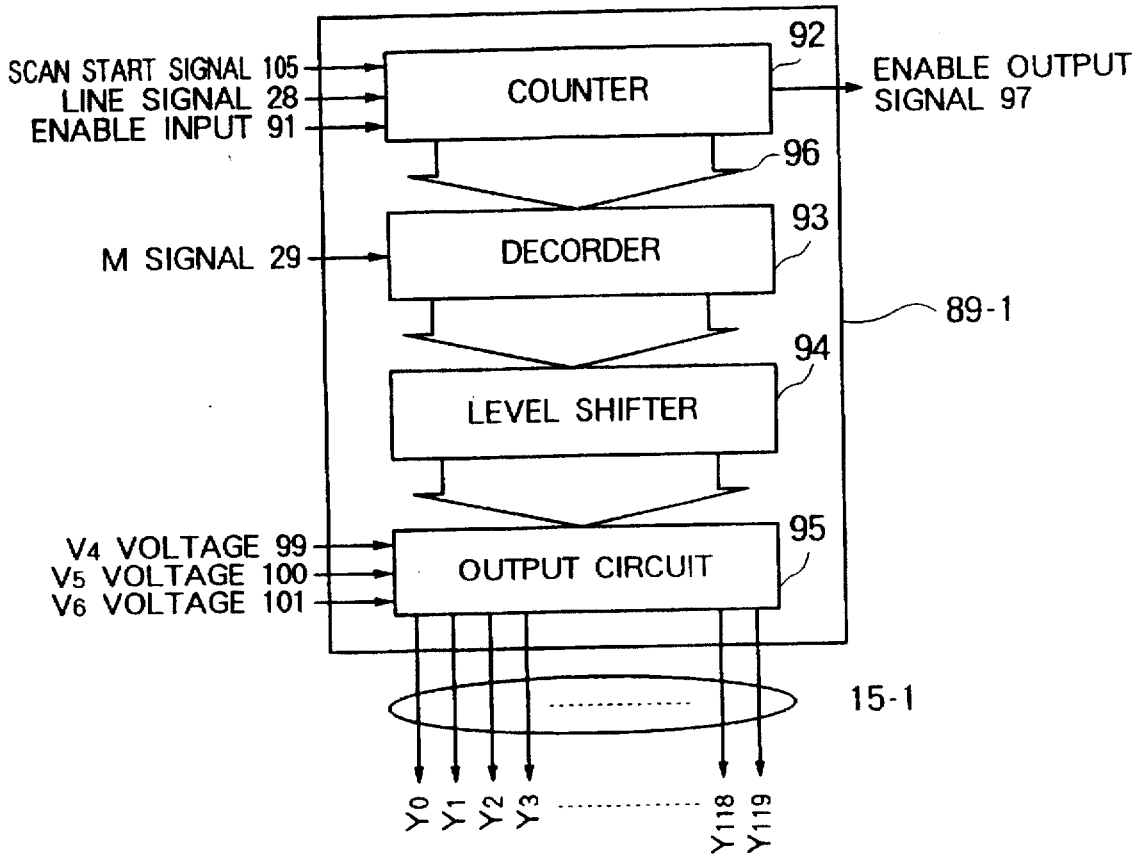
FIG. 25 is a block diagram showing a concrete arrangement of a scan driver shown in FIG. 24.

FIG. 25 is a block diagram showing a concrete arrangement of the scan driver 89-1 shown in FIG. 24, in which a numeral 92 denotes a counter, a numeral 93 denotes a decoder, a numeral 94 denotes a level shifter, and a numeral 95 denotes an output circuit.

Figure 26:
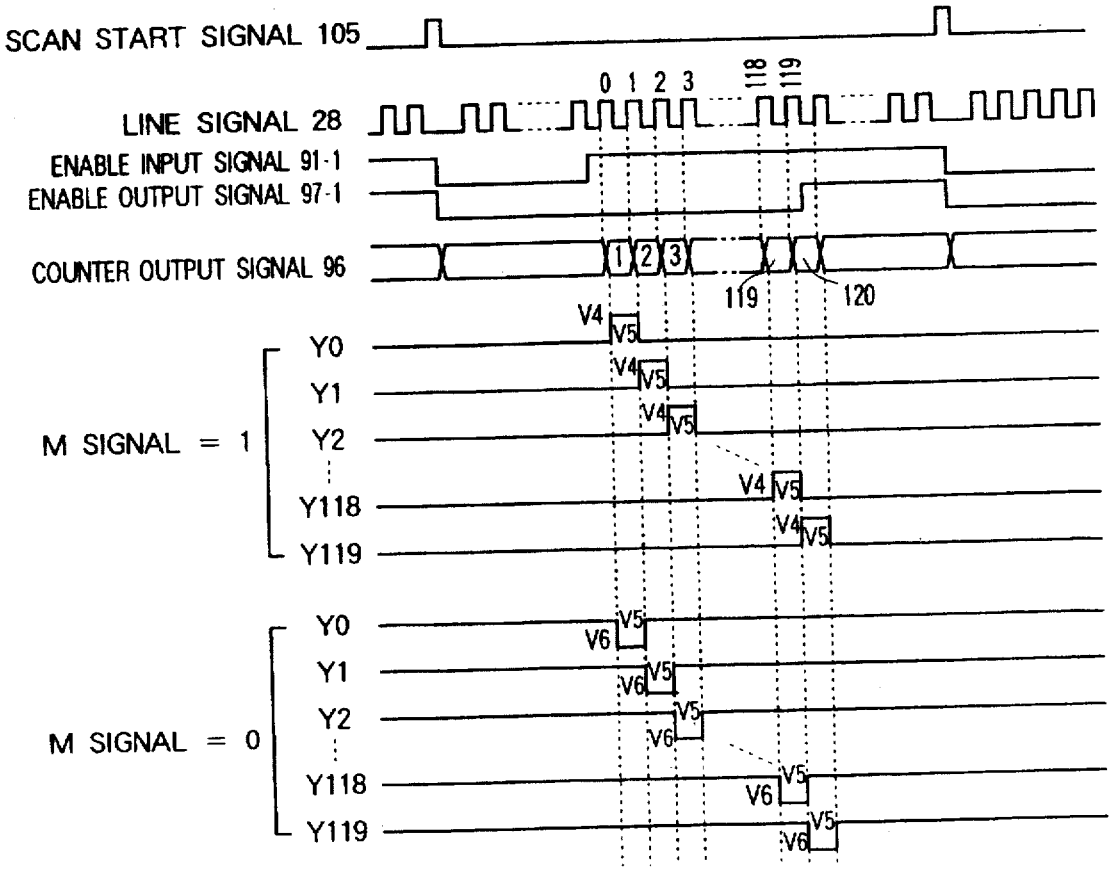
FIG. 26 is a timing view showing a concrete operation of the scan driver shown in FIG. 25.

FIG. 26 is a timing view showing the signals of some components shown in FIG. 25. The same signals of FIG. 26 as those shown in FIG. 25 have the same reference numbers.

In FIGS. 25 and 26, the counter 92 does not operate to count when the enable input signal 91 has a logic 0 but starts to count when the signal 91 changes the logic from 0 to 1. Hence, each time the counter 92 receives the scan start signal 105, the count value is initialized and then the counter starts to count the line signal 28 after the scan start signal 105 and generate the counter output signal 96 from the count value. Then, when the count value of the line signal 28 reaches 120, the counter 92 changes the logic of the enable output signal 97 from 0 to 1 and stops the counting operation until the next scan start signal 105 is fed thereto. This enable output signal 97 is fed as the enable input signal to the same counter included in the scan driver 89-2 having the same arrangement.

The counter output signal 96 from the counter 92 is converted into a scan electrode driving signal 15-1 through the effect of the decoder 93, the level shifter 94 and the output circuit 95. The scan electrode driving signal 15-1 is used for selecting one of the scan electrodes Y0 to Y119 of the liquid crystal panel 1 (see FIG. 2) according to the value of the counter output signal 96. The scan voltage is applied to the selected electrode. Further, the polarity of the scan voltage to be applied to the selected scan electrode may be changed according to the M signal 29 fed to the decoder 93.

The scan driver 89-1 shown in FIG. 24 is responsible for a half of the scan electrodes Y0 to Y239 and the scan driver 89-2 is responsible for the other half of the scan electrodes. Herein, the scan driver 89-1 feeds a scan voltage to the scan electrodes Y0 to Y119, while the scan driver 89-2 feeds a scan voltage to the scan electrodes Y120 to Y239.

Then, the scan driver 89-1 will be described. When the M signal 29 has a logic 1, the output circuit 95 selects the V4 applied by the power supply circuit 5 (see FIG. 21) and applies the V4 voltage 99 to the scan electrode according to the count output signal 96. That is, When the counter output signal 96 has a value of 1, the V4 voltage 99 is applied to the scan electrode Y0.

When the counter output signal 96 has a value of 2, the V4 voltage 99 is applied to the scan electrode Y1.

When the counter output signal 96 has a value of 3, the V4 voltage 99 is applied to the scan electrode Y2.

When the counter output signal 96 has a value of 4, the V4 voltage 99 is applied to the scan electrode Y3.

.
.
.
.
.

When the counter output signal 96 has a value of 120, the V4 voltage is applied to the scan electrode Y119 for scanning the electrode. Further, when the M signal 29 has a logic 0, the output circuit 95 selects the V6 voltage 101 sent from the power supply circuit 5 (see FIG. 21).

When the counter output signal 96 has a value of 1, the V6 voltage 101 is applied to the scan electrode Y0.

When the counter output signal 96 has a value of 2, the V6 voltage 101 is applied to the scan electrode Y1.

When the counter output signal 96 has a value of 3, the V6 voltage 101 is applied to the scan electrode Y2.

When the counter output signal 96 has a value of 4, the V6 voltage 101 is applied to the scan electrode Y3.

.
.
.
.
.

When the counter output signal 96 has a value of 120, the V6 voltage 101 is applied to the scan electrode Y119 for scanning the electrode.

Further, the V5 voltage 100 is applied to the scan electrodes to which the V4 voltage 99 and the V6 voltage 101 are not applied. As shown in FIG. 26, the V4 voltage 99 and the V6 voltage 101 have a different polarity from the V5 voltage 100.

The above operation holds true to the scan driver 89-2 shown in FIG. 24. When the enable output signal 97 sent from the counter 92 shown in FIG. 25 is made to have a logic 1, likewise, the scan driver 89-2 operates to apply a selected one of the V4 voltage 99 to the V6 voltage 101 to the corresponding one of the scan electrodes Y120 to Y239 for scanning.

The foregoing description will be oriented to the operation of the first embodiment with reference to FIGS. 1 to 26. Next, with reference to FIGS. 27 to 29, the concrete voltages to be applied to the liquid crystal panel 1 will be described on the assumption of the actual display pattern.

Figure 27:
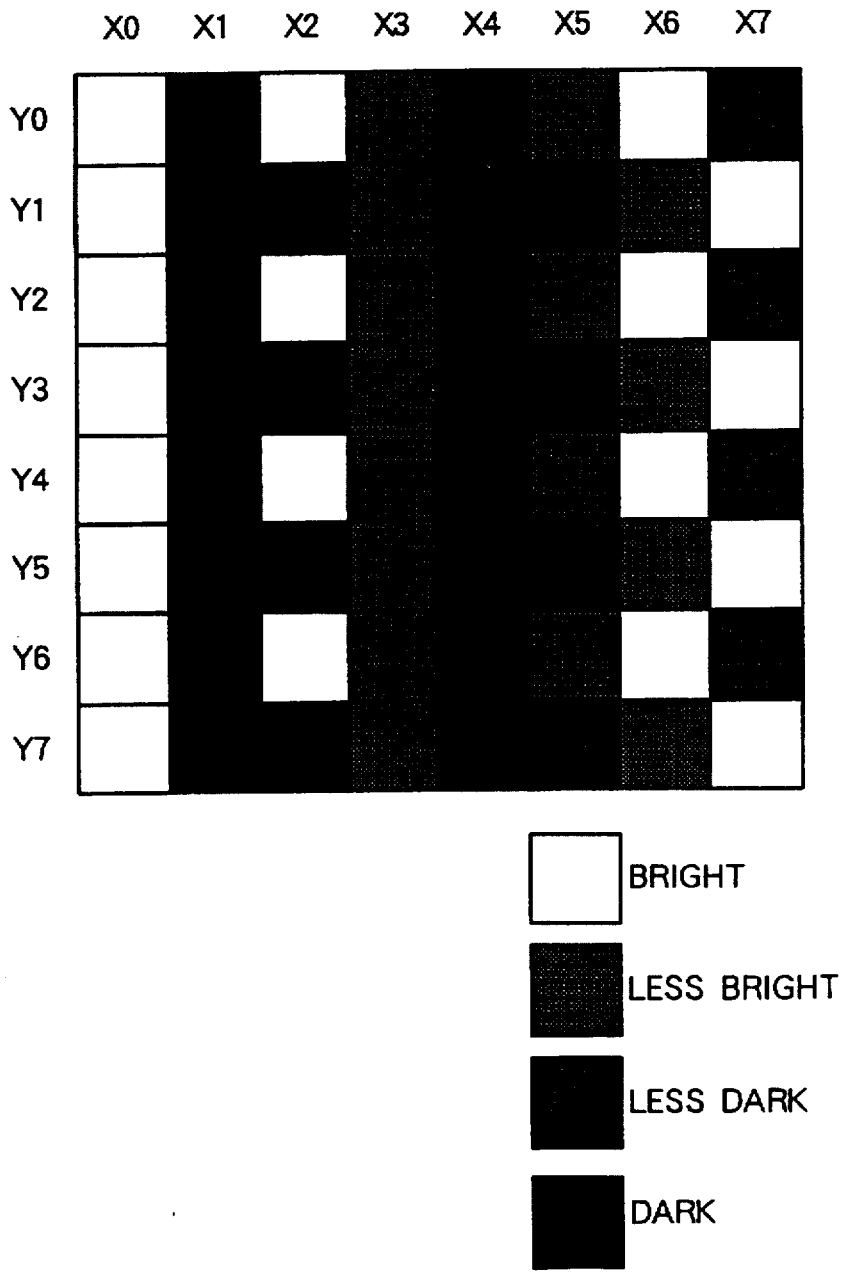
FIG. 27 is an illustration exemplarily showing one example of a display pattern on the liquid crystal panel shown in FIG. 1.

FIG. 27 shows an example of a display pattern formed on the assumption that the liquid crystal panel 1 (see FIG. 2) consists of 8×8 dots. Herein, the number of tones on the display is four like the above embodiment.

Figure 28A:
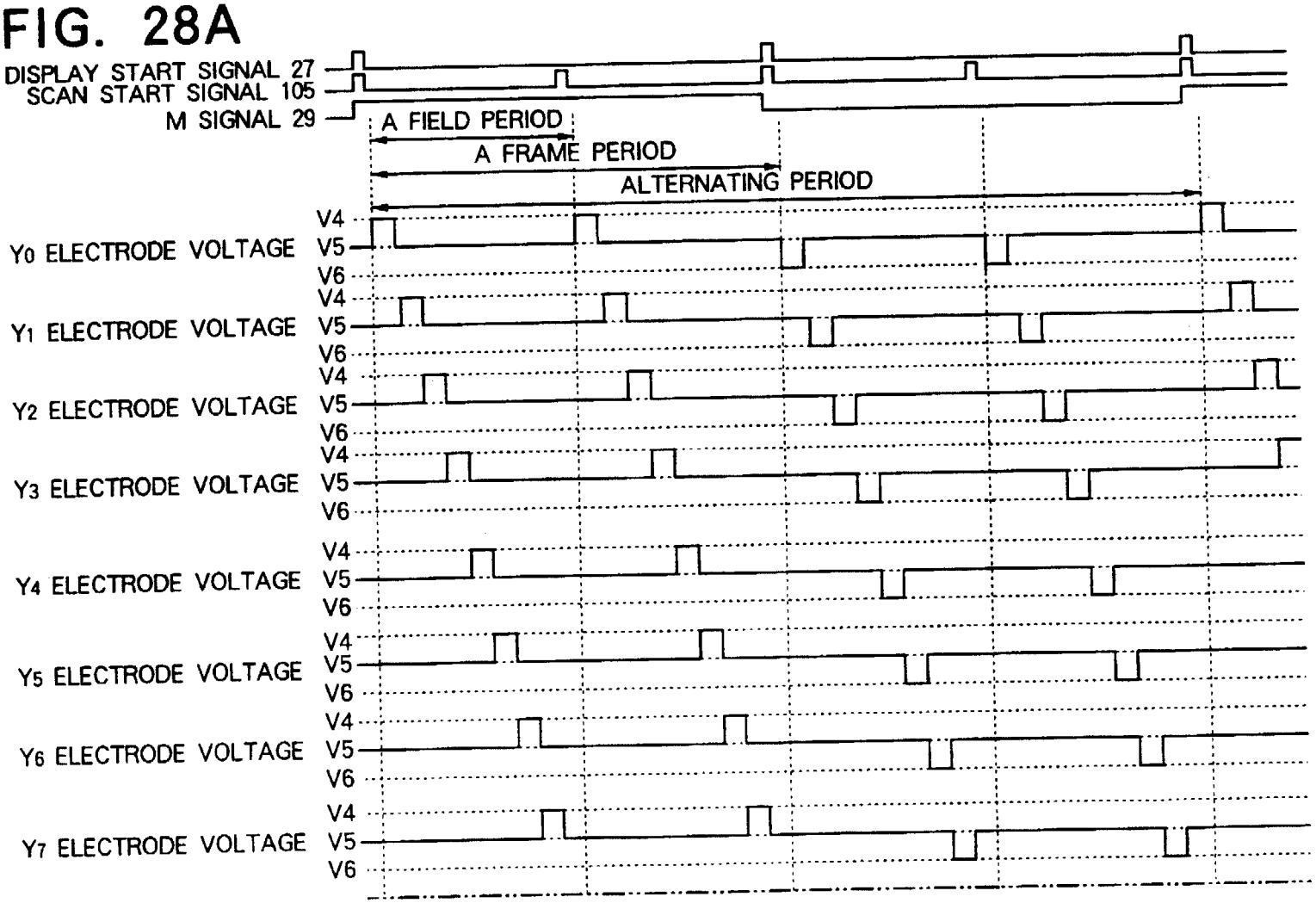
FIGS. 28A and 28B show an example of a liquid crystal driven voltage waveform for the display pattern shown in FIG. 27 at the data electrode and the scan electrode of the liquid crystal panel.
Figure 28B:
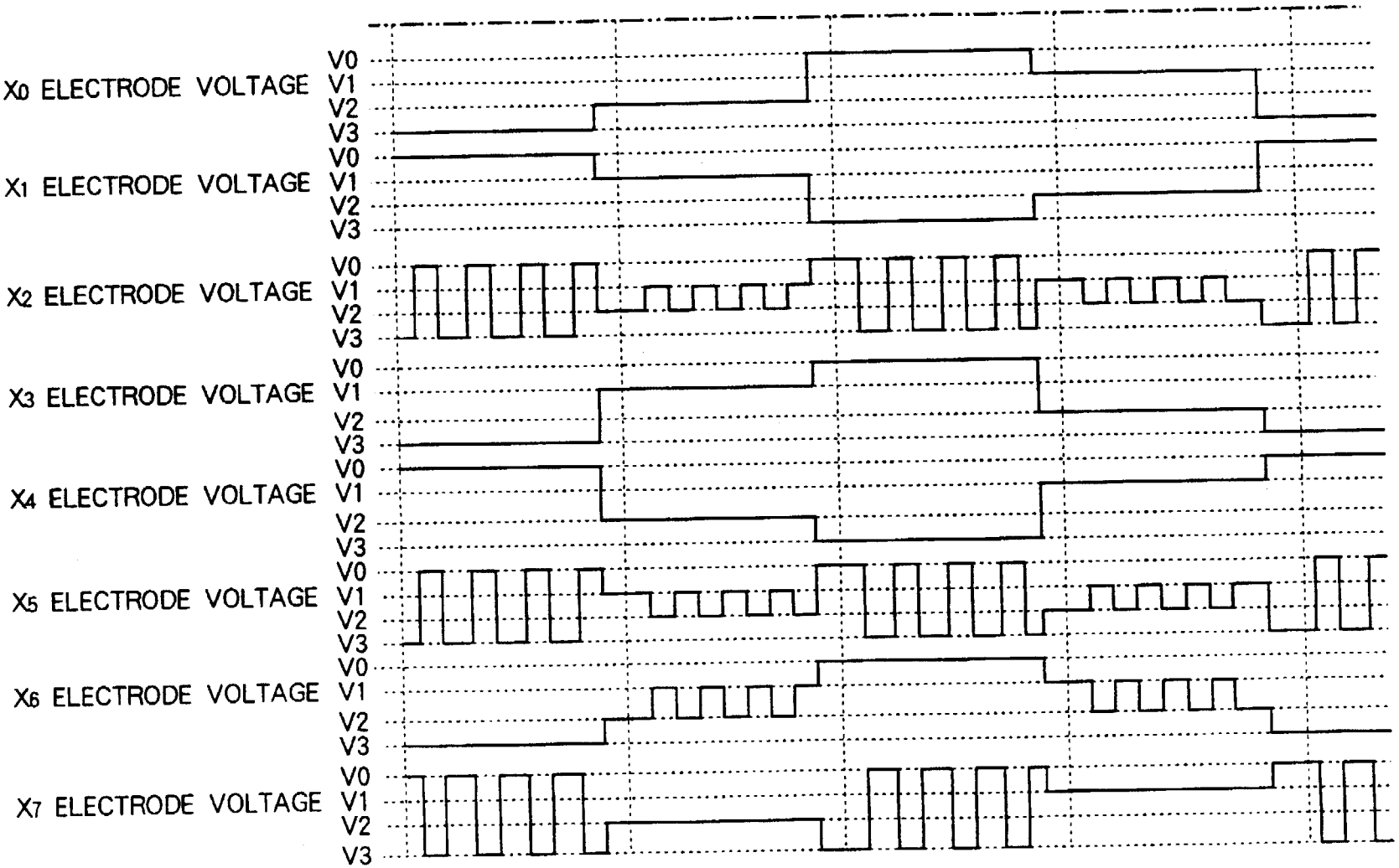

FIGS. 28A and 28B show the voltage waveforms of the data electrodes X0 to X7 and the scan electrodes Y0 to Y7 against the display pattern shown in FIG. 27. The voltage waveforms of the data electrodes X0 to Xy are listed in the above Table 1. The voltage waveforms of the scan electrodes Y0 to Y7 are listed as noted above.

Herein, the period of the display start signal 27 is called a frame period. The period of the scan start signal 105 is called a field period. The period of the M signal is called an ac period. The double one of the field period is equal to the frame period. This is because each field corresponds to each of the two bits composing the display data for displaying the display data composed of two bits on four tones. In the example shown in FIG. 28, the more weighted bit (upper bit) of the tone bit corresponds to the first half one (referred to as a field period F) of the two fields, while the less weighted bit (lower bit) of the tone bit corresponds to the second half one (referred to as a field period B). Those four bits contained in the two fields within one frame represent four tones.

By logically reversing the M signal 29 at each frame, the polarity of the voltage applied to the liquid crystal is reversed at each frame. This is referred to as frame alternation.

As such, as shown in FIGS. 28A and 28B, in the Table 1, if the M signal 29 has a logic 1, the data bit signal 56 keeps a logic 0 during the field period F when the upper bit $D_{ij}$ (0) is read from the bit plane A shown in FIG. 10A. Hence, the V0 voltage 30 or the V1 voltage 33 is applied to the data electrodes X0 to X7 according to the upper bit $D_{ij}$ (0). On the other hand, if the M signal 29 has a logic 1, the data bit signal 56 has a logic 1 during the field period R when the lower bit $D_{ij}$(1) is read from the bit plane A shown in FIG. 10A. Hence, the V2 voltage 32 or the V1 voltage 31 is applied to the data electrodes X0 to X7 according to the upper bit $D_{ij}$(1). This operation holds true to the case that the M signal 29 has a logic 0, except that the relation of the V0 voltage 30 and the V3 voltage 33 with the read bit or the relation of the V2 voltage 32 and the V1 voltage 31 with the read bit is reversed.

Figure 29A:
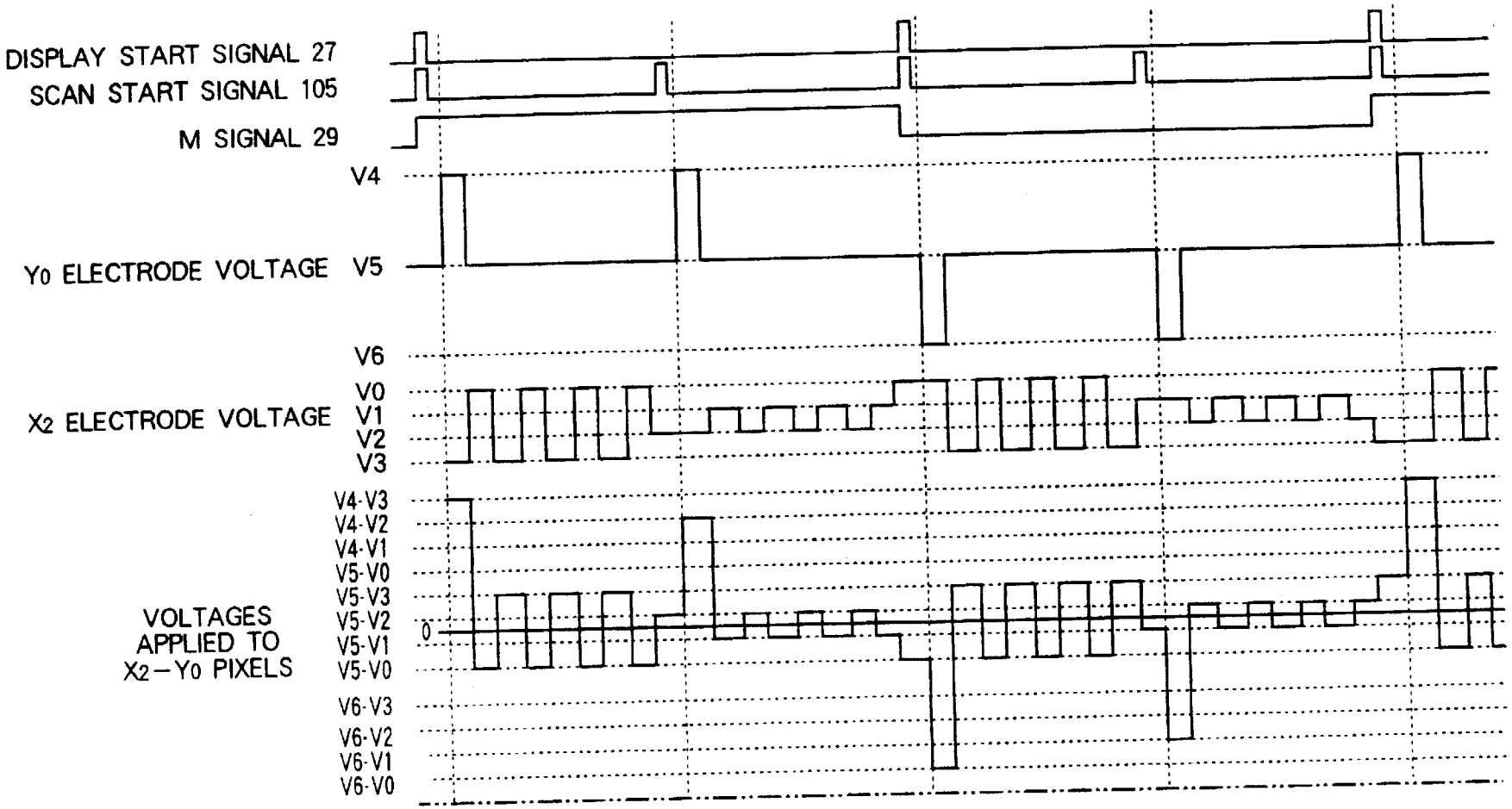
FIGS. 29A, 29B and 29C show an example of a voltage applied to a display pixel of the liquid crystal, against the voltage waveform shown in FIG. 28.
Figure 29B:
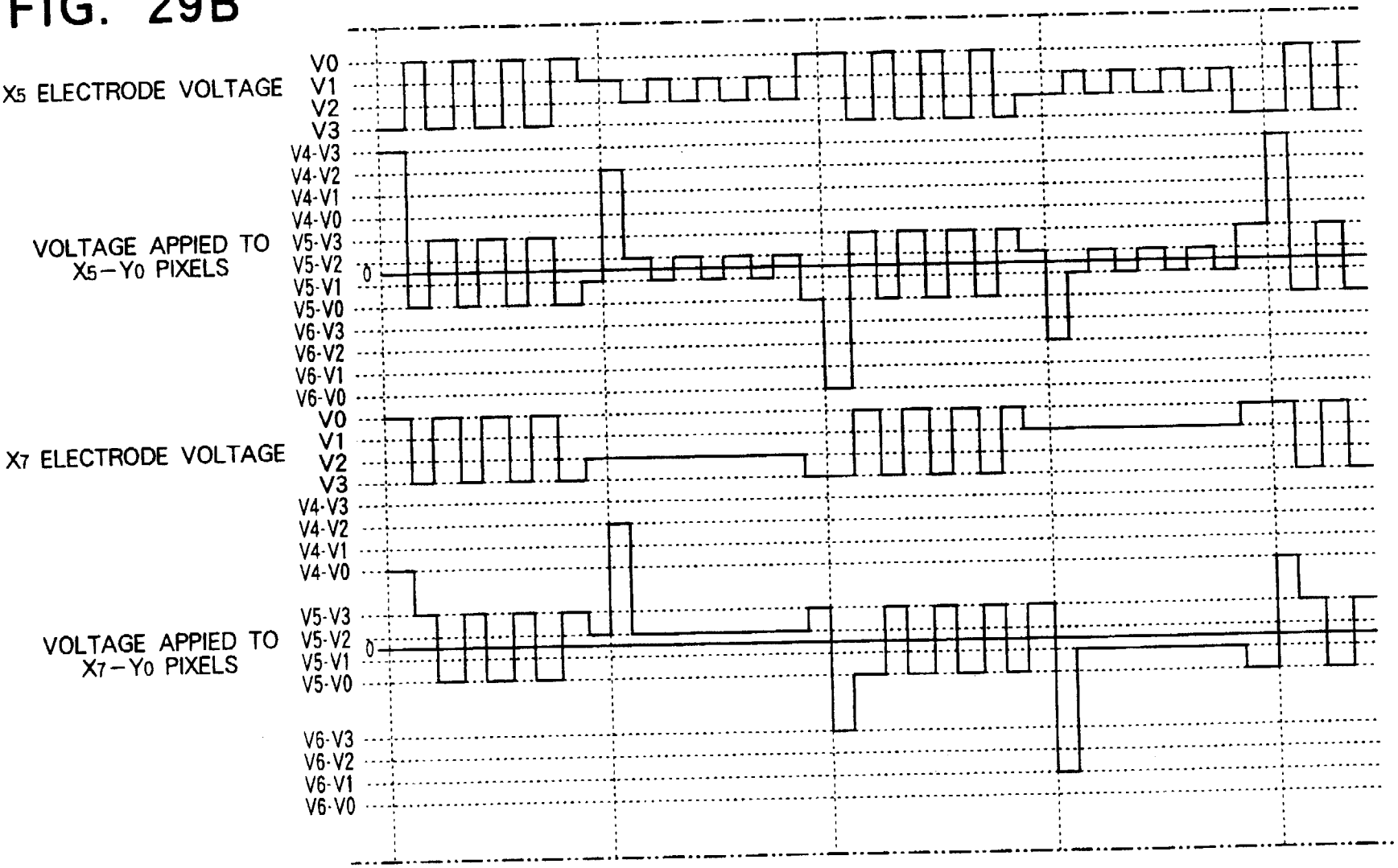
Figure 29C:
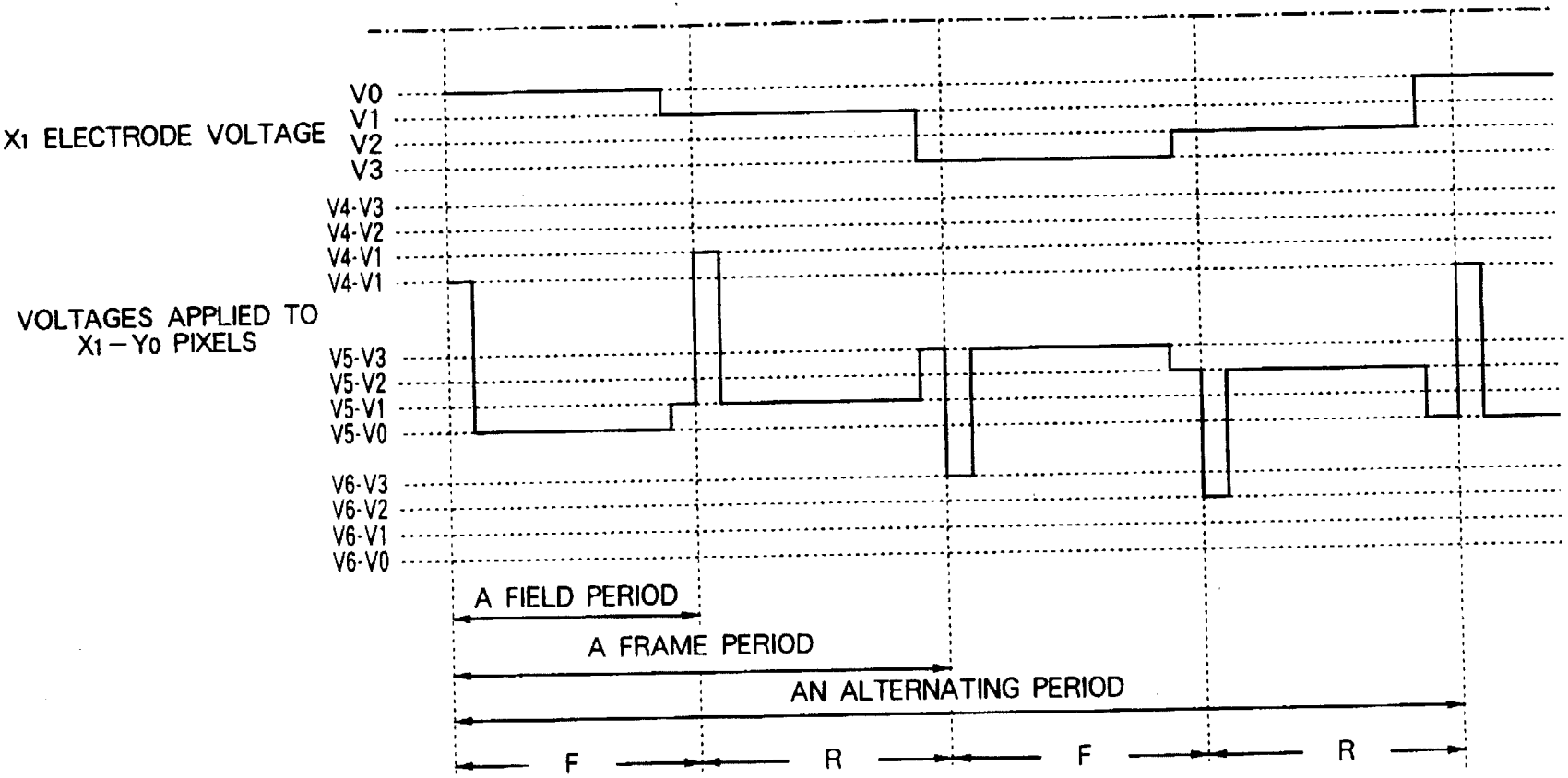

FIGS. 29A, 29B and 29C show the voltages actually applied to the display pixels by the data electrodes and the scan electrodes in the above manner. The waveforms of the voltages are illustrated which are applied to a crosspoint of the scan electrode Y0 (called Y0 electrode, the other electrodes are similarly called later) and the X 2 electrode, a crosspoint of the Y0 electrode and the X5 electrode, a crosspoint of the Y0 electrode and the X7 electrode, and a crosspoint of the Y0 electrode and the X1 electrode.

Now, consider the Y0 electrode shown in FIG. 27. The display pixel at the crosspoint of the Y0 electrode and the X2 electrode (called X2-Y0 pixel, the other pixels are similarly called later) is bright. The X5-Y0 pixel is less bright. The X7-Y0 pixel is less dark. The X1-Y0 pixel is dark. In such tones, the display data at the X2-Y0 pixel has the upper bit of $D_{ij}$(0)=1 and the lower bit of $D_{ij}$(1)=1. The display data at the X5-Y0 pixel has the upper bit of $D_{ij}$(0)=1 and the lower bit of $D_{ij}$(1)=0. The display data at the X7-Y0 pixel has the upper bit of $D_{ij}$(0)=0 and the lower bit of $D_{ij}$(1)=1. The display data at the X1-Y0 pixel has the upper bit of $D_{ij}$(0)=0 and the lower bit of $D_{ij}$(1)=1.

In FIGS. 29A, 29B and 29C, as described above with reference to FIGS. 25 and 26, the time of interval when the V4 voltage 99 or the V6 voltage 101 is applied to the scan electrode is called a selecting interval. The time of interval when the other V5 voltage 100 is applied thereto is called a non-selecting interval. The tone display is determined by the voltage applied to the display pixels during two selecting intervals within the frame period. As is obvious from FIGS. 28A and 28B, if the M signal 29 has a logic 1, in the selecting interval of the first field period F within the frame period, a difference voltage between the V4 voltage 99 and the V3 voltage 33 (called a V4-V3 voltage, the other difference voltages are similarly called later) is applied to the pixels when the tone bit with a large display data weight (upper bit) is on (that is, has a logic 1). The V4-V0 voltage is applied to the pixels when the tone bit is off (that is, has a logic 0). Further, in the selecting interval of the next field period R, the V4-V2 voltage is applied to the pixels when the tone bit with a small display data weight (lower bit) is on. The V4-V1 voltage is applied to the pixels when the tone bit is off.

Then, the X2-Y0 pixel is on in the field periods F and R. During the selecting interval of the field period F, the V4-V3 voltage is applied and during the selecting interval of the field period F, the V4-V2 voltage is applied, for achieving the bright display. The X5-Y0 pixel is on during the field period F or off during the field period R. During the selecting interval of the field period F the V4-V3 voltage is applied and during the selecting interval of the field period R the V4-V1 voltage is applied, for achieving the less bright display. The X7-Y0 pixel is off during the field period F or on during the field period R. During the selecting interval of the field period F, the V4-V0 voltage is applied and during the selecting interval of the field period R the V4-V2 voltage is applied, for achieving the less dark display. The X1-Y0 pixel is on during the field periods F and R. During the selecting interval of the field period F the V4-V0 voltage is applied and during the selecting interval of the field period R the V4-V1 voltage is applied, for achieving the dark display.

As described above, the tones are represented by combining large and small selected voltages applied to the pixels during each field period F or R.

At the next frame where the M signal 29 has a logic 0, as shown in FIG. 29A, during the field period F, the V6-V0 voltage is applied to the X2-Y0 pixel. The V6-V0 voltage is applied to the X5-Y0 pixel. The V6-V3 voltage is applied to the X7-Y0 pixel. The V6-V3 voltage is applied to the X1-Y0 pixel. Further, during the field F, the V6-V1 voltage is applied to the X2-Y0 pixel. The V6-V2 voltage is applied to the X5-Y0 pixel. The V6-V1 voltage is applied to the X7-Y0 pixel. The V6-V2 voltage is applied to the X1-Y0 pixel. In this case, the polarity of the voltage at this frame is reverse to that at the previous frame where the M signal 29 has a logic 1.

As set forth above, if the horizontal frequency for driving the liquid crystal in the mean pulse width modulation system is made n times as great as the horizontal frequency of the write display data, the liquid crystal display device according to this embodiment makes it possible to achieve a $2^n$-tone display by weighting the driving signal of the liquid crystal according to the pulse level without having to greatly enhance the data shift clock. Further, this embodiment may achieve the liquid crystal display device which operates to drive a fast responsive liquid crystal material at high contrast by raising the scan frequency of the display. For example, by doubling the scan frequency on which the liquid crystal is driven (about 60 Hz to 120 Hz), the four tone can be realized. Further, by doubling the frame frequency, the liquid crystal is allowed to be driven on the totally four times the scan frequency (concretely, at about 120 Hz to 240 Hz). It means that the fast responsive liquid crystal is driven at high contrast.

Further, since the display memory is built in the data driver, it is not necessary to match the frequency of the display data to be transferred from the display controller to the frequency of the data voltage outputted to the liquid crystal panel. The display controller may be operated independently of the display. Hence, if the displayed content is not changed, the display controller may lower its operating frequency or be stopped in order to reduce a power consumed in a small information instrument, a personal computer, a wordprocessor apparatus, an electronic note, and the other electronic instruments provided with the liquid crystal display device according to this embodiment.

The liquid crystal display device according to the present invention may use another type of display unit like a CRT or a plasma display rather than the liquid crystal display. The CRT or the plasma display may provide a different operating frequency from the liquid crystal display device. In this case, the operating frequency of the display controller is matched to the frequency of the desired display unit. With this matching, an image may appear in the liquid crystal display device and another display unit at a time.

At each frame, the polarity of the voltage applied to the display pixel is reversed. This makes contribution to preventing the characteristics of the liquid crystal from being degraded.

In addition, the liquid crystal display device according to this embodiment has been described in the case that the display data is composed of two bits and a four-tone display is achieved. The present invention is not limited to this embodiment. The capacity of the display memory, the level number of the data voltage, and the arrangement of the decoder are easily changed according to the bit number of the tones.

In turn, the description will be oriented to the liquid crystal display device and method according to the second embodiment of the invention with reference to FIGS. 30A, 30B, 32, 32A, 32B, 33A, 33B and 33C.

The liquid crystal display device according to the second embodiment of the invention basically has the same arrangement as the device according to the above first embodiment, except a way of storing the display data in the display memory 43.

FIGS. 30A and 30B show a concrete arrangement of a memory map indicating a relation between each address of the display memory 43 and the display data stored at the address in the second embodiment.

The different respect of this memory map from that shown in FIGS. 10A and 10B is that the memory map shown in FIGS. 10A and 10B is arranged so that only a bit 0 (upper bit) of the display data is stored in the bit plane A and only a bit 1 (lower bit) of the display data is stored in the bit plane B, while the memory map shown in FIGS. 30A and 30B is arranged so that the bits 0 and 1 of the display data are stored alternately in the bit planes A and B.

That is, like the description shown in FIG. 5, in writing data, under the control of the memory access control circuit 38 and the write control circuit 41, the display data 51 for one line is fed to and stored in the display memory 43. As shown in FIGS. 30A and 30B, the different tone bits (that is, upper and lower bits) are alternately ranged in the bit plane A or B of the display memory 43 when these bits are stored in the memory 43.

For example, at 0-th row (write address 0) of the bit plane A, assuming that the upper bit is a tone bit 0 and the lower bit is a tone bit 1, the tone bits 0 and 1 are alternately stored in such a manner as 0, 1, 0, 1, 0, 1 . . . , concretely, the tone bit 0 of the display data $D_{0,0}$, the tone bit 1 of the display data $D_{0,1}$, the tone bit 0 of the display data $D_{0,2}$, the tone bit 1 of the display data $D_{0,3}$, . . . . In the first row (write address 1) of the bit plane 1, conversely, the tone bits 0 and 1 are alternately stored in such a manner as the tone bits 1, 0, 1, 0, 1, 0, . . . , concretely, the tone bit 1 of the display data $D_{0,0}$, the tone bit 0 of the display data D0.1, the tone bit 1 of the display data $D_{0,2}$, the tone bit 0 of the display data $D_{0,3}$, . . . . Then, in the next row (second row), the tone bits are stored in each of the bit planes A and B in the reverse sequence to that of the first row.

As set forth above, the tone bits 0 and 1 are alternately ranged in the bit plane A or B when they are stored therein. On the other hand, under the control of the memory access control circuit 38 and the read control circuit 42, the display data stored in the display memory 43 is read from the memory 43 in the same manner as the reading of the map shown in FIG. 10 from the display memory 43.

Figure 31:
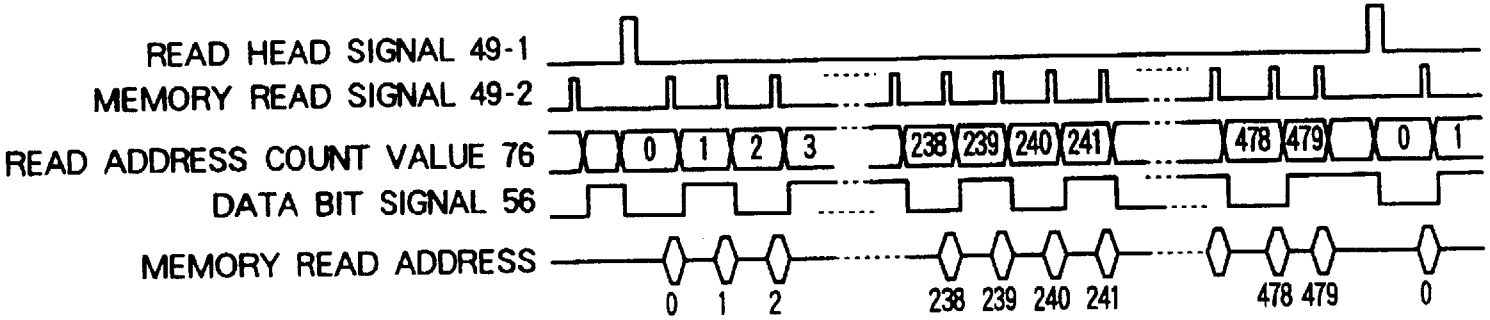
FIG. 31 is a timing view showing how a read control circuit of the second embodiment is operated with respect to the memory map shown in FIG. 30.
Figure 42:
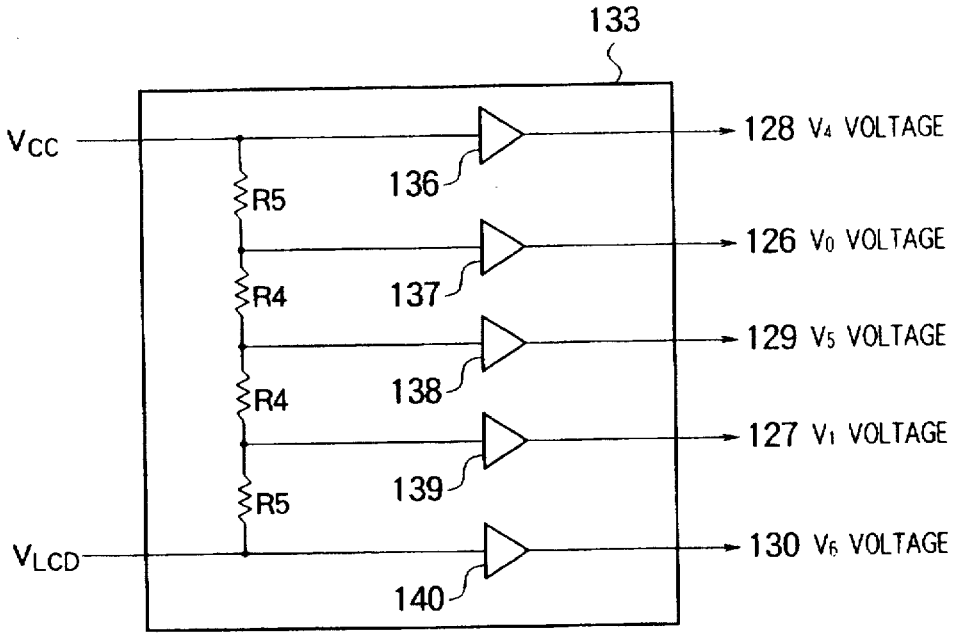
FIG. 42 is a circuit diagram showing a concrete arrangement of a power supply circuit shown in FIG. 34.

FIG. 31 is a timing view showing how the read control circuit shown in FIG. 17 42 operates in the memory map shown in FIGS. 30A and 30B.

The read control circuit 42, as described with reference to FIG. 17, is composed of the read address counter 74 and the read address buffer 75. The counter 74 and the buffer 75 operates to generate the read address count value 76 and the memory readout address 53 on the timing as shown in FIG. 18. Hence, the method for reading the display memory 43 is the same as that included in the first embodiment, except the data bit signal 56 generated from the read address counter 74.

In this embodiment, as shown in FIG. 31, the data bit signal 56 is generated so that it has a logic 0 when the address count value 76 is an even or a logic 1 when it is an odd. The data bit signal 56 is fed to the decoder 45 (see FIG. 5). The decoder 45 operates to decode the read latch output data 55 based on the data bit signal 56 and the M signal 29 and generate the decode signal 57. The decode signal 57 is sent to the level shifter (see FIG. 5) in which it is converted into a signal for driving the output circuit 47. In response to the converted signal, the output circuit 47 operates to select one of the V0 voltage 30, the V1 voltage 31, the V2 voltage 32 and the V3 voltage 33 and output it as the data electrode driving signal 14.

The decoder 45 of the second embodiment has a different arrangement from the decoder 45 shown in FIG. 20. The table 2 indicates how the data electrode driving signal 14 is generated from the read latch output data 55, the data bit signal 56 and the M signal 29 through the effect of the decoder 45, the level shifter 46 and the output circuit 47 shown in FIG. 5.

TABLE 2

| | | Read Latch Output | Output 14-1, 14-2 | |
|---|---|---|---|---|
| M Signal 29 | Data Bit Signal 56 | Data 55 $D_{ij}$ | Xl (Even Column) | Xi (Odd Column) |
| 0 | 0 | 0 | $V_0$ | $V_1$ |
| 0 | 0 | 1 | $V_3$ | $V_2$ |
| 0 | 1 | 0 | $V_1$ | $V_0$ |
| 0 | 1 | 1 | $V_2$ | $V_3$ |
| 1 | 0 | 0 | $V_3$ | $V_2$ |
| 1 | 0 | 1 | $V_0$ | $V_1$ |
| 1 | 1 | 0 | $V_2$ | $V_3$ |
| 1 | 1 | 1 | $V_1$ | $V_0$ |

Table 2 is an output truth table of the data electrode driving signals 14 generated by the decoder 45, the level shifter 46 and the output circuit 47 in the second embodiment.

In FIG. 5, the memory readout data 54 read from the display memory 43 to the read latch 44 is processed in the decoder 45, the level shifter 46 and the output circuit 47. That is, the data 54 is converted into the signals listed in Table 2. Then, the final converted signal is fed as the data electrode driving signal 14 to the liquid crystal panel 1 (see FIG. 2). The decoder 45 is arranged according to the output truth table listed in Table 2 so that the combination of the data electrode driving signals 14 may be variable according to the even or odd data electrode to which the data electrode driving signal 14 is applied, if the combination of the read latch output data 55, the data bit signal 56 and the M signal 29 is the same as that of the first embodiment.

Next, the voltage applied to the liquid crystal panel 1 will be described with reference to FIGS. 32 and 33 as taking an example of the display pattern shown in FIG. 27.

Figure 32A:
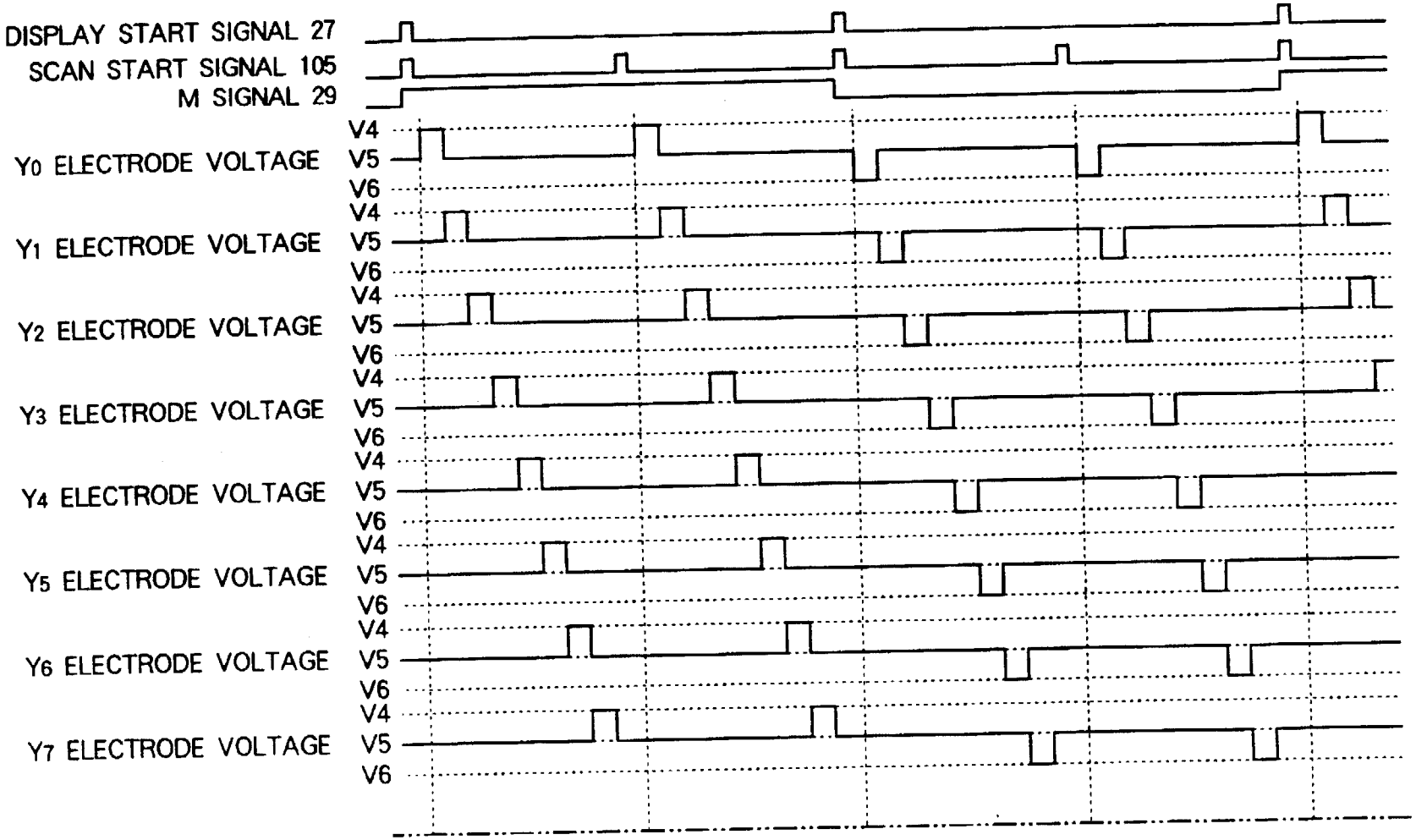
FIGS. 32A and 32B show an example of a liquid crystal driving waveform of the second embodiment against the memory map shown in FIG. 30.
Figure 32B:
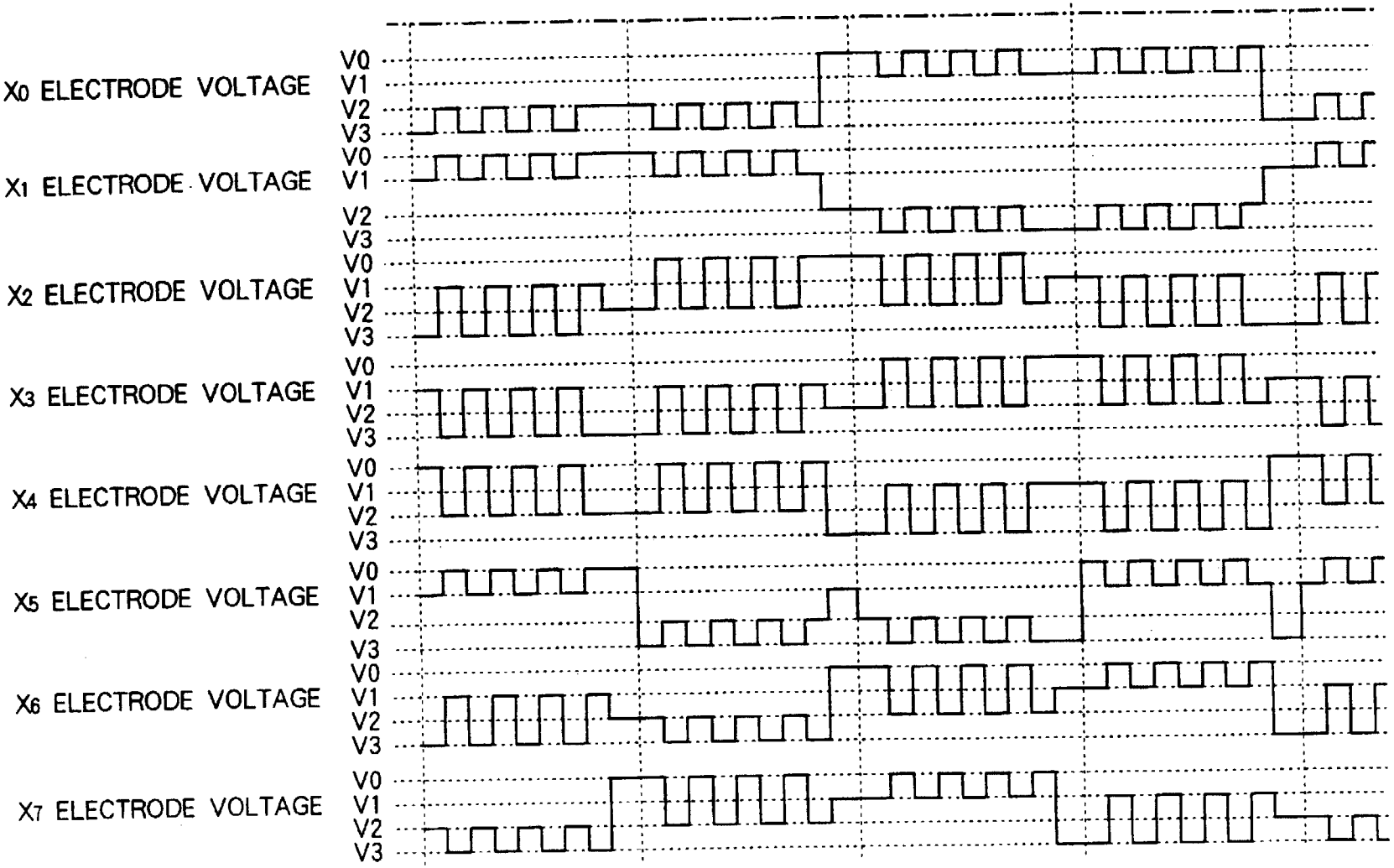

FIGS. 32A and 32B show concrete waveforms of the liquid crystal driving voltages.

In FIGS. 32A and 32B, like the above description, the period of the display start signal 27 is called a frame period. The period of the scan start signal 105 is called a field period. The period of the M signal 29 is called an ac period. The relation among those periods is just as shown in the timing view of FIGS. 28A and 28B.

The liquid crystal driving waveform shown in FIGS. 32A and 32B is arranged so that the weight of the tone bit (that is, the upper bit or the lower bit) is switched at each one horizontal interval of the first field (field period F). Further, the switching sequence is changed at each data electrode (at each electrode column) shown in FIG. 2. Then, at the next field (field period R), the switching sequence is reversed to that at the first field.

Figure 33A:
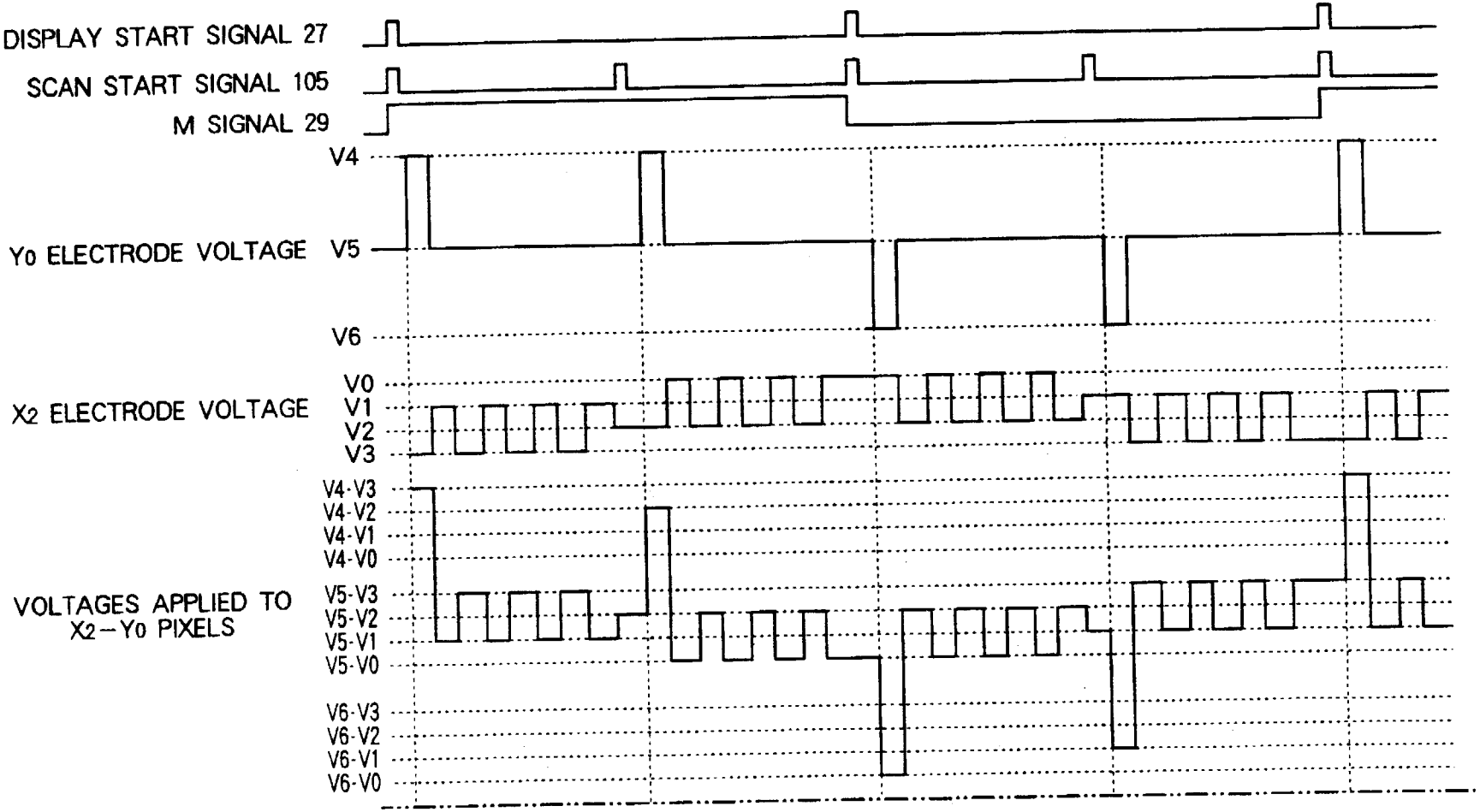
FIGS. 33A, 33B and 33C show is a view showing an example of a voltage applied to a display pixel of the liquid crystal of the second embodiment against the memory map shown in FIG. 30.
Figure 33B:
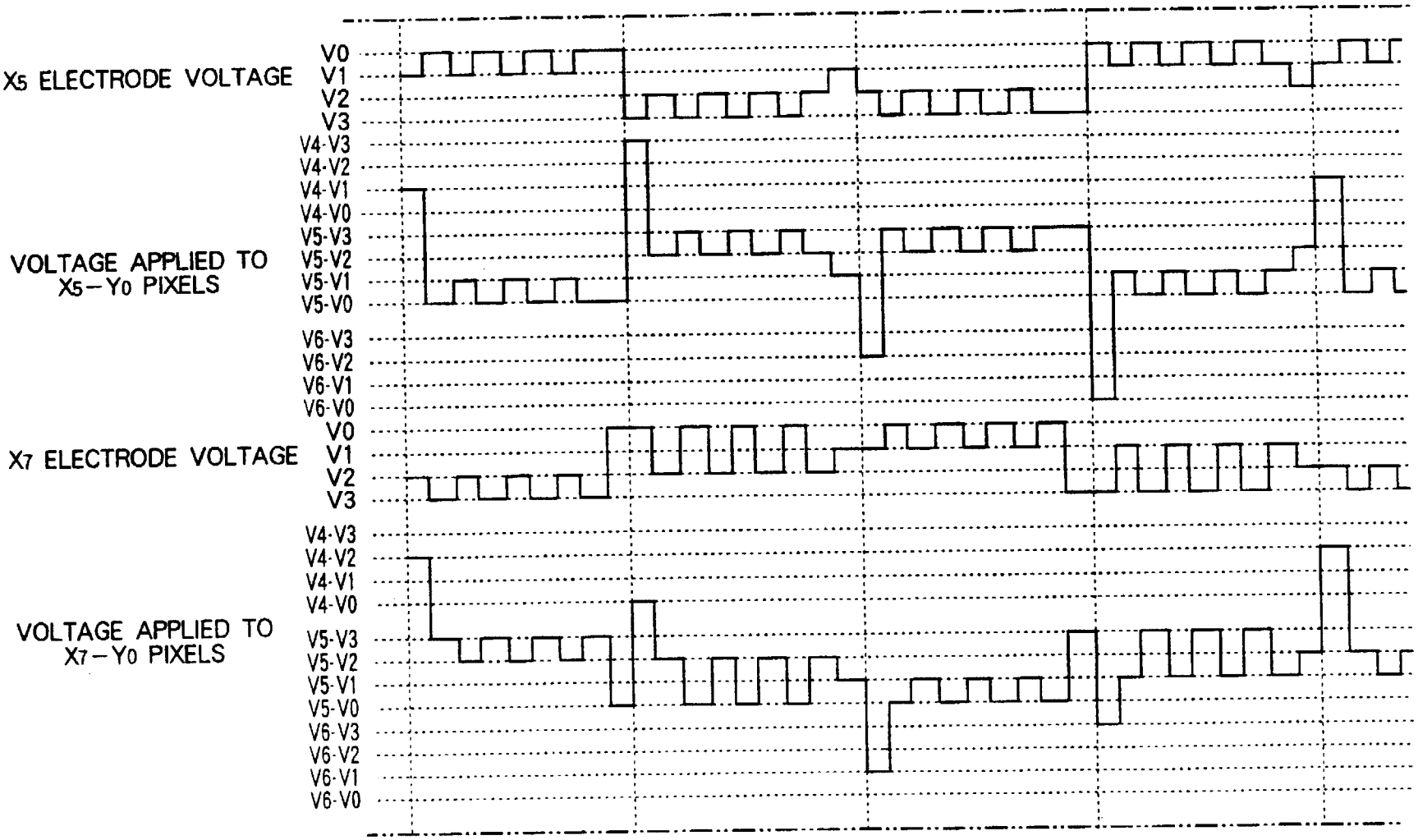
Figure 33C:
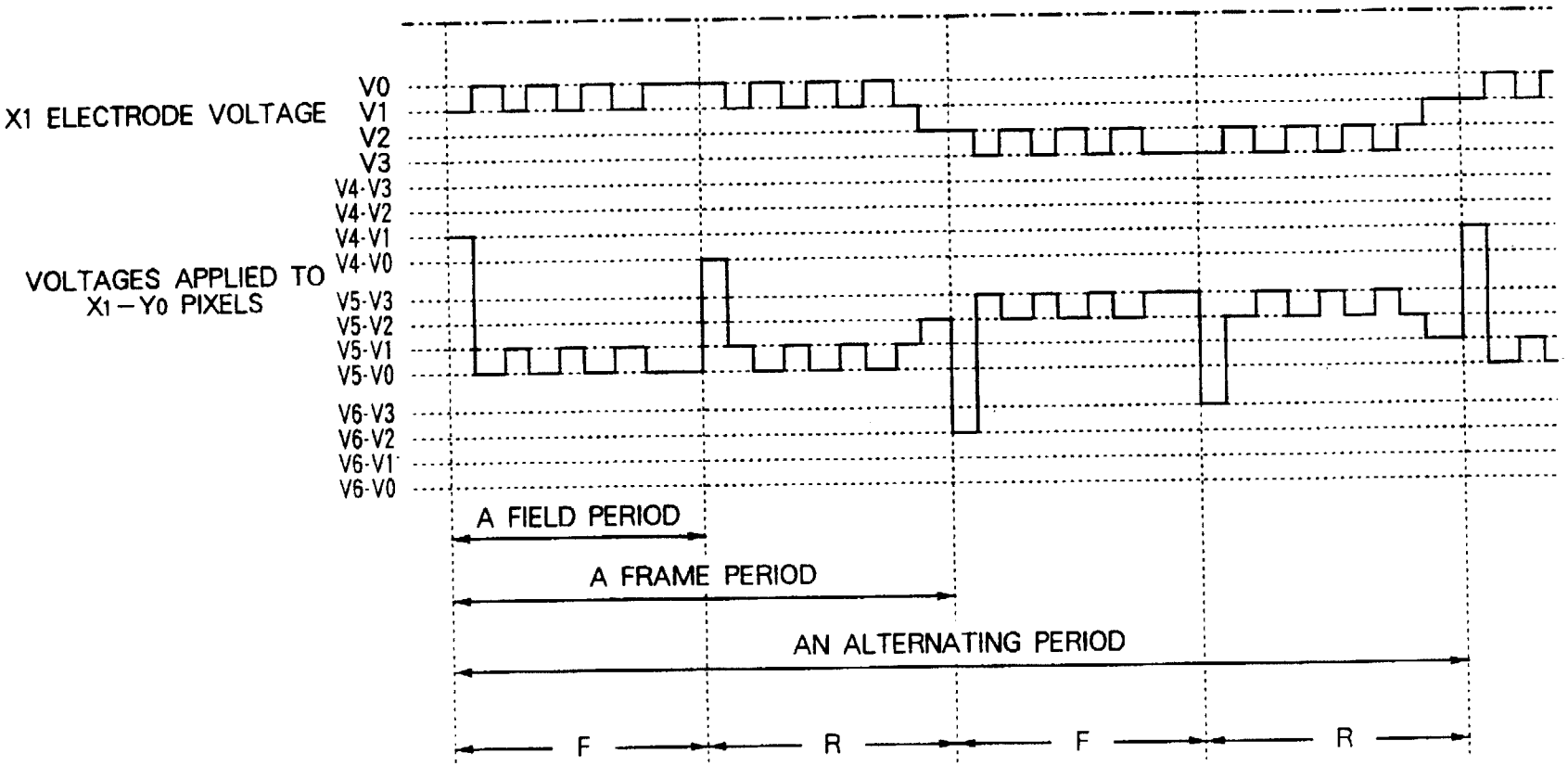

FIGS. 33*a*, 33B and 33C show the voltages actually applied to the display pixels of the data electrodes and the scan electrodes, which voltages are applied as described above. In the selecting interval within the two field periods of one frame period, the combination of the voltages applied to each pixel defines the pixel tone. Further, the voltage is applied to the liquid crystal so that the weight of the tone bit is switched at each column or row. Hence, the voltage applied to the liquid crystal changes in each one horizontal interval. This makes it possible to reduce the unevenness on the display resulting from the frequency characteristic of the threshold value of the liquid crystal.

As set forth above, the liquid crystal device according to the second embodiment offers the same effect as the device according to the first embodiment. It is effective in reducing the unevenness on the display resulting from the frequency characteristic of the threshold value of the liquid crystal by changing the voltage applied to the liquid crystal in each one horizontal interval by changing the voltage applied to the liquid crystal in each one horizontal interval.

Figure 34:
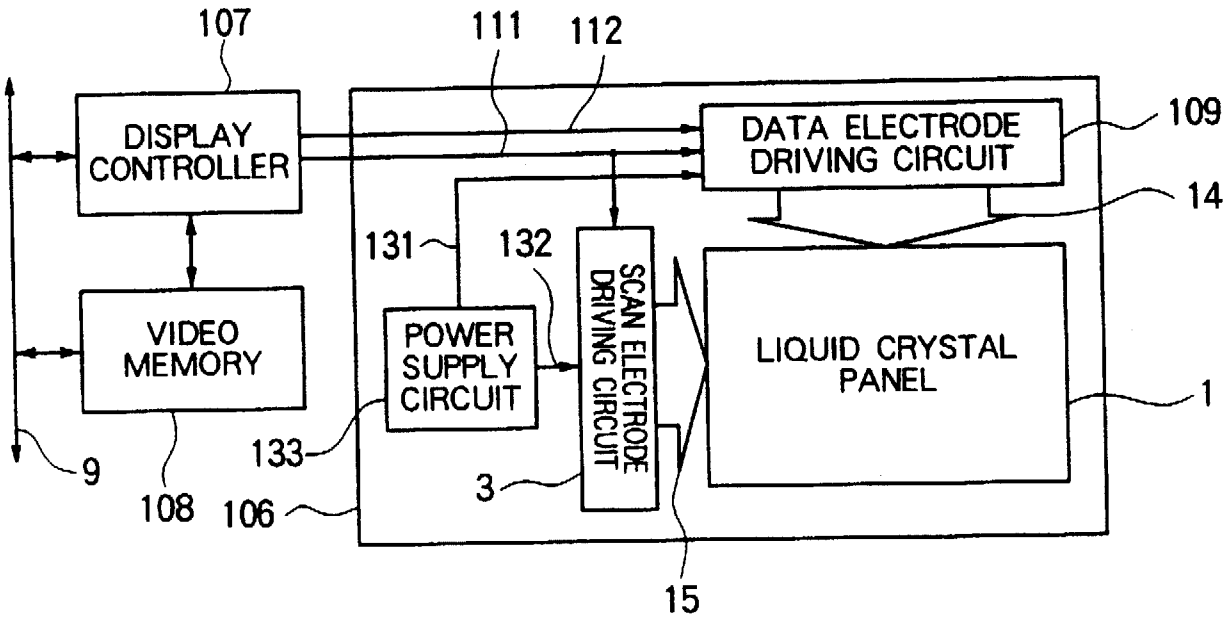
FIG. 34 is a block diagram showing a liquid crystal display device and method according to a third embodiment of the present invention.

FIG. 34 is a block diagram showing a liquid crystal display device and method according to a third embodiment of the invention. In this figure, a numeral 106 denotes a liquid crystal display module. A numeral 107 denotes a display controller. A numeral 108 denotes a video memory. A numeral 109 denotes a data electrode driving circuit. A numeral 133 denotes a power supply circuit. The corresponding components of FIG. 34 to those of FIG. 1 have the same reference numbers.

In FIG. 34, a system bus 9 is a basic bus for connecting a personal computer or a wordprocessor apparatus, through which bus the control data and the display data is loaded from the display controller 107 to the video memory 108 under the control of the CPU (not shown), the micro processor (not shown) and the memory for storing a program. The display controller 107 has the same capability as the CRT controller HD 6845 manufactured by Hitach, Ltd. The display controller 107 operates to rapidly read the display data stored in the video memory 108 (for example, at a frame frequency of 150 Hz or more) and send it as the 8-bit display data 112 to the liquid crystal display module 106 at a higher frame frequency. Further, the display controller 107 operates to send to the liquid crystal display module 106 the input clock 11 corresponding to the reference clock synchronized with the 8-bit display data 112.

The rate at which the 8-bit display data 112 is sent out is equal to how often the display data composing one screen is sent out, that is, a frame frequency. To rapidly read it out of the video memory 108, the frame frequency is set as 150 Hz or more.

The 8-bit display data 112 sent out at the frame frequency of 150 Hz or more is fed to the data electrode driving circuit 109 in the liquid crystal display module 106. The data electrode driving circuit 109 receives the 8-bit display data 112 at a high frame frequency and generate and output the data electrode driving signal 14 for driving the liquid crystal panel 1 at a high frame frequency.

On the other hand, the scan electrode driving circuit 3 operates to generate the scan electrode driving signal 15 from the input clock 111. With this driving signal 15, the liquid crystal panel 1 is driven at such a high frame frequency as 150 Hz, for example.

In order to drive the liquid crystal panel 1 at a high frame frequency, the display controller 107 operates to output the 8-bit display data 112 at a high frame frequency. The data electrode driving circuit 109 and the scan electrode driving circuit 3 are arranged to cover this high frame frequency.

Figure 35:
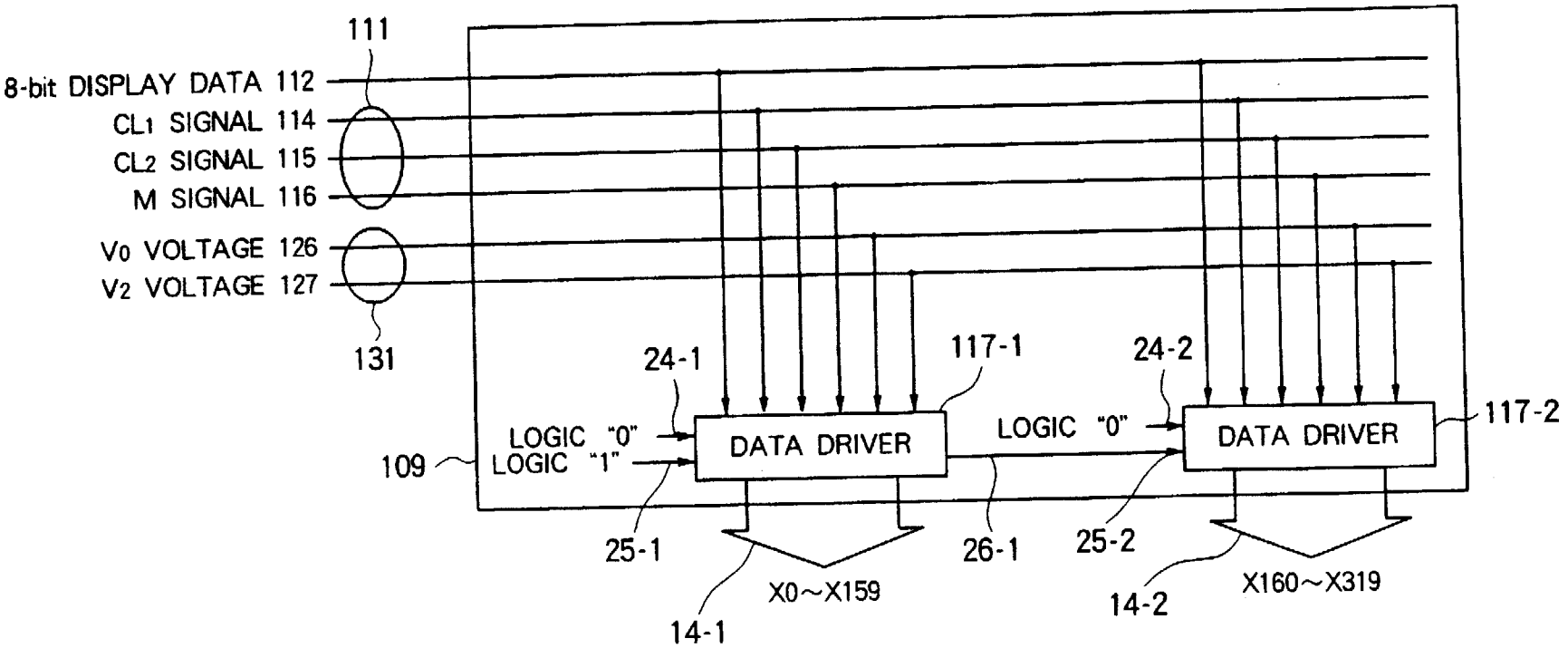
FIG. 35 is a block diagram showing a concrete arrangement of a data electrode driving circuit shown in FIG. 34.

FIG. 35 is a block diagram showing a concrete arrangement of the data electrode driving circuit 109 shown in FIG. 34, in which numerals 117-1 and 117-2 denote data drivers.

In FIG. 35, the data electrode driving circuit 109 is composed of data drivers 117-1 and 117-2. Then, the display controller 107 (see FIG. 34) operates to feed the 8-bit display data 112 and the input clock 111 composed of the CL1 signal 114, the CL2 signal 115 and the M signal 116. From these signals, the data electrode driving circuit 109 operates to generate the driving signal 14-1 for the data electrodes X0 to X159 and the driving signal 14-2 for the data electrodes X160 to X319.

Figure 36:
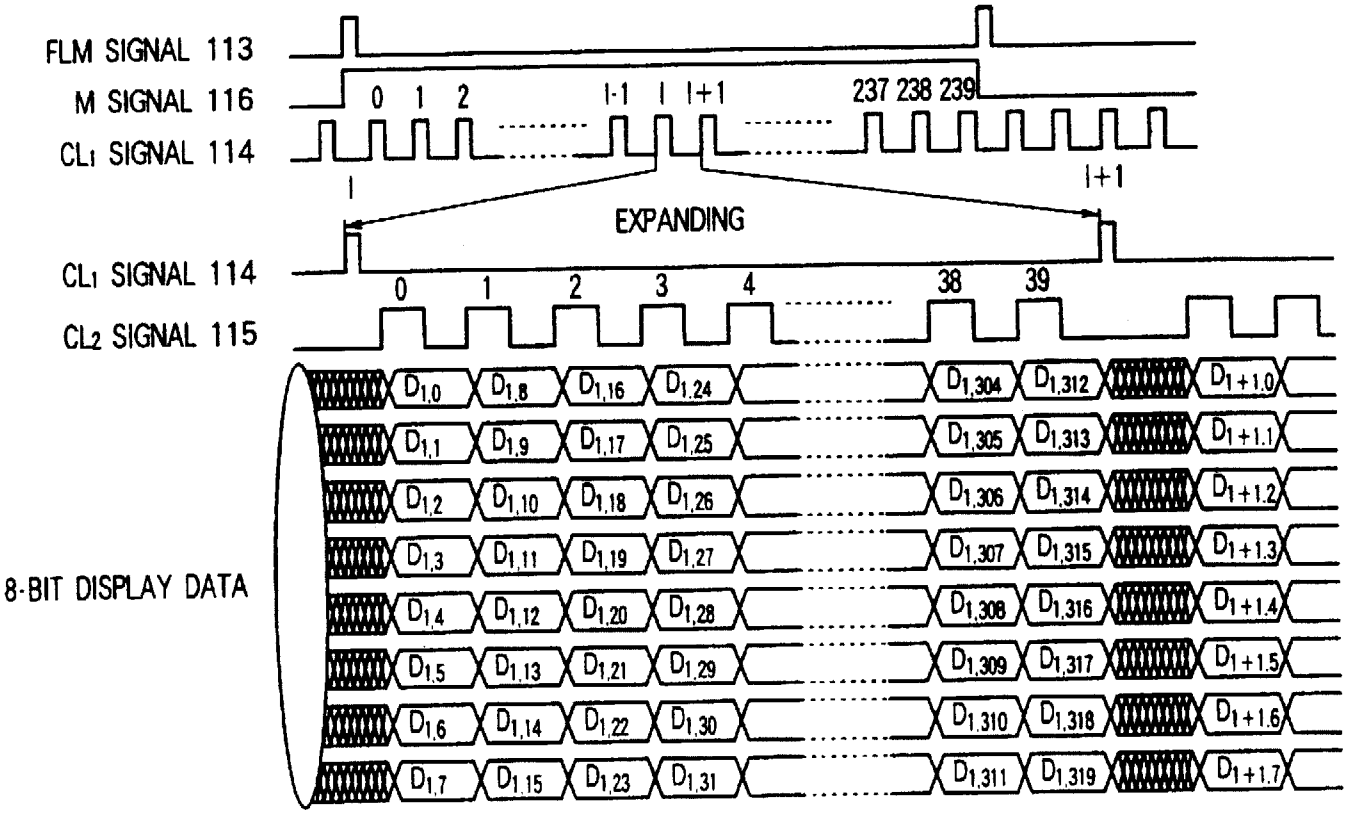
FIG. 36 is a view showing a timing relation between an input clock and an 8-bit display data in the circuit shown in FIG. 35.

FIG. 36 shows the timing relation between the input clock 111 and the 8-bit display data 112.

In FIG. 36, the FLM signal 113 is a signal indicating whether or not the 8-bit display data 112 for one overall screen has been sent out. The reverse of the period of the FLM signal 113 is a frame frequency. (In this embodiment, the frame frequency is 150 Hz or more as noted above.) And, the CL1 signal 114 for one period of the FLM signal 113 are fed to the data drivers in the form of 240 pulses. This CL1 signal 114 is a clock to be generated each time the 8-bit display data 112 for one line is fed to the data drivers. One period of this CL1 signal 114 is one horizontal interval. 240 horizontal intervals compose one frame.

At each period of the CL1 signal 114, 40 pieces of 8-bit display data 112 are serially sent to the data drivers with the CL2 signal. One CL2 signal 115 contains data for 8 pixels. It means that the 8-bit display data 112 consisting of 8×40=320 pixels is set to the data drivers during one horizontal interval.

As described above, the 8-bit display data 112 for one screen is synchronized with each clock at the frame frequency of 150 Hz when it is sent to the data drivers.

Returning to FIG. 35, a data reference voltage 131 to be fed from the power supply circuit (see FIG. 34) to the data drivers 117-1 and 117-2 is composed of a V0 voltage 126 and a V1 voltage 127. On the input clock 111, the data electrode driving signal 14 is generated from the 8-bit display data 112 fed from the data drivers 117-1 and 117-2 with the data reference voltage 131. The shift direction signal 24 and the enable input signal 25 to be fed to the data drivers 117-1 and 117-2 are control signals which define the operations of the data drivers 1117-1 and 117-2. The operation is the same as that described about the first embodiment. Hence, the description of the operation is left out.

Figure 37:
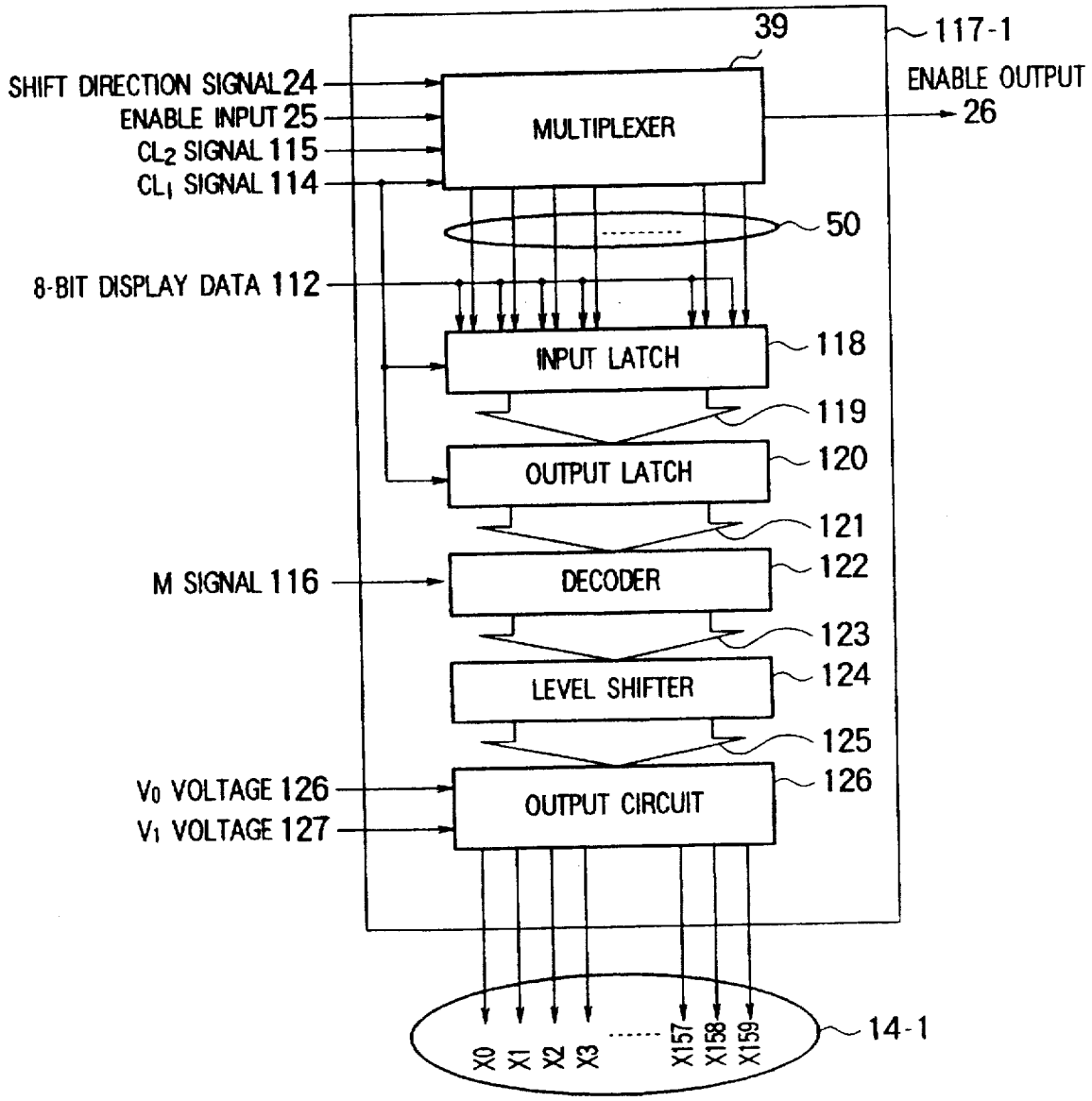
FIG. 37 is a block diagram showing a concrete arrangement of a data driver shown in FIG. 35.

FIG. 37 is a block diagram showing a concrete arrangement of the data driver 117-1 shown in FIG. 35. A numeral 118 denotes an input latch. A numeral 120 denotes an output latch. A numeral 122 denotes a decoder. A numeral 124 denotes a level shifter. A numeral 135 denotes an output circuit. The same components of FIG. 37 as those shown in FIG. 5 have the same reference numbers.

In FIG. 37, the 8-bit display data 112 for one line is stored in the input latch according to the operation of the multiplexer 38. It is outputted as an 8-bit latch output signal 119 from the input latch as soon as it is inputted in response to the CL1 signal 114. The arrangement and the operation of the multiplexer 39 are the same as those described in the first embodiment shown in FIG. 6. Hence, the description about them is left out. This 8-bit latch output signal 119 is stored in the output latch 120 in response to the CL1 signal 114. The output latch 120 operates to output the stored one as a latch output signal 121. The decoder 122 operates to decode the latch output signal 121 in combination with the M signal 116 and generate a decoder output signal 123 indicating if the V0 voltage 126 or the V1 voltage 127 is selected. The level shifter 124 operates to convert this decoder output signal 123 into a level shifter output signal 125 for driving the output circuit 135. The output circuit 135 operates to select any one of the V0 signal 126 and the V1 signal 127 according to the level shifter output signal 125. The selected signal is fed as the data electrode driving signal 14 to the data electrodes X0, X1, . . . , X159 of the liquid crystal panel 1.

The data driver 117-2 shown in FIG. 35 has the same arrangement as described above. When the enable output signal 26 shown in FIG. 37 has a logic 1, the data driver 117-2 operates to generate the data electrode driving signal 14-2 in the similar manner to the data driver 117-1.

Figure 38:
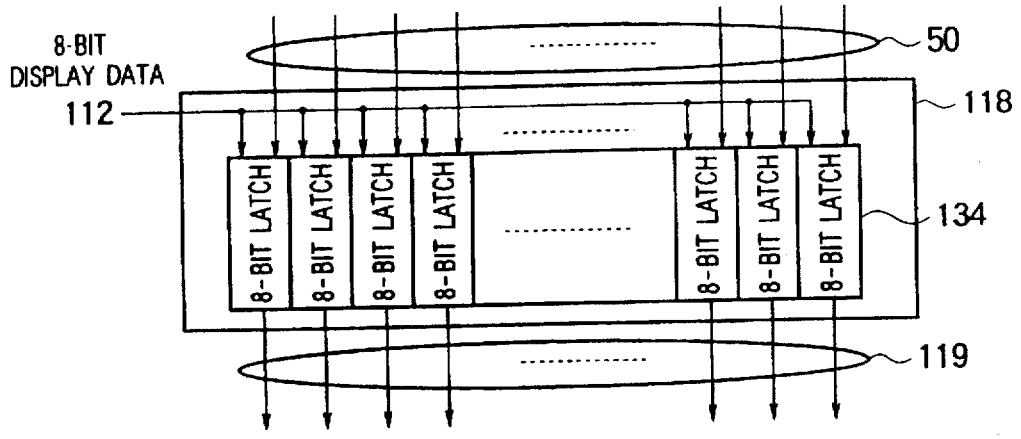
FIG. 38 is a block diagram showing a concrete arrangement of an input latch shown in FIG. 37.
Figure 39:
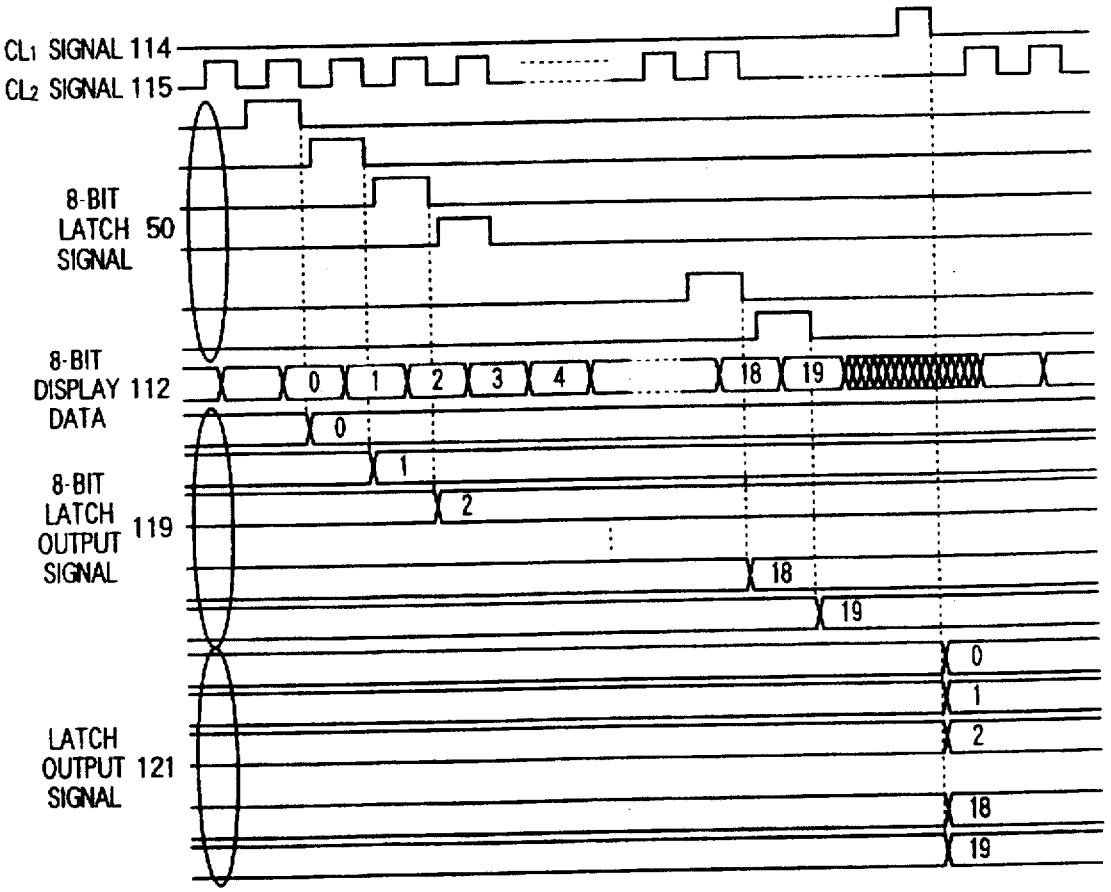
FIG. 39 is a timing view showing how the input latch and an output latch shown in FIG. 37 operate.

FIG. 38 is a block diagram showing a concrete arrangement of the input latch 118 shown in FIG. 37, in which a numeral 134 denotes a 8-bit latch.

In FIG. 38, the input latch 118 is composed of 40 8-bit latches 134. In response to an indication of the latch signal 50 sent from the multiplexer 39 (see FIG. 37), the 8-bit display data 112 for one line is sequentially stored in these 8-bit latches 134, from which are outputted 8-bit latch signals 119. As shown in FIG. 2, this embodiment is arranged so that the liquid crystal panel 1 has 320 data electrodes. Further, since the data electrode driving circuit 109 uses two data drivers 117-1 and 117-2 as shown in FIG. 35, the input latch 118 includes 40 8-bit latches 134 therein.

Next, the description will be oriented to the operations of the input latch 118 and the output latch 120 shown in FIG. 37.

In the input latch 118, the 8-bit display data 112 is latched in the 8-bit latches 134 in sequence through the 8-bit latch signal 50. That is, the forty 8-bit latches 134 operate to sequentially latch the pieces of 8-bit display data 112 being serially sent thereto and temporarily store those pieces of 8-bit display data 112 as the display data for one line. Then, the 8-bit latch signals 68 outputted from the 8-bit latches are fed to the output latch 120. Those signals are simultaneously read by the output latch 120 through the effect of the CL1 signal 114 being fed thereafter. The output latch 120 operates to output it as the latch output signal 121 to the decoder 122.

Figure 40:
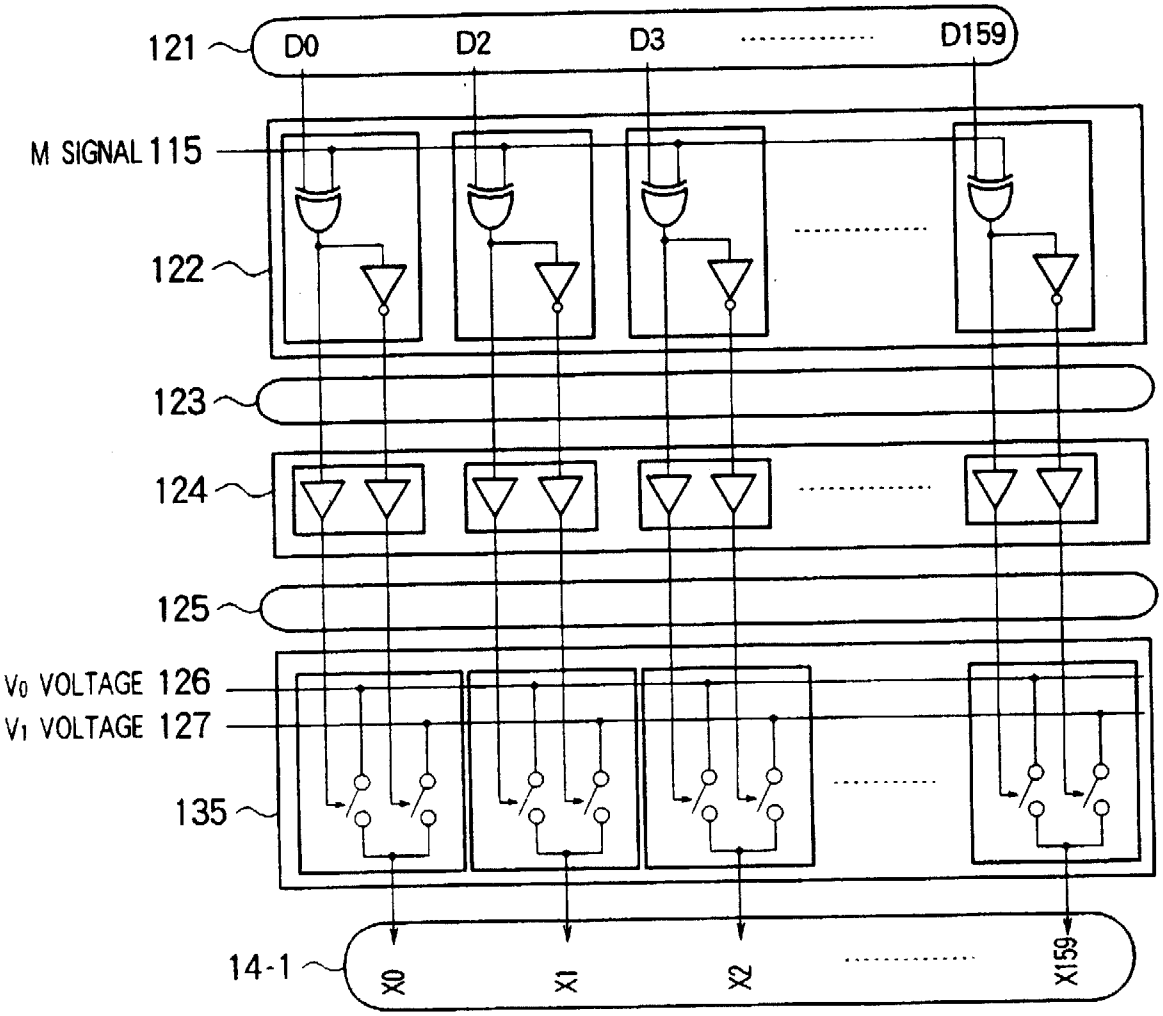
FIG. 40 is a circuit diagram showing concrete arrangements of a decoder, a level shifter and an output circuit shown in FIG. 37.

FIG. 40 is a diagram showing a concrete arrangement of the decoder 122, the level shifter 124 and the output circuit 135 shown in FIG. 37. The same components of FIG. 40 as those shown in FIG. 37 have the same reference numbers.

In FIG. 40, the latch output signal 121 outputted from the output latch 120 are fed to the decoder 122. The decoder 122 operates to generate the decode signal 123 from the latch output signal 121 with the M signal 116. This decode signal 123 is converted into a signal 125 for driving the output circuit 123 through the effect of the level shifter 124. For example, the output circuit 135 composed of a transistor operates to select as the data electrode driving signal 14-1 one of the V0 voltage 126 and the V1 voltage 127 according to the signal 125.

Table 3 indicates how the data electrode driving signal 14 is generated with the M signal 116 through the effect of the decoder 122, the level shifter 124 and the output circuit.

TABLE 3

| M Signal 116 | Latch Output Signal 121 | Output 14 |
|---|---|---|
| 0 | 0 | $V_0$ |
| 0 | 1 | $V_1$ |
| 1 | 0 | $V_1$ |
| 1 | 1 | $V_0$ |

Table 3 is an output truth table of the data electrode driving signal 14 generated in the decoder 122, the level shifter 124 and the output circuit 135. As listed in Table 3, the display data for one line outputted from the output latch 120 is converted into the data electrode driving signal 14, which is fed to the liquid crystal panel 1.

The above operation holds true to the data driver 17-2 shown in FIG. 35.

Figure 41:
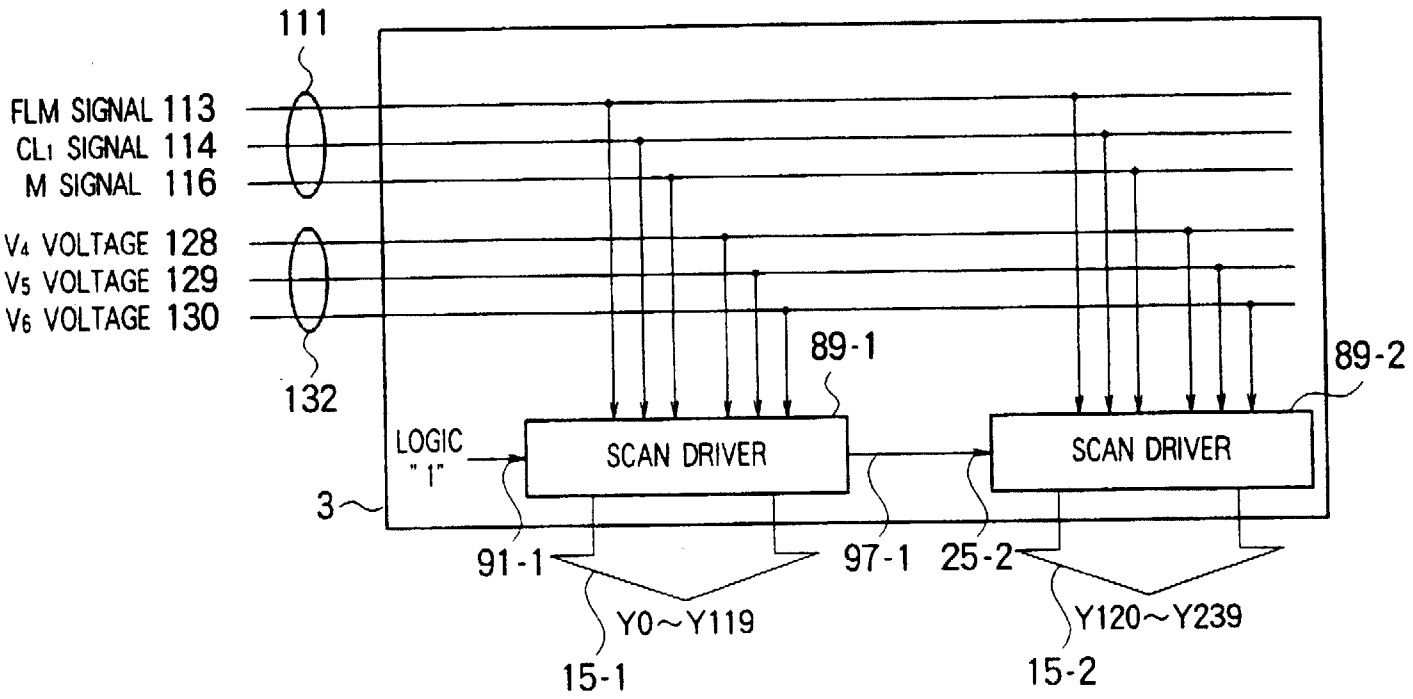
FIG. 41 is a block diagram showing a concrete arrangement of a scan electrode driving circuit shown in FIG. 34.

FIG. 41 is a block diagram showing a concrete arrangement of the scan electrode driving circuit 3 shown in FIG. 34. The same components of FIG. 41 as those shown in FIG. 24 have the same reference numbers.

In FIG. 41, the scan drivers 89-1 and 89-2 have the same arrangements as those shown in FIG. 24. In FIG. 24, however, the display clock generator 4 (see FIG. 1) operates to feed a display clock, while in FIG. 41, a display controller 107 (see FIG. 34) operates to feed an input clock 111. The input clock 111 is composed of the FLM signal 113, the CL1 signal 114 and the M signal 116. The FLM signal 113 and the CL1 signal 114 correspond to the scan start signal 105 and the line signal 28 shown in FIG. 24, respectively. In response to these signals, the scan drivers 89-1 and 89-2 shown in FIG. 41 operate to generate the scan electrode driving signals 15-1 and 15-2 in the same manner as the scan drivers 89-1 and 89-2 shown in FIG. 34.

FIG. 42 is a block diagram showing a concrete arrangement of the power supply circuit 133 shown in FIG. 34, in which numerals 136 to 140 denote buffer amplifiers and R4 and R5 denote resistors.

In FIG. 42, the power supply circuit 133 is composed of divider resistors R5, R4, R4 and R5 series-connected between the terminal of the voltage $V_{cc}$ and the terminal of the voltage $V_{LCD}$ and buffer amplifiers 136 to 140. The voltage $V_{cc}$ is fed to the buffer amplifier 136 from which the V4 voltage 128 is outputted. The voltage $V_{LCD}$ is fed to the buffer amplifier 140 from which the V6 voltage 130 is outputted. The voltages at a contact between the resistors R5 and R4, a contact between the resistors R5 and R4, and a contact between the resistors R5 and R4 are sent to the buffer amplifiers 137, 138 and 139, respectively, from which amplifiers the V0 voltage 126, the V5 voltage 129 and the V1 voltage 127 are outputted. Those voltages have a relation of V4>V0>V5>V1>V6.

Herein, the voltages $V_{cc}$ and $V_{LCD}$ and the resistors R4 and R5 are adjusted so that the V4 voltage 128, the V0 voltage 126, the V5 voltage 129, the V1 voltage 127 and the V6 voltage are made to have the predetermined values.

Figure 43:
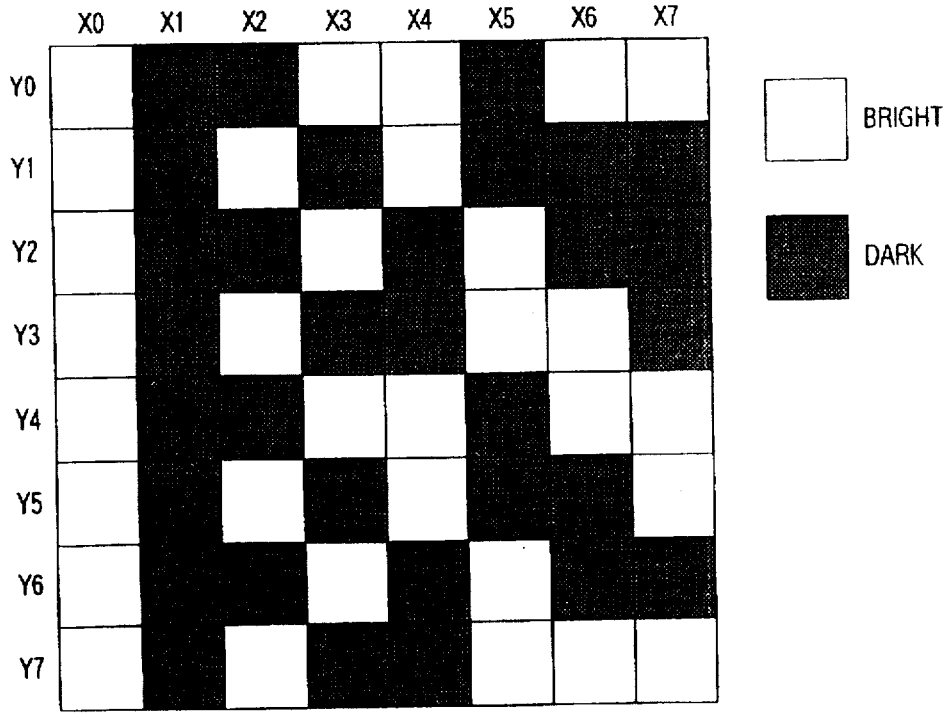
FIG. 43 is an illustration exemplarily showing an example of a display pattern in the liquid crystal panel shown in FIG. 34.

Next, the description will be oriented to the waveform of the voltage applied to the liquid crystal panel 1 (see FIG. 34) according to the third embodiment in the case of obtaining the display pattern shown in FIG. 43. FIG. 43 shows a concrete example of the display pattern assumed when the liquid crystal panel 1 consists of 8×8 dots. Herein, a binary representation of "bright" and "dark" is achieved. X0 to X7 denote data electrodes. Y0 to Y7 denote scan electrodes.

Figure 44:
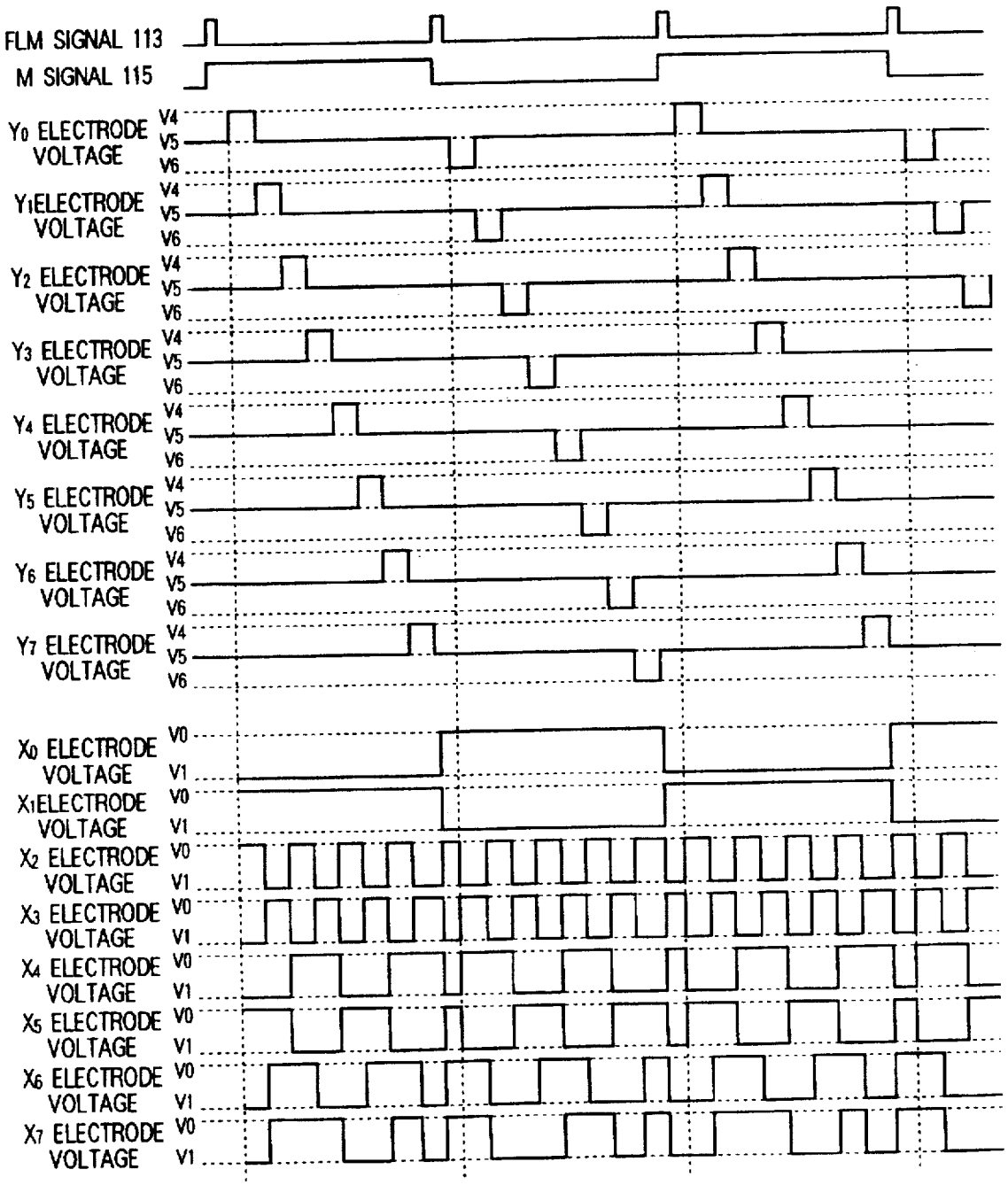
FIG. 44 is a view showing an example of a liquid crystal driving waveform against the display pattern shown in FIG. 43 included in the third embodiment shown in FIG. 34.

FIG. 44 shows the waveforms of the voltages applied onto the data electrodes X0 to X7 and the scan electrodes Y0 to Y7 for realizing the display pattern.

In FIG. 44, the period of the FLM signal 113 is a frame period. The M signal 116 is logically reversed at each frame period. That is, the M signal 116 is a frame alternation like the first embodiment. The V4 to the V6 voltages are sequentially applied to the scan electrodes Y0 to Y7. With these voltages applied thereon, the V0 or the V1 voltage is applied to the data electrode according to the on or off state of the display.

If the liquid crystal panel having M row electrodes (scan electrodes) is activated in a time divisional driving system (1/240 duty), assuming that the scan electrode voltage Vs and the data electrode voltage Vd have the following relation of;

$$V_s = \sqrt{M}\ V_d \tag{1}$$

it is generally known that a ratio of an effective value of an on display and an off display is made maximum.

Herein, the ratio of the scan electrode voltage Vs and the data electrode voltage Vd is referred to as a bias ratio. The data electrode voltage Vd (that is, the V0 voltage 126 and the V1 voltage 127 in the third embodiment) is referred to as a bias voltage. When the liquid crystal panel is driven at 1/240 duty and at a threshold voltage of 2.5 volts, the bias voltage is about 2 volts. In the third embodiment, the display state is switched on or off by changing the polarity of the bias voltage. Hence, the data electrode voltage composed of the V0 voltage 126 and the V1 voltage 127 outputted from the data electrode driving circuit 109 has an amplitude of ±2 volts.

On the other hand, the display controller 107 operates to output the 8-bit display data 112 and the input clock 111 so that the frame frequency may be about 150 Hz or more against the fast responsive liquid crystal. Through the effect of the signals 112 and 111, the voltage waveforms of the scan electrodes Y0 to Y7 and the data electrode X0 to X7 make their frame frequency so high that the fast responsive liquid crystal may be driven at high contrast.

Figure 45:
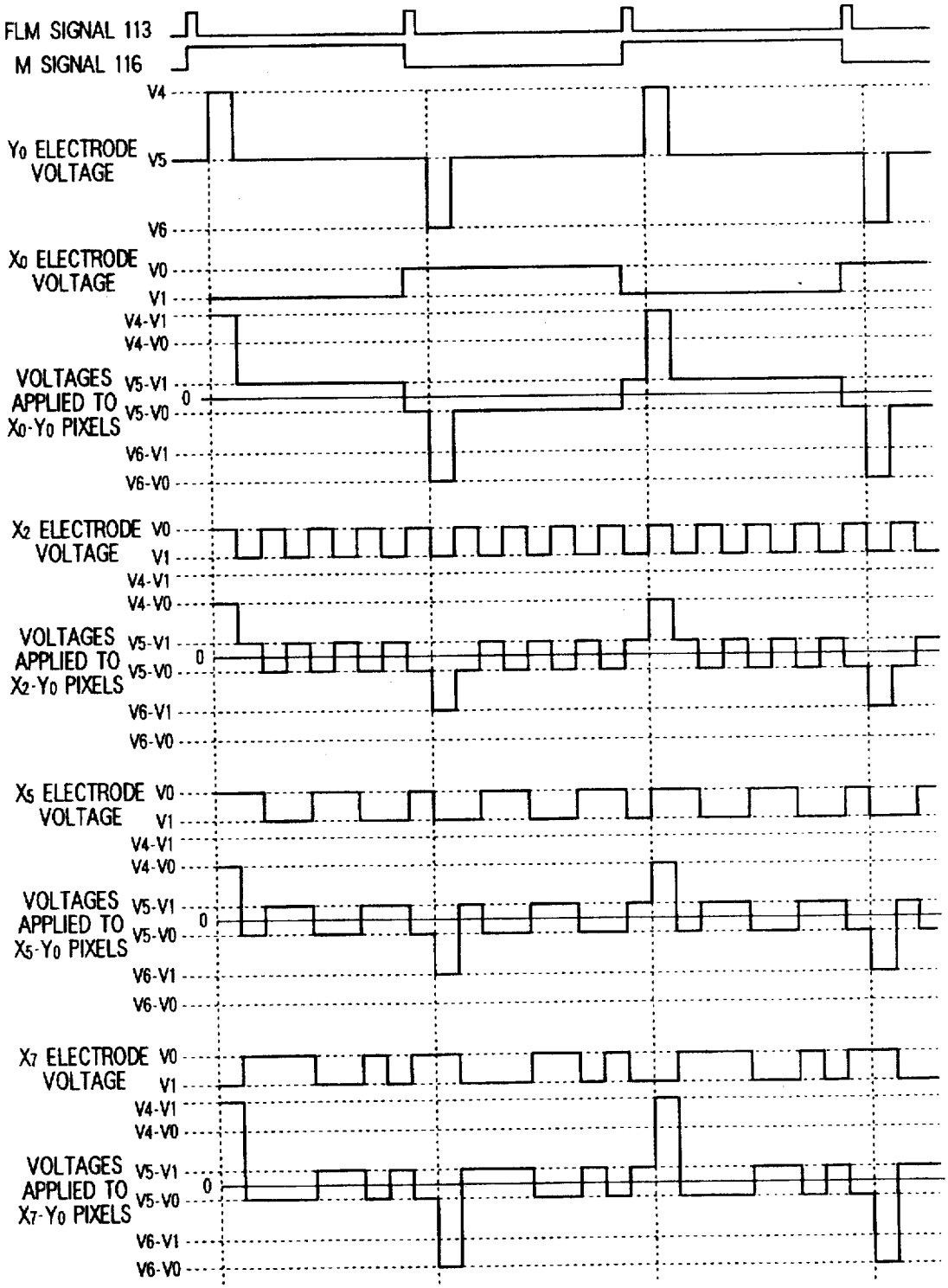
FIG. 45 is a view showing an example of a voltage applied to a display pixel of the liquid crystal included in the third embodiment, against the liquid crystal driving waveform shown in FIG. 44.
Figure 46:
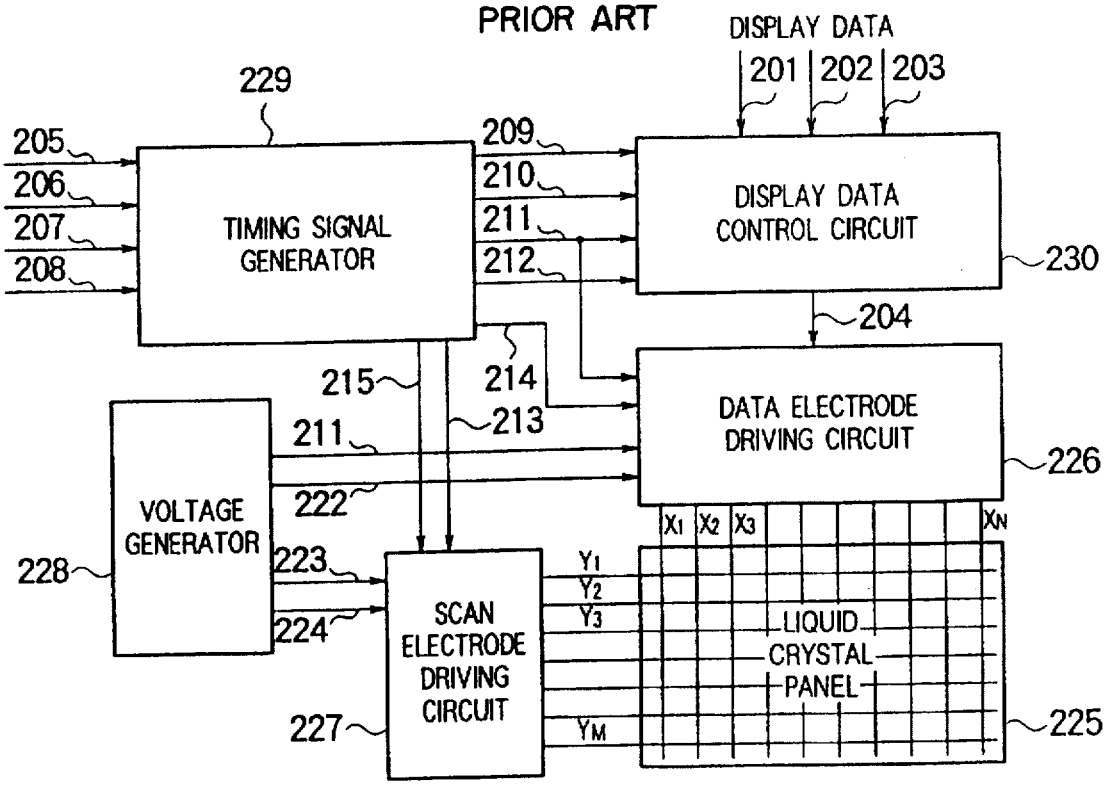
FIG. 46 PRIOR ART
FIG. 46 is a block diagram showing a conventional liquid crystal display device.
Figure 47:
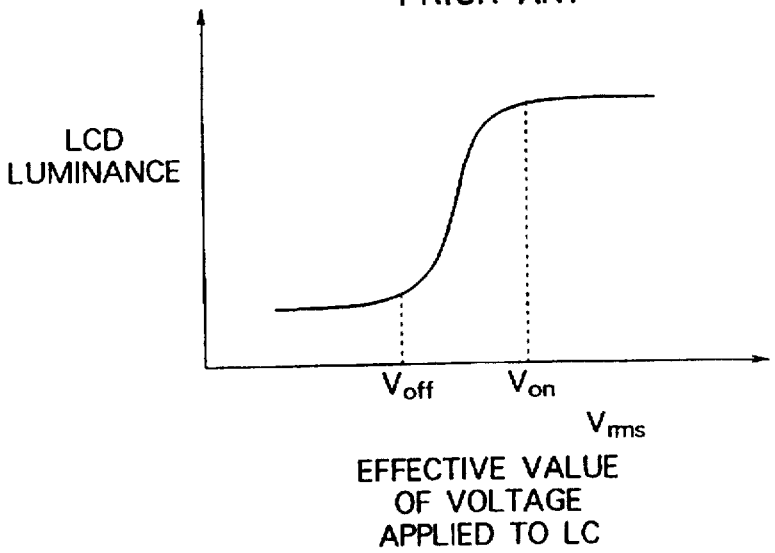
FIG. 47 PRIOR ART
FIG. 47 is a graph showing a display characteristic of liquid crystal.
Figure 48:
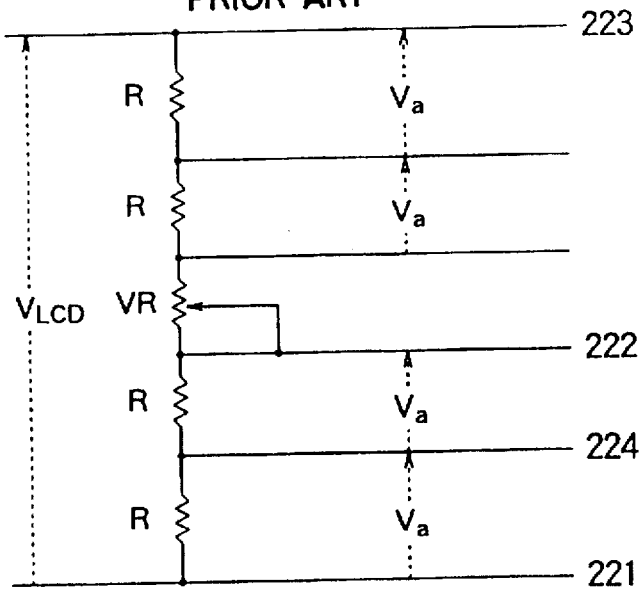
FIG. 48 PRIOR ART
FIG. 48 is a circuit diagram showing an arrangement of a voltage generating circuit shown in FIG. 46.
Figure 49:
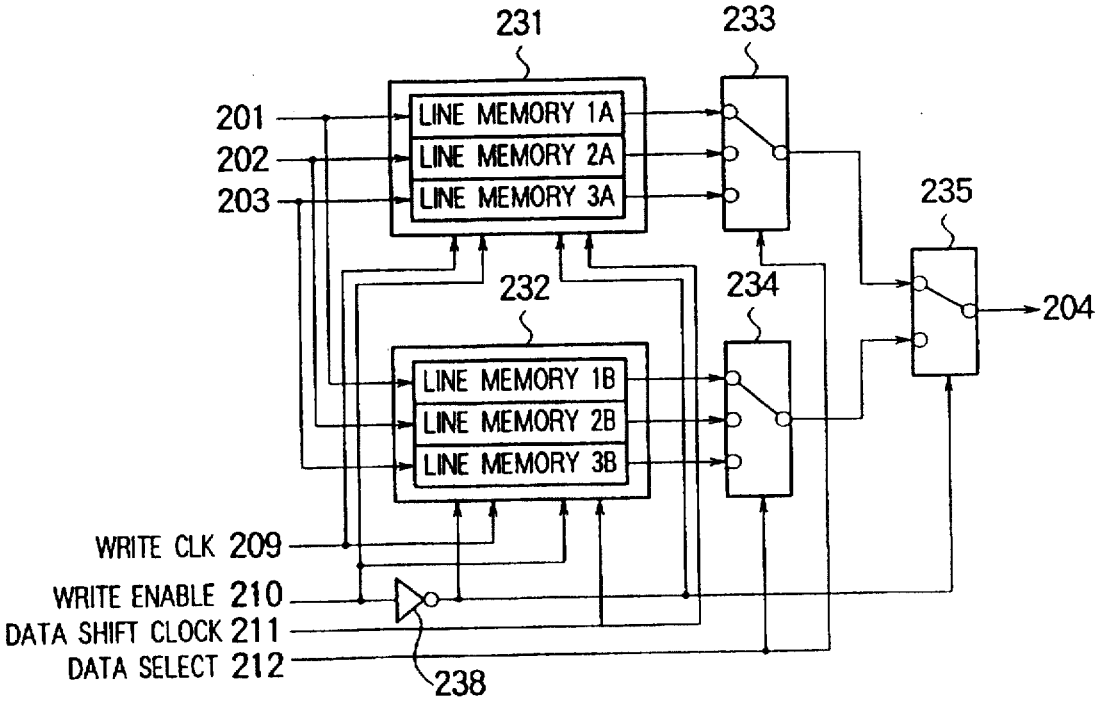
FIG. 49 PRIOR ART
FIG. 49 is a block diagram showing an arrangement of a display data control circuit shown in FIG. 46.

FIG. 45 shows the waveforms of the voltages actually applied to the data electrodes X0 to X7 and the scan electrodes Y0 to Y7 in such a manner as described above.

The data electrode voltage given during the selecting interval defines the effective value to be given to the liquid crystal. On the defined effective value, the display is switched from an on state to an off state or vice versa. Further, since the frame frequency is defined to be 150 Hz or higher, the fast responsive liquid crystal is driven at high contrast.

In general, the power consumed in a semiconductor circuit is proportional to an operating frequency, a load capacitance and a square of an operating voltage. If, therefore, the operating voltage is reduced to a half, the power consumption may be reduced to a quarter. The conventional voltage average method needs a highly withstand output circuit for the data electrode driving signal. On the other hand, the liquid crystal display device according to the third embodiment of the invention is arranged to just output the bias voltage. Hence, the output circuit 135 (for example, a transistor) shown in FIG. 37, which is provided in the data driver 117-1 or 117-2 of the data electrode driving circuit 109, does not need to have so high a withstand voltage. Hence, the operating voltages of the data drivers 117-1 and 117-2 may be reduced accordingly. This results in greatly reducing the power consumption as well as realizing a high-contrast display without having to increase the power consumption if the operation is made faster by raising the frame frequency, for example. For example, the conventional voltage averaging method needs such a withstand voltage as about 30 volts at 1/240 duty. On the other hand, this embodiment may reduce its operating voltage to 1/6, thereby lowering the power consumption to 1/36. If the frame frequency is made four times as high as that of the conventional method, this embodiment may reduce its power consumption to 4/365 in total, that is, 1/9.

As described above, the third embodiment makes it possible to drive the fast responsive liquid crystal at high contrast and greatly reduce the power consumption of the data electrode driving circuit.

Next, the description will be oriented to a liquid crystal display device and method according to a fourth embodiment of the invention with reference to FIGS. 54 to 73.

The fourth embodiment basically has the same arrangement as the third embodiment. Yet, it is different in a respect that plural scan electrodes (lines L is a more integer than 1) of the liquid crystal panel are selected at a time so as to reduce the liquid crystal driving voltage and thereby the power consumption of the display system. Further, this driving method (see FIG. 58) may apply to the method for driving the liquid crystal by the data electrode driving circuit having a display memory as described with respect to the first embodiment (see FIG. 5). The method for selectively driving plural scan electrodes at a time is disclosed in JP-A-6-67628 and the U.S. patent application Ser. No. 08/340,485 filed in Nov. 14, 1994 corresponding to the Japanese publication. Later, the principle of the method will be briefly described with reference to FIGS. 54 and 55.

Figure 54:
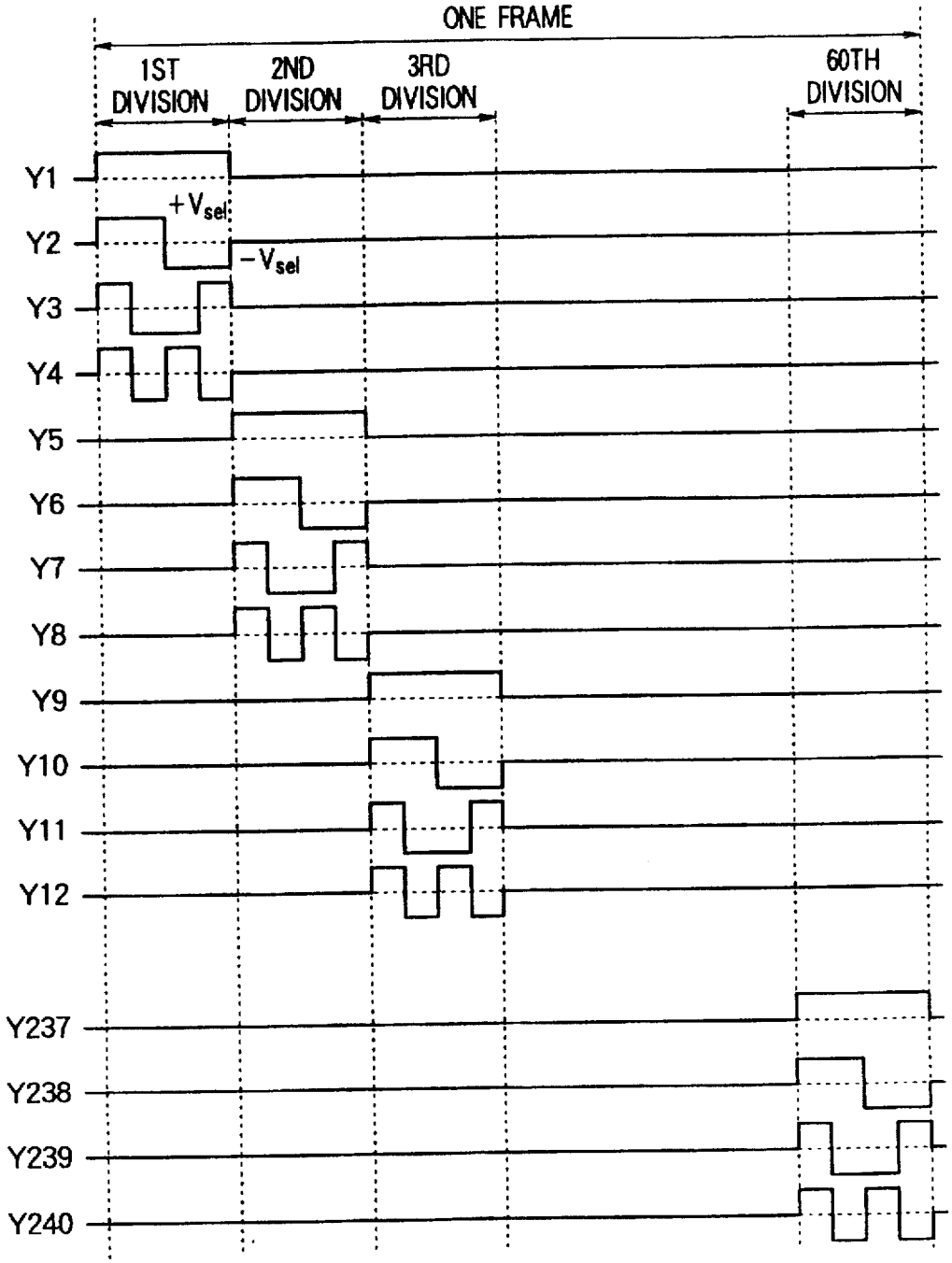
FIG. 54 is a waveform view showing an example of a scan signal given in the case of selecting plural scan electrodes of a simple matrix type liquid crystal panel at a time.

FIG. 54 shows the waveforms of the scan signals given in the case of selecting plural scan electrodes provided in the simple matrix type liquid crystal panel at a time.

Figure 55:
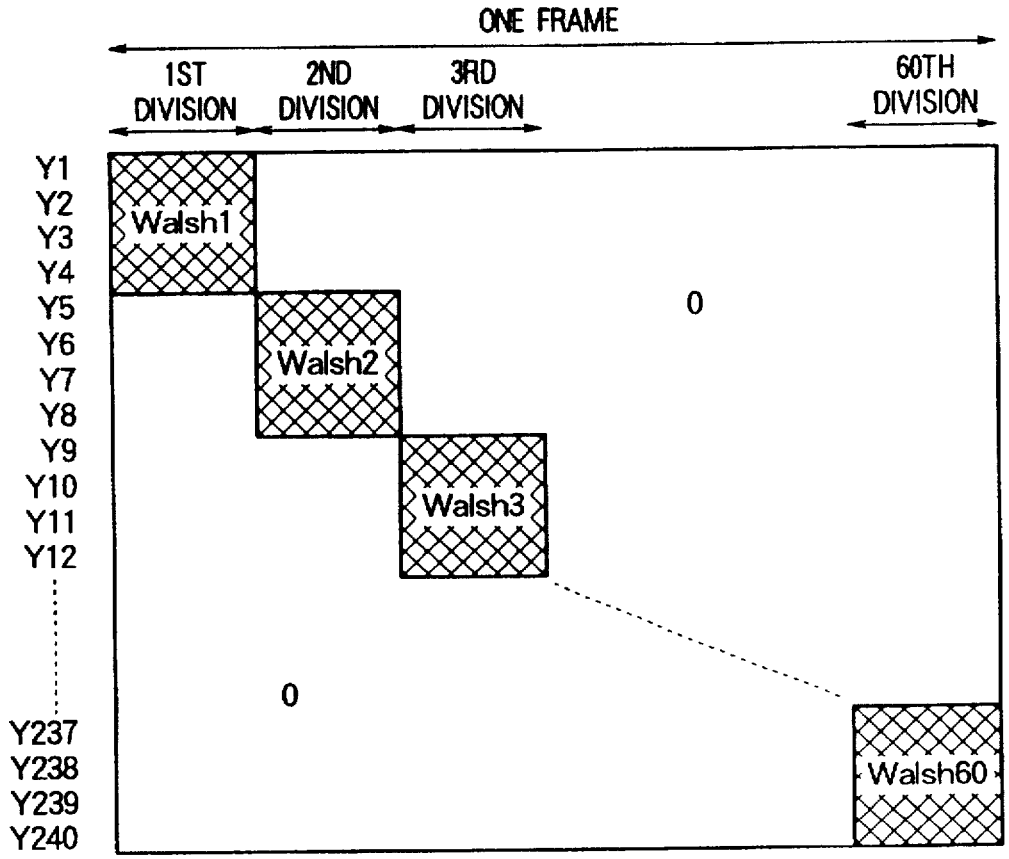
FIG. 55 is a view exemplarily showing a waveform shown in FIG. 54.

In FIG. 54, the liquid crystal panel has such an arrangement as shown in FIG. 2, which includes 240 scan electrodes Y1 to Y240. Each four scan electrodes are driven at a time. Hence, 60 scans are done for the overall liquid crystal panel. By these scans, the scan signal is given to all the scan electrodes. Herein, the time of interval when plural scan electrodes are selected at a time is referred to as a divisional interval. In the first divisional interval, the scan electrodes Y1 to Y4 are selectively driven. In the second divisional interval, the scan electrodes Y5 to Y8 are selectively driven. In the third divisional interval, the scan electrodes Y9 to Y12 are selectively driven, . . . so forth. That is, each four scan electrodes are driven in sequence. In the last 60th divisional interval, the scan electrodes Y237 to 240 are selectively driven. The waveforms shown in FIG. 54 are exemplified as shown in FIG. 55.

In each divisional interval, the voltages for selecting the scan electrodes are +Vsel and −Vsel. In the other intervals, the voltages are made zero. Herein, Vsel is defined by the following expression (2).

$$V_{sel}=\sqrt{\frac{M}{m}}\sqrt{\frac{\sqrt{M}}{2(\sqrt{M}-1)}}\,V_{th} \tag{2}$$

wherein M is a total number of scan electrodes, m is a number of scan electrodes selected at a time, and Vth is a threshold voltage of the liquid crystal. In general, the i-th row scan voltage Fi(t) is as follows.

$$Fi(t)=V_{sel}\,w_i \tag{3}$$

wherein wi is a function which becomes +1 or −1 in the selecting interval but 0 in the non-selecting interval. In the selecting interval, an orthogonal function is used. As an example of an orthogonal function, the Walsh function may be referred. Hence, the value indicated in the expression (3) is a value given by multiplying the value of the expression (2) by+1, 0 or −1. Against such a scan voltage, the driving voltage Gj(t) of the j-th column data electrode is derived as follows.

$$Gj(t)=\frac{1}{\sqrt{M}}\sum_{i=1}^{N} I_{ij}F_i(t) \tag{4}$$

wherein $I_{ij}$ denotes display data at the display pixel of the i-th row and j-th column. The on state of the display takes a value of −1, while the off state takes a value of +1. Hence, the expression (4) may be transformed by the expressions (2) and (3). The resulting expression is as follows.

$$Gj(t)=\frac{1}{\sqrt{M}}\sqrt{\frac{\sqrt{M}}{2(\sqrt{M}-1)}}\,(2D-m)V_{th} \tag{5}$$

wherein D is a matching number derived by counting the matched ones of the possible values +1 and −1 of the display data $I_{ij}$ to the possible values +1 and −1 of the function $w_i$ at the i-th row (i=1 to N). The matching means that $I_{ij}=-1$ and $w_i=-1$ or $I_{ij}+1$ and $w_i=+1$ at the i-th row. The other combinations correspond to the mismatch. The matching number D defined as above is an integer ranging from 0 to m.

By driving the liquid crystal panel according to the expressions (3) and (5), the effective values Vrms (on) and Vrm (off) given to the display pixel at the i-th row and the j-th column are derived as follows.

$$V_{rms}(\text{on})=\sqrt{\frac{\sqrt{M}+1}{\sqrt{M}-1}}\,V_{th} \tag{6}$$

$$V_{rms}(\text{off})=V_{th} \tag{7}$$

This is equivalent to the well known voltage averaging driving method.

In summary, the method for driving plural electrodes at a time is arranged so that the scan voltage is given according to the expression (3) and the data voltage is given according to the expression (5).

The withstand voltage required for the driver LS1 for driving the liquid crystal is calculated as follows by the expressions (3) and (5). Assuming that M=240, m=4 and Vth=2.5 volts, the scan driver LSI needs a voltage of 28.3 Vp-p and the data driver LSI needs a voltage of 7.3 Vp-p. Hence, though the conventional voltage average driving method needs to prepare a withstand voltage of 30 V or more for the scan driver LSI and the data driver LSI, this embodiment may reduce the withstand voltage for the data driver LSI to a quarter though it keeps the same withstand voltage for the scan driver LSI, thereby reducing the power consumed in the liquid crystal display device.

In turn, the description will be oriented to the liquid crystal display device according to a fourth embodiment of the present invention, which realizes a method for selecting plural scan electrodes at a time, with reference to FIGS. 56 to 73.

Figure 56:
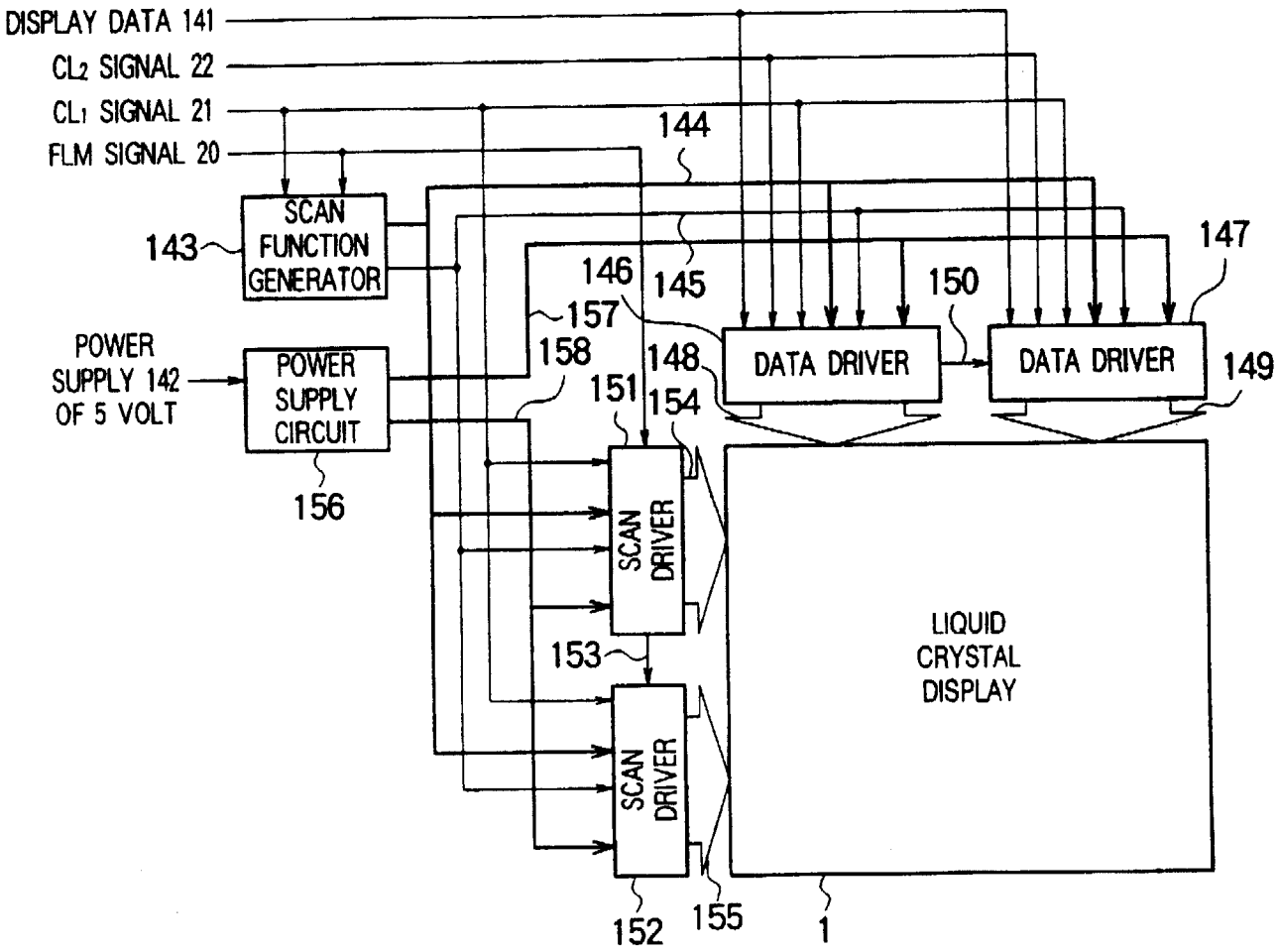
FIG. 56 is a block diagram showing a liquid crystal display device and method according to a fourth embodiment of the present invention.

FIG. 56 is a block diagram showing the liquid crystal display device according to the fourth embodiment of the invention. In this figure, a numeral 143 denotes a scan function generator. Numerals 146 and 147 denote data drivers. Numerals 151 and 152 denote scan drivers. A numeral 156 denotes a power supply circuit. The same components and signals of this figure as those of the previous figures have the same reference numbers.

Figure 57:
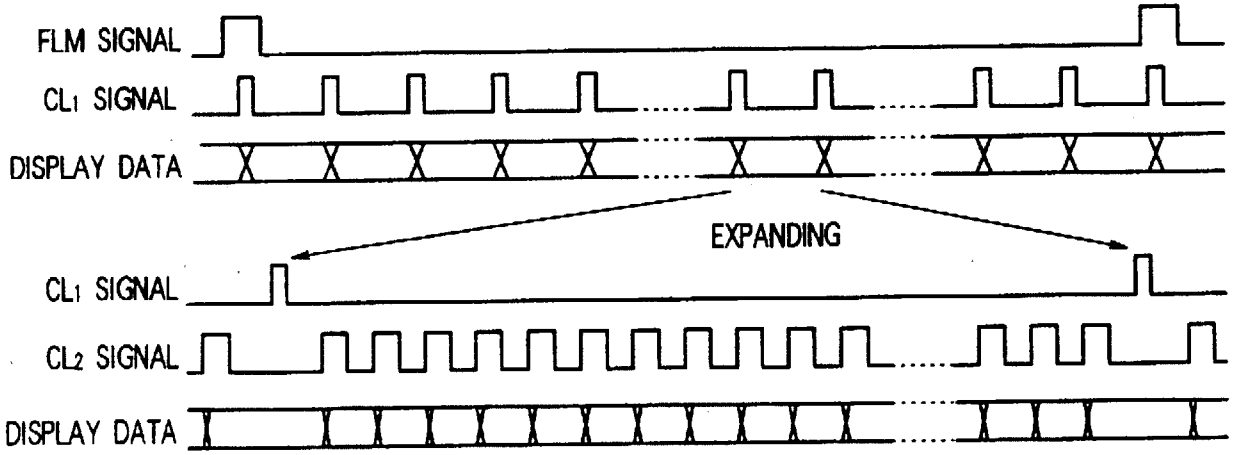
FIG. 57 is a view showing a timing relation among display data, a FLM signal and a CL1 signal shown in FIG. 56.

FIG. 57 is a view showing a timing relation among a display data 141, the FLM signal 20, the CL1 signal 21 and the CL2 signal 22 shown in FIG. 56.

In FIGS. 56 and 57, the display data 141 is supplied from the display controller (not shown) such as the CRT controller HD6845 manufactured by Hitachi, Ltd. described about the first embodiment. The display data 141 is sent together with the CL2 signal 22, the CL1 signal 21 and the FLM signal 20. The display data 141 is fed at each one dot in synchronous to the CL2 signal 22. Each time the display dot for one line is sent from the display controller, the CL1 signal 21 is sent to the device. Each time the display data for the predetermined number of lines is fed to the device, the FLM signal 20 is fed to the device. Later, the description will be expanded on the assumption that the liquid crystal panel contains 320 dots per line and 240 display dots if not specified.

The display data 141 is fed to the data drivers 146 and 147 in synchronous to the CL2 signal 2. The data drivers 146 and 147 read the four-line display data 141.

On the other hand, the scan function generator 143 operates to generate a four-line clock 145 and scan function data 144 from the CL1 signal 21 and the FLM signal 20 and send them out to the data drivers 146 and 147. The data drivers 146 and 147 performs a predetermined operation with respect to the scan function data 144 and the four-line display data and then feed data electrode driving signals 148 and 149 to the liquid crystal panel 1.

Further, the scan drivers 151 and 152 operates to generate a selected voltage from the CLS signal 21, the FLM signal 20, the four-line clock 145 and the scan function data 144 and feed them as scan electrode driving signals 154 and 155 to the liquid crystal panel 1. The power supply circuit 156 operates to generate a data driver supply voltage 157 containing five voltages Vx0, Vx1, Vx2, Vx3, Vx4 and Vx5 and a scan driver supply voltage 158 containing three voltages Vy0, Vy1 and Vy2 from a 5-volt supply voltage 142 and feed the voltages 157 and 158 to the data drivers 146 and 147 and the scan drivers 151 and 152.

Figure 58:
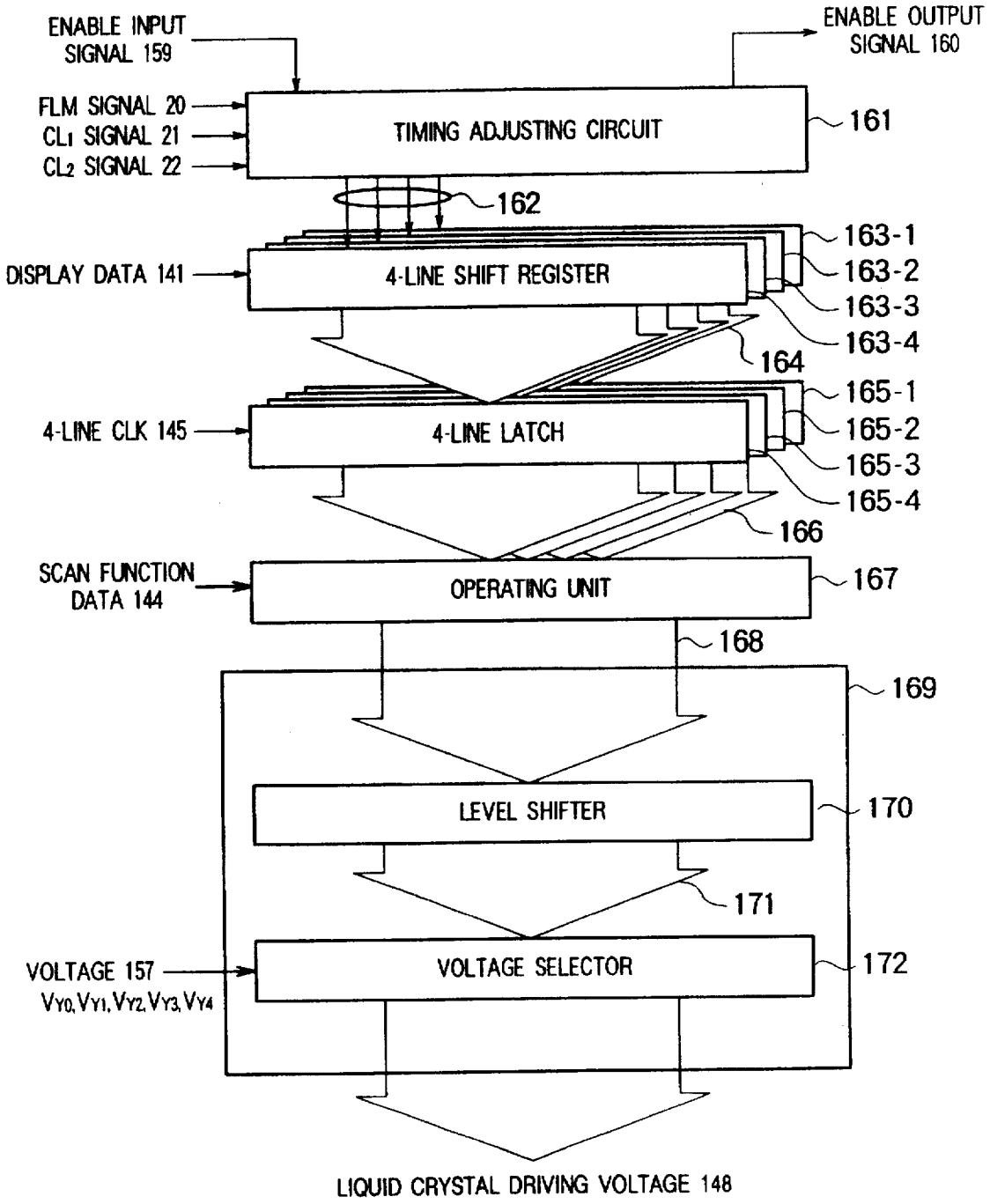
FIG. 58 is a block diagram showing a concrete arrangement of a data driver shown in FIG. 56.

FIG. 58 is a block diagram showing a concrete arrangement of the data driver 146 shown in FIG. 56, in which figure a numeral 161 denotes a timing adjusting circuit, numerals 163-163-4 denote four-line shift registers, a numeral 167 denotes an operating unit, a numeral 169 denotes an output circuit, a numeral 170 denotes a level shifter, and a numeral 172 denotes a voltage selector. The same signals of FIG. 58 as those shown in FIG. 56 have the same reference numbers. The data driver 147 has the same arrangement. In this arrangement, the scan electrodes of m=4 are selected at a time.

Figure 59:
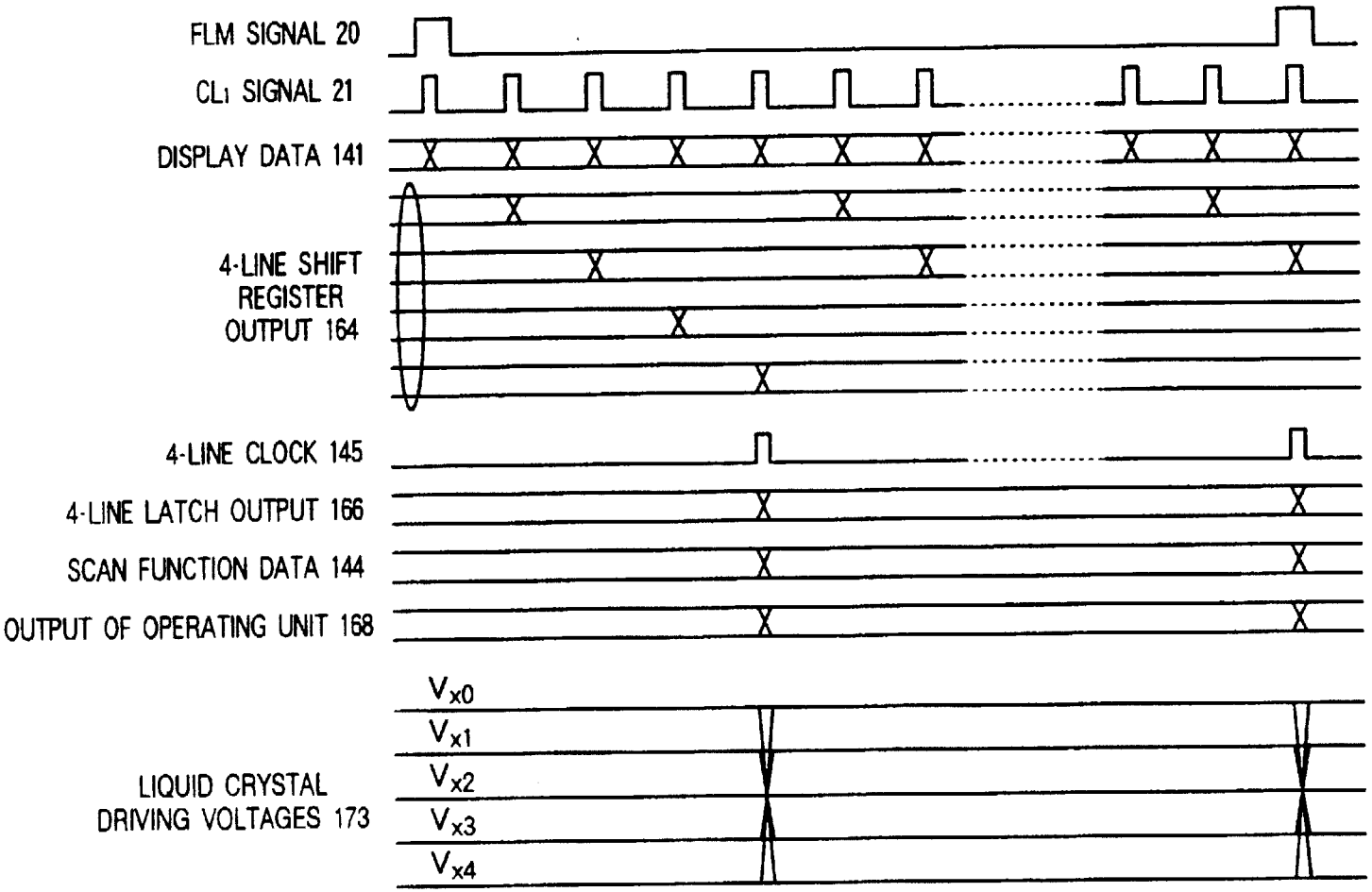
FIG. 59 is a timing view showing signals of components shown in FIG. 58.

Next, the operation of the data driver 146 will be described with reference to FIG. 59. FIG. 59 is a view showing a timing relation among the signals given to the components of FIG. 58.

In FIG. 59, an enable input signal 159 determines if the data driver is operative 146 or inoperative. The enable output signal 160 is led to an enable input of the next data driver having plural data drivers connected thereto. In FIG. 56, these enable signals are shown as the enable signal 150. The operations of these enable output signals 159 and 160 are adopted and realized in the commercially available data drivers. Hence, the description about these operations will be left out herein.

The timing adjusting circuit 161 operates to generate a shift clock 162 and the enable output signal 160 based on the FLM signal 20, the CL1 signal 21 and the CL2 signal 22. On the timing of the shift clock 162, the four-line shift register 163 reads the display data 141 in sequence. When the data for four lines is read, the data is outputted as a shift register output 164.

A numeral 165 denotes a four-line latch which operates to latch the shift register output 164 with the four-line clock 145 and output it as the latched output 166. The operating unit 167 performs a predetermined operation with respect to the latched output 166 and the scan function data 144. The output circuit 169 contains the level shifter 170 and the voltage selector 172. The level shifter 170 operates to level-shift the output 168 sent from the operating unit 167. Then, the voltage selector 172 operates to select one of five voltages contained in the data driver supply voltages 157 according to the output 171 of the level shifter 170 and output the selected voltage as the liquid crystal driving voltage 148.

Figure 60:
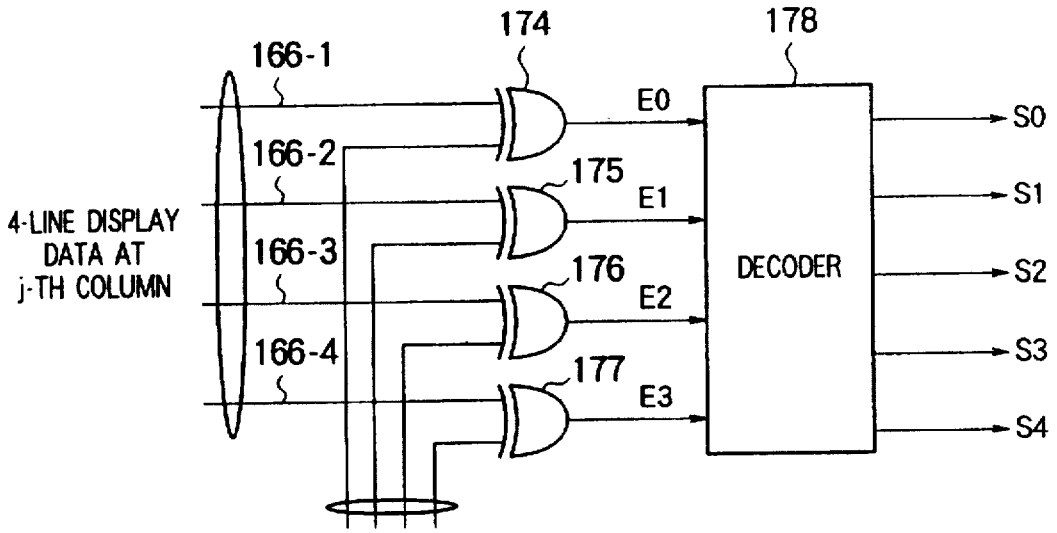
FIG. 60 is a block diagram showing a concrete arrangement of a computing element shown in FIG. 58.

FIG. 60 is a block diagram showing a concrete arrangement of the operating unit 167 shown in FIG. 58, in which figure numerals 174 to 177 denote exclusive OR circuits and a numeral 178 denotes a decoder.

The operating unit operates to drive one data electrode. In this embodiment, the data driver 146 is assumed to drive 160 data electrodes. This needs 160 operating units. In the later description, the illustrated operating unit is the j-th column (j-th dot) one.

In FIG. 60, the exclusive OR circuits 174 to 177 each perform an exclusive OR operation with respect to the four-line display data at the j-th column and the scan function data 144 sent from the four-line latch 165. The four-line latch 165 is arranged to store one-line display data in each of the latches 165-1, 165-2, 165-3 and 165-4, store the display data for totally four lines.

The four-line display data 166 at the j-th column is the combination of the one-line display data at the j-th column in the latch 165-1, the one-line display data at the j-th column in the latch 165-2, the one-line display data at the j-th column in the latch 165-3, and the one-line display data at the j-th column in the latch 165-4. The one-line display data 166 at the j-th column is exclusive ORed with the scan function data 144. The results are fed as the data E0, E1, E2 and E3 to the decoder 178.

The decoder 178 operates to generate the selected signals S0, S1, S2, S3 and S4 from the fed data E0, E1, E2 and E3. The relation between the data E0, E1, E2, E3 and the selected signals S0, S1, S2, S3, S4 is listed in Table 4.

TABLE 4

| E0 | E1 | E2 | E3 | S0 | S1 | S2 | S3 | S4 |
|---|---|---|---|---|---|---|---|---|
| 0 | 0 | 0 | 0 | 1 | 0 | 0 | 0 | 0 |
| 0 | 0 | 0 | 1 | 0 | 1 | 0 | 0 | 0 |

TABLE 4-continued

| E0 | E1 | E2 | E3 | S0 | S1 | S2 | S3 | S4 |
|---|---|---|---|---|---|---|---|---|
| 0 | 0 | 1 | 0 | 0 | 1 | 0 | 0 | 0 |
| 0 | 0 | 1 | 1 | 0 | 0 | 1 | 0 | 0 |
| 0 | 1 | 0 | 0 | 0 | 1 | 0 | 0 | 0 |
| 0 | 1 | 0 | 1 | 0 | 0 | 1 | 0 | 0 |
| 0 | 1 | 1 | 0 | 0 | 0 | 1 | 0 | 0 |
| 0 | 1 | 1 | 1 | 0 | 0 | 0 | 1 | 0 |
| 1 | 0 | 0 | 0 | 0 | 1 | 0 | 0 | 0 |
| 1 | 0 | 0 | 1 | 0 | 0 | 1 | 0 | 0 |
| 1 | 0 | 1 | 0 | 0 | 0 | 1 | 0 | 0 |
| 1 | 0 | 1 | 1 | 0 | 0 | 0 | 1 | 0 |
| 1 | 1 | 0 | 0 | 0 | 0 | 1 | 0 | 0 |
| 1 | 1 | 0 | 1 | 0 | 0 | 0 | 1 | 0 |
| 1 | 1 | 1 | 0 | 0 | 0 | 0 | 1 | 0 |
| 1 | 1 | 1 | 1 | 0 | 0 | 0 | 0 | 1 |

As listed in Table 4, in the decoder 178, if no input data of E0, E1, E2 and E3 has a logic 1, a logic 1 is given to S0. If one piece of input data has a logic 1, a logic 1 is given to S1. If two pieces of data have a logic 1, a logic 1 is given to S2. If pieces of input data have a logic 1, a logic 1 is to S3. If all the pieces of input data have a logic 1, a logic 1 is given to S4. The selecting signal generated on this principle. The selecting signal 168 is fed to the output circuit 169 shown in FIG. 58.

The operating process done by the operating unit 167 is indicated as follows.

$$S_j = \frac{\sum_{i=j}^{m} I_{ij} W_i + m}{2} \tag{8}$$

wherein, as noted above, m is the number of the scan electrodes to be selected at a time, $w_i$ is a function arranged to take a value of +1 or −1 in the selecting interval or a value of 0 in the non-selecting interval, and $I_{ij}$ is display data located at the pixel of the i-th row and j-th column.

Figure 61:
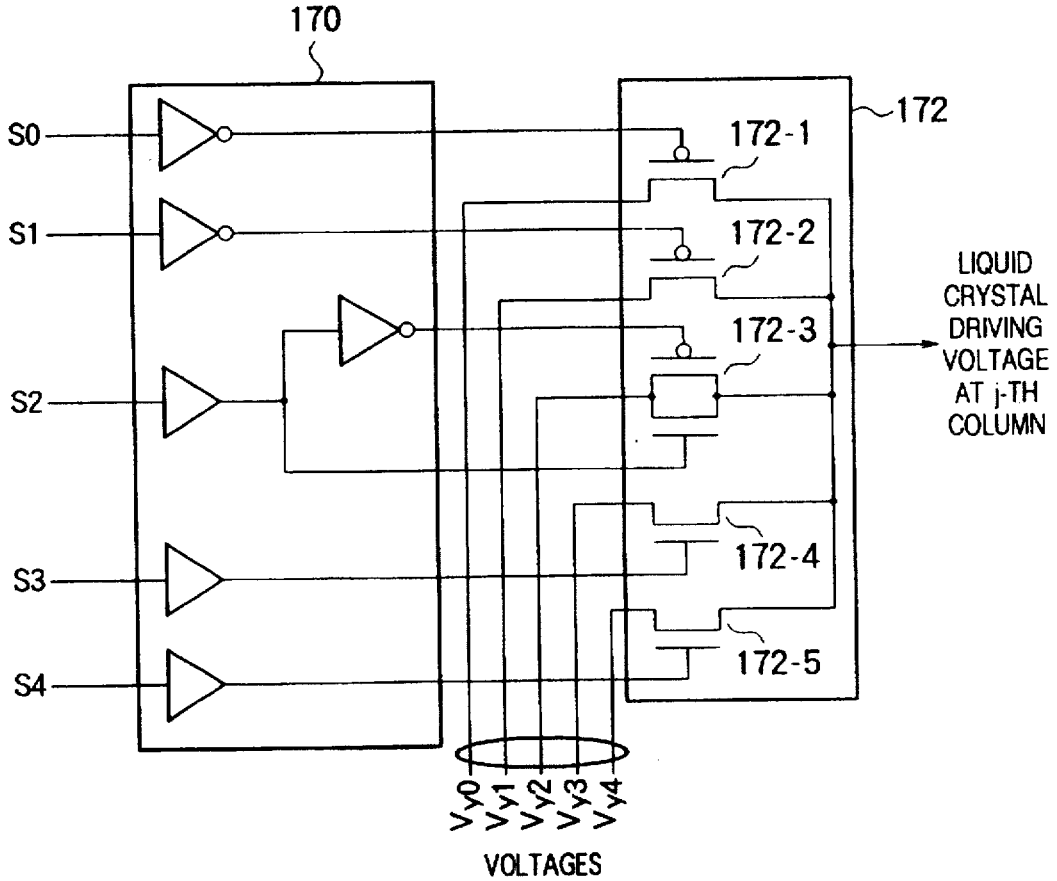
FIG. 61 is a circuit diagram showing a concrete arrangement of a level shifter and a voltage selector of an output circuit shown in FIG. 58.

FIG. 61 is a circuit diagram showing a concrete arrangement of the level shifter 170 and the voltage selector 172 included in the output circuit 169 shown in FIG. 58. In FIG. 61, numerals 172-1 to 172-5 denote output transistors. The corresponding components of FIG. 61 to those of FIG. 58 have the same reference numbers.

The arrangement is connected to the output of the operating unit shown in FIG. 60. This means that it is necessary to prepare the same number of the level shifters 170 and the voltage selectors 172 as the operating units.

In FIG. 61, the selecting signal 168 generated in the decoder 178 shown in FIG. 60 is fed to the level shifter 170 provided in the output circuit 169. The level shifter 170 operates to convert the selecting signal 168 into the voltage for switching on and off the output transistors 172-t to 172-5 according to the logic. The output transistors 172-1 to 172-5 operate to select one of the five voltages Vy0, Vy1, Vy2, Vy3 and Vy4 contained in the data driver supply voltage 157 and output the selected voltage as the liquid crystal driving voltage 146.

Figure 62:
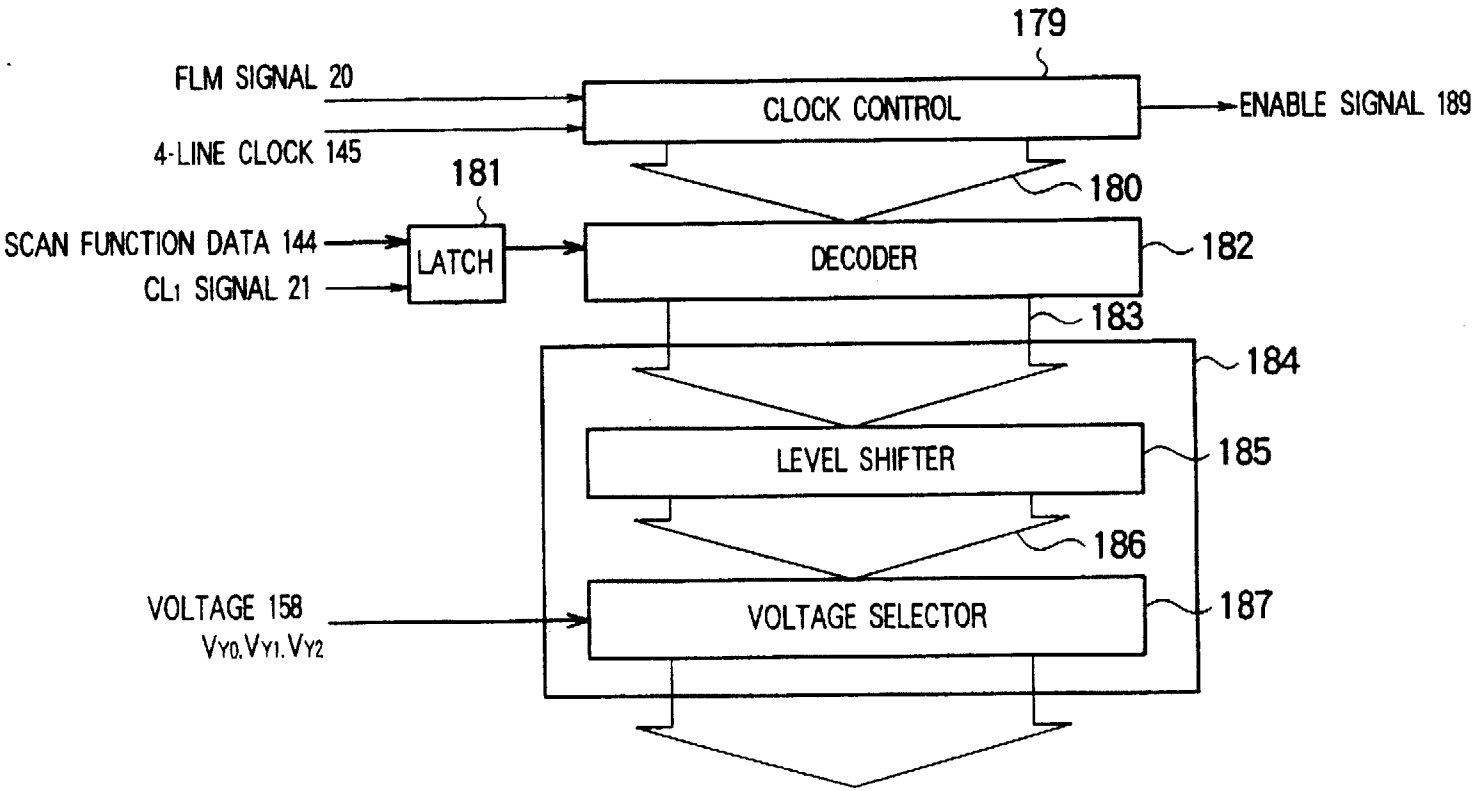
FIG. 62 is a block diagram showing a concrete arrangement of a scan driver shown in FIG. 56.

FIG. 62 is a block diagram showing a concrete arrangement of the scan drivers 151 and 152 shown in FIG. 56. In this figure, a numeral 179 denotes a clock control circuit. A numeral 181 denotes a latch. A numeral 182 denotes a decoder. A numeral 184 denotes an output circuit. A numeral 185 denotes a level shifter. A numeral 187 denotes a voltage selector.

Figure 63:
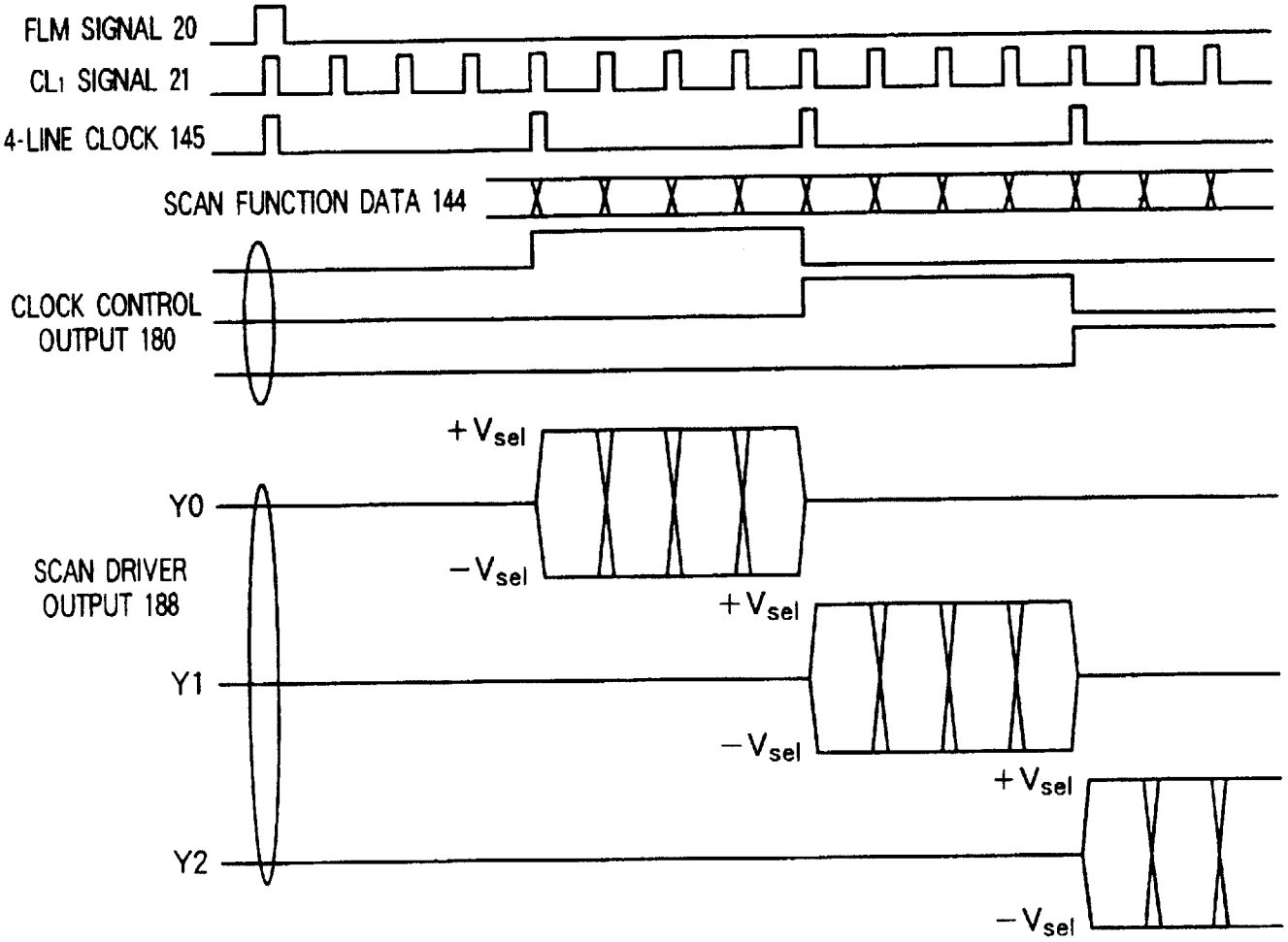
FIG. 63 is a timing view showing signals of components shown in FIG. 62.

FIG. 63 is a view showing a timing relation among the signals of the components shown in FIG. 62. The corresponding signals of FIG. 63 to those of FIG. 62 have the same reference numbers.

In FIGS. 62 and 63, the clock control circuit 179 operates to generate a clock control output 180 and an enable signal 179 from the FLM signal 20 and the four-line clock 145 and output them. On the other hand, the scan function data 144 is fed in synchronous to the CL1 signal 21 and is latched by the latch 181. The latched scan function data 144 and the output 180 of the clock control circuit 179 are fed to the decoder 182. The decoder 182 feeds the output 183 to the output circuit 184.

The output circuit 184 is composed of the level shifter 185 and the voltage selector 187. The voltage selector 187 operates to select one of the three scan driver supply voltages 158 and output the selected voltage as the liquid crystal driving voltage 154.

Figure 64:
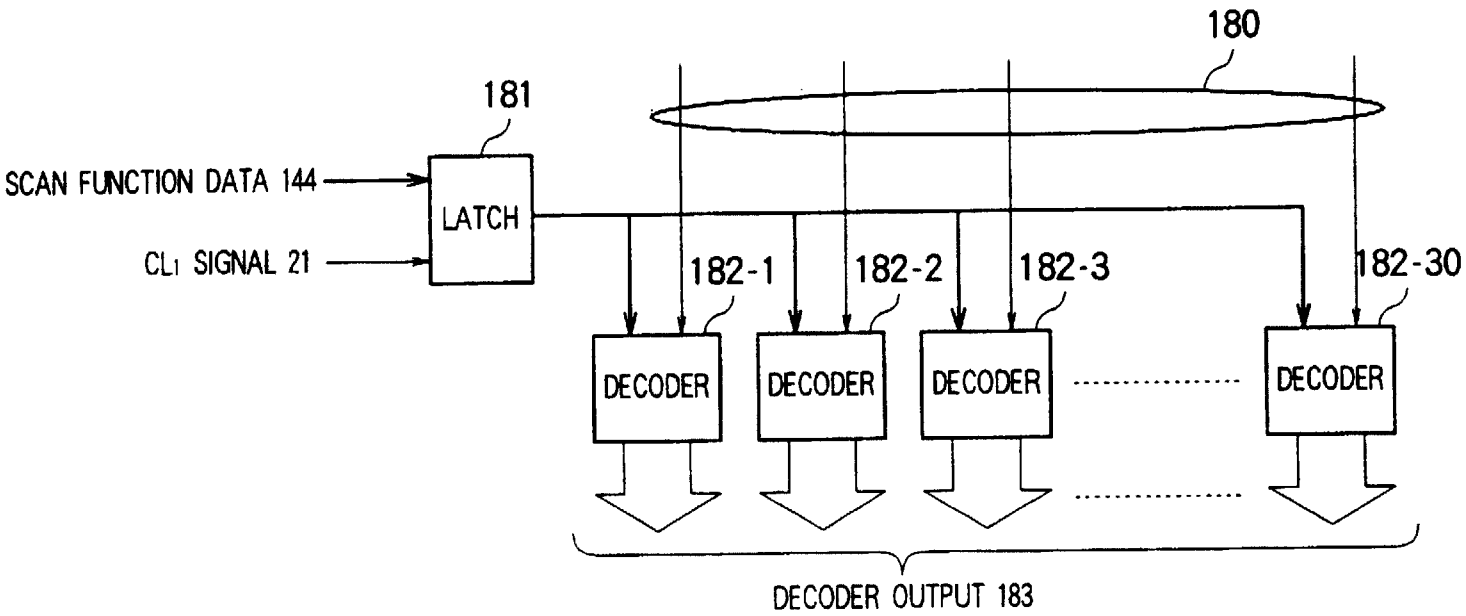
FIG. 64 is a block diagram showing a concrete arrangement of a decoder shown in FIG. 62.

FIG. 64 is a block diagram showing a concrete arrangement of the decoder 182 shown in FIG. 62. In FIG. 64, numerals 182-1, 182-2, 182-3, . . . , 182-30 denote decoding units. The corresponding components of FIG. 64 to those of FIG. 62 have the reference numbers.

In FIG. 64, the decoder 182 is composed of 30 decoding units 182-1, 182-2, 182-3, . . . , 182-30, one of which is selected by the output 180 of the clock control circuit (see FIG. 62). The selected decoding unit operates to output the code data 183 corresponding to the scan function data 144 latched by the latch 181. The remaining, non-selected decoding units operate to output non-selecting decode data 183.

Figure 65:
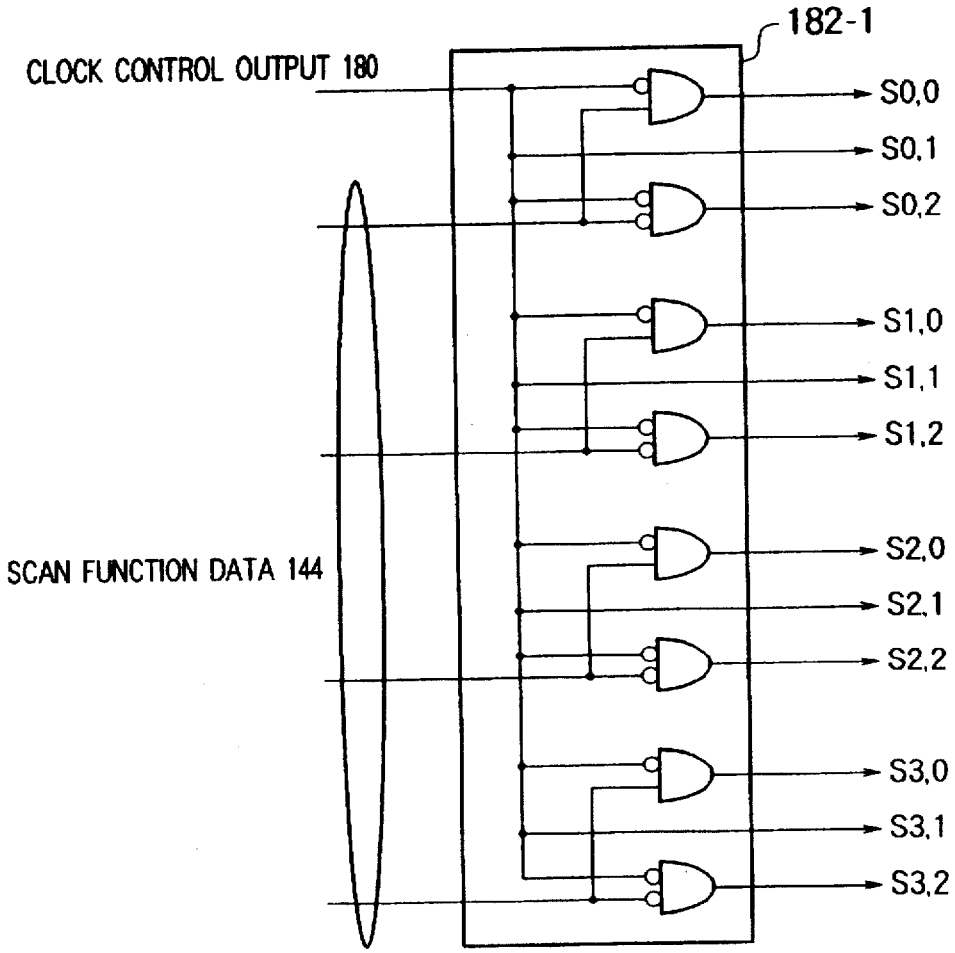
FIG. 65 is a block diagram showing a concrete arrangement of a decoder shown in FIG. 64.

The decoding units 182-1 to 182-30 are arranged in such a manner as shown in FIG. 65. If the output 180 of the clock control circuit 179 has a logic 0, the decoding unit enters into a selecting state. When the output 180 has a logic 1, the decoding unit enters into a non-selecting state. In the selecting state, the code data 183 is outputted to the output circuit 184 according to the logic of the scan function data 144.

Figure 66:
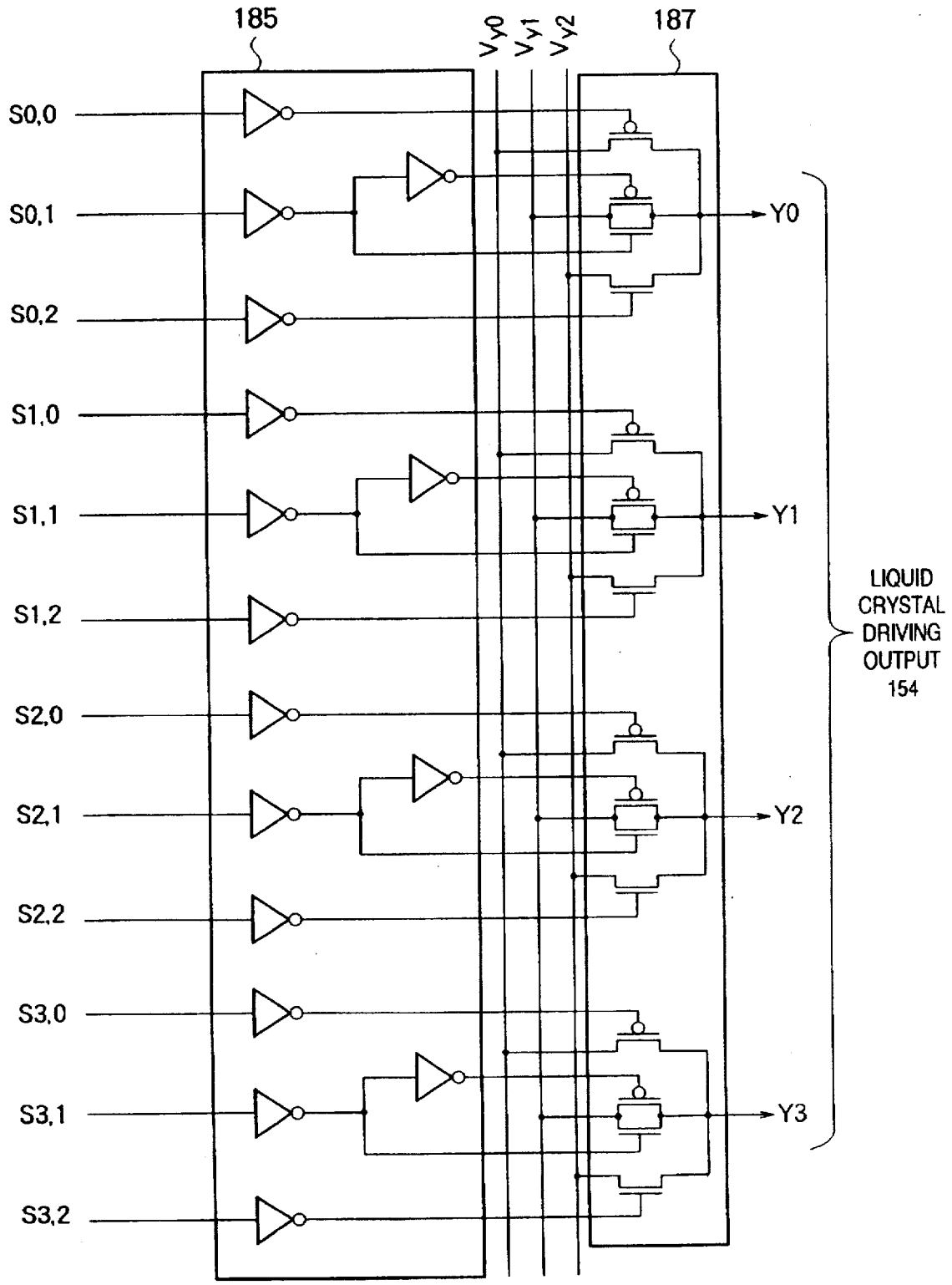
FIG. 66 is a circuit diagram showing a concrete arrangement of an output circuit shown in FIG. 62.

FIG. 66 is a circuit diagram showing a concrete arrangement of the output circuit shown in FIG. 62. The corresponding components of FIG. 66 to those of FIG. 62 have the same reference numbers.

In FIG. 66, the code data 183 is level-shifted in the level shifter 185, on the output 186 of which the voltage selector 187 operates. In the selecting state, the voltage selector 187 operates on the code data, that is, the decoder output 183. The voltage selector 187 operates to select the voltage Vy0 (+Vsel as shown in FIG. 63) when the scan function data 144 has a logic 1 or the voltage Vy2 (−Vsel as shown in FIG. 63) when the data 144 has a logic 0 and operates to output the selected voltage as the liquid crystal driving voltage 154. In the non-selecting state, the voltage Vy1 is outputted as the liquid crystal driving voltage 154 independently of the logic of the scan function data 144.

The above description has concerned with the scan driver 151 shown in FIG. 56. This holds true to the other scan driver 152.

Figure 67:
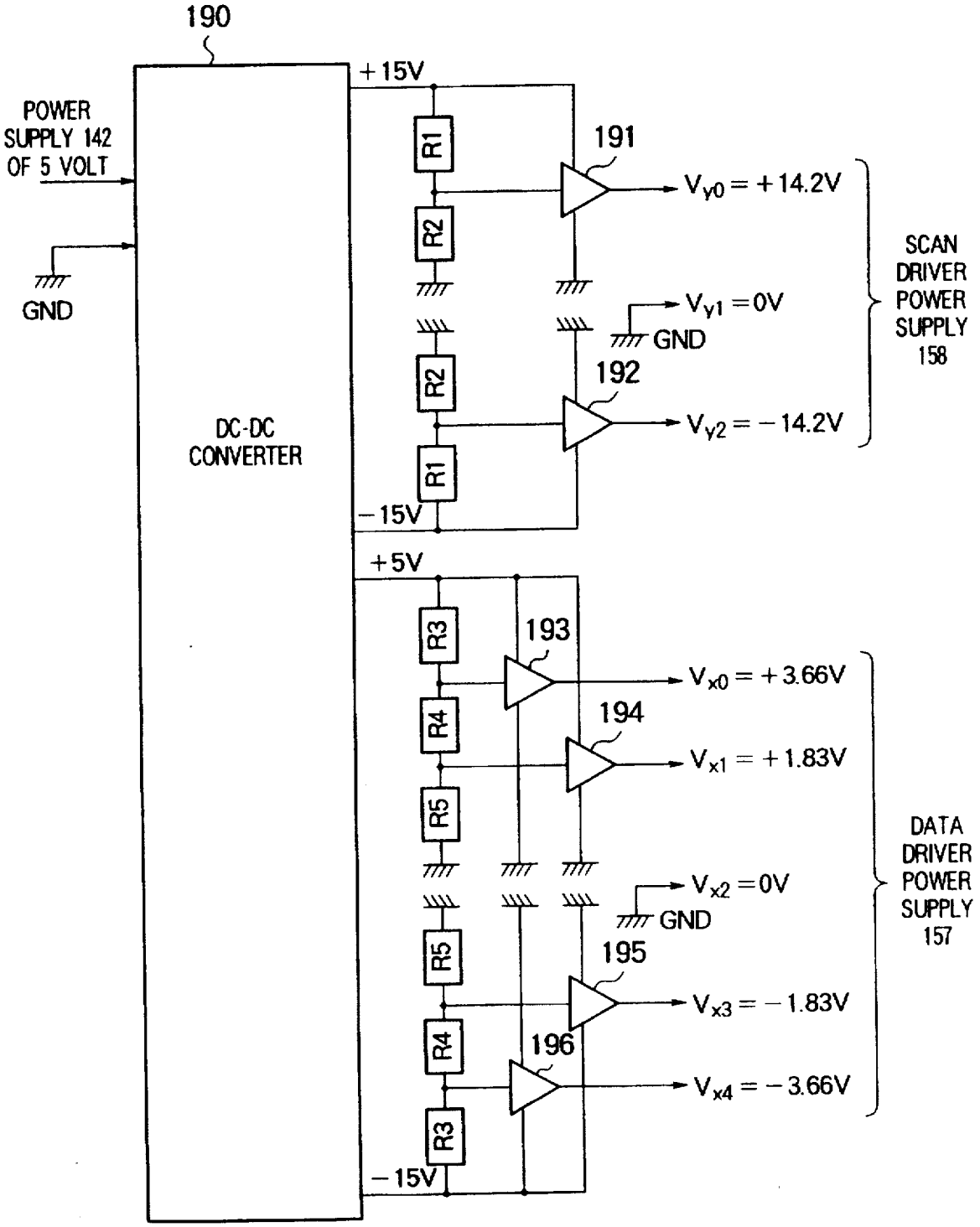
FIG. 67 is a block diagram showing a concrete arrangement of a power supply circuit shown in FIG. 56.

FIG. 67 is a block diagram showing a concrete arrangement of the power supply circuit 156 shown in FIG. 56. In FIG. 67, a numeral 190 denotes a dc-to-dc converter. Numerals 191 to 196 denote operation amplifiers. R1, R2, R3, R4 and R5 denote resistors.

In FIG. 67, the dc-to-dc converter 190 operates to generate four voltages of +15 volts, −15 volts, +5 volts and −5 volts from the 5-volt supply voltage. The voltage of +15 volts is divided by the resistors R1 and R2. The divided voltage is current-amplified in the operation amplifier 191. The amplifier 191 forms the voltage Vy0. Likewise, the voltage of −15 volts is divided through the effect of the resistors R1 and R2 and then is current-amplified in the operation amplifier 192. The amplifier 192 forms the voltage Vy2. The voltage Vy1 is grounded (0 V). These operations result in forming the scan driver supply voltage 159 composed of the voltages Vy0, Vy1 and Vy2.

On the other hand, the voltage of +5 volts is divided through the effect of the resistors R3, R4 and R5 and then is current-amplified by the operation amplifiers 193 and 194, from which are outputted the voltages Vx0 and Vx1. Likewise, the voltage of −5 volts is divided through the effect of the resistors R3, R4 and R5 and then is current-amplified by the operation amplifiers 195 and 196, from which are outputted the voltages Vx3 and Vx4. The voltage Vx2 is grounded (0 volt). These operations result in forming the data driver supply voltage 157 composed of the voltages Vx0, Vx1, Vx2, Vx3 and Vx4.

The actual voltage values of the scan driver supply voltage 159 are derived as follows by the expression (3), that is, the expression (2) by which wi of +1, 0 and −1 is multiplied.

$$Vy0=+14.2 \text{ volts},\ Vy1=0 \text{ volt},\ Vy2=-14.2 \text{ volts}$$

wherein N=240, m=4 and Vth=2.5 volts given in the expression (3). Further, assuming that each voltage of the data driver supply voltage 157 is Vxk (k is an integer ranging from 0 to m), the following expression (9) may be derived from the expression (5).

$$V_{xk}=\frac{1}{\sqrt{M}}\sqrt{\frac{\sqrt{M}}{2(\sqrt{M}-1)}}\,(2k-m)V_{th} \tag{9}$$

Hence, $$Vx0=+3.66 \text{ volts},\ Vx1=+1.83 \text{ volts},\ Vx2=0 \text{ volt},\ Vx3=-1.83 \text{ volts},\ Vx4=-3.66 \text{ volts}$$

The resistors R1 to R5 are set to have such voltage dividing ratios as defining these voltages.

Figure 68:
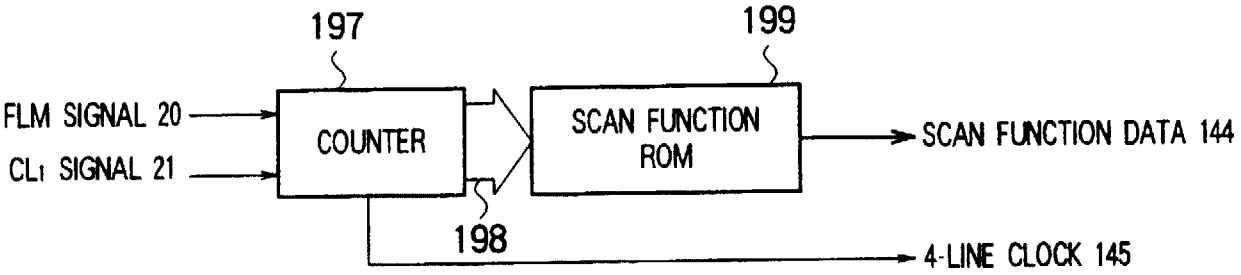
FIG. 68 is a block diagram showing a concrete arrangement of a scan function generator shown in FIG. 56.
Figure 69:
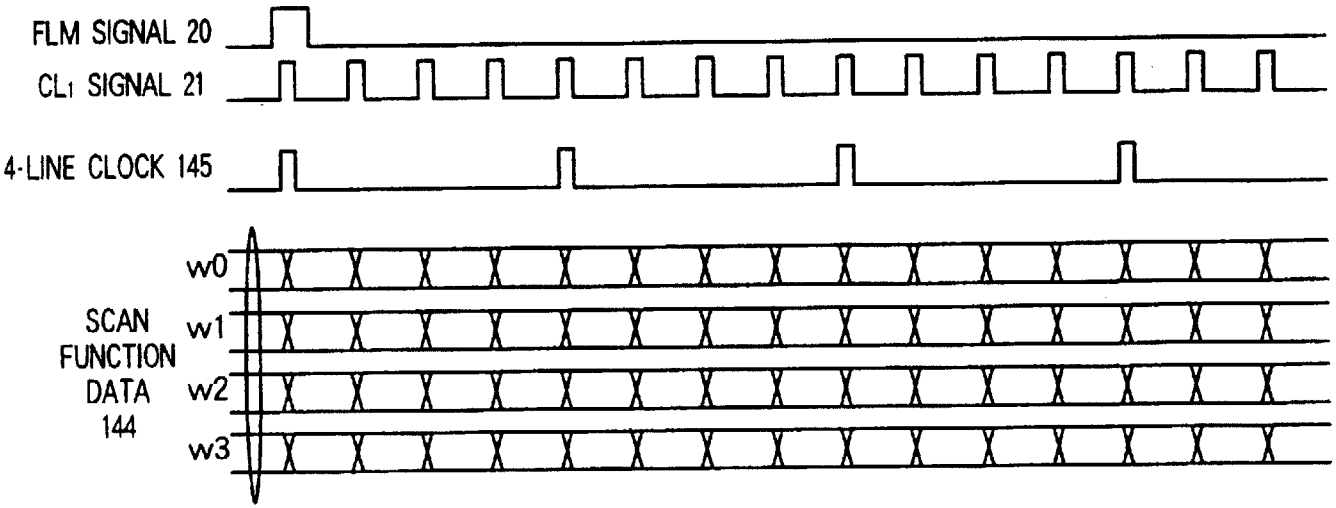
FIG. 69 is a timing view showing an operation of a scan function generator shown in FIG. 68.

FIG. 68 is a block diagram showing a concrete arrangement of a scan function generator 143 shown in FIG. 56, in which a numeral 197 denotes a counter and a numeral 199 denotes a scan function ROM. FIG. 69 is a timing view showing the concrete operation of the generator 143.

In FIG. 68, the counter 197 operates to generate a read address signal 198 of the scan function ROM 199 and the four-line clock 145 from the FLM signal 20 and the CL1 signal 21. The data stored in the scan function ROM is read as the scan function data 144 with the address signal 198.

The above operation will be described with reference to FIG. 69. The four-line clock 145 is synchronous to the FLM signal 20. One clock 145 is generated each time four CL1 signals 21 are fed. By counting the CL1 signal 21, the address signal 198 is generated. The address of the data stored in the scan function ROM 199 is updated and read out each time the CL1 signal 21 is fed. The data is read as the scan function data 144.

An example of the data stored in the scan function ROM 199 is illustrated in FIG. 70. FIG. 70 shows an address map stored in the scan function ROM 199, on which map the scan signal waveforms shown in FIG. 54 are read out of the scan driver 151.

In FIG. 70, the count of the CL1 signal 21 done by the counter 197 is equivalent to the address 198 at which the data is read out of the scan function ROM 199. When the first address signal 198 has a value of 0, $w_0$, $w_1$, $w_2$ and $w_3$ of the scan function data 144 are all made zero. Next, when the address signal 198 has a value of 1, the scan function data 144 becomes such as $w_0=1$, $w_1=1$, $w_2=0$ and $w_3=0$.

When the address signal 198 has a value of 2, the scan function data 144 becomes such as $w_0=1$, $w_1=0$, $w_2=0$ and $w_3=1$. The scan function data 144 shown in FIG. 70 is outputted.

The scan voltage in the first divisional interval of FIG. 54 corresponds to the data given when the address signal 198 has a value of 0 to 3. The scan voltage in the second divisional interval corresponds to the data given when the address signal 198 has a value, of 3 to 7. The similar correspondence continues later. Lastly, the scan voltage in the 60-th divisional interval corresponds to the data given when the address signal 198 has a value of 236 to 239. As a result, the scan signal waveform is indicated in FIG. 54.

The data stored in the scan function ROM 199 is inverted in logic to the data stored in the ROM 199. This makes it possible to alternately inverse the polarity of the voltage applied to the liquid crystal cell for each frame as keeping the effective value of the voltage constant. This inversion of the polarity prevents the liquid crystal material from being degraded.

The scan function ROM 199 stores not only the data shown in FIG. 70 but the other type of data, each of which is shown in FIGS. 71 to 73.

The waveform of the scan signal shown in FIG. 54 is formed like a selecting pulse changing similarly in each divisional interval, that is, an orthogonal function. In addition, it may be formed like a selecting pulse changing differently in each divisional interval. For the address map stored in the scan function ROM 199 shown in FIG. 71, it is possible to obtain the scan signal waveform shown in FIG. 74.

Further, the polarity of the selecting pulse may be inverted in each divisional interval. FIG. 72 shows an example of an address map stored in the scan function ROM 199 in this case, against which address map the scan signal waveform appears as shown in FIG. 75.

Figure 76:
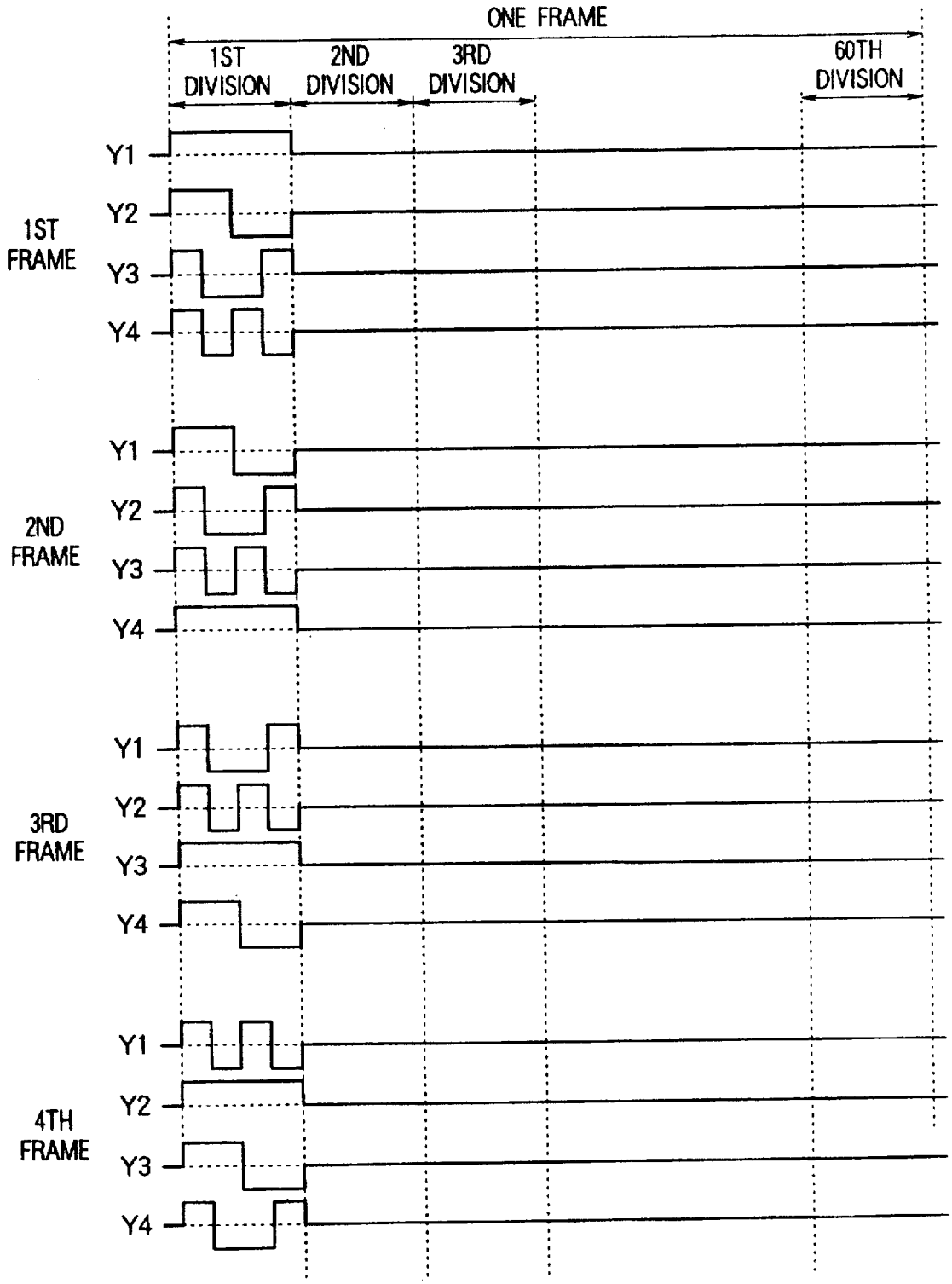
FIG. 76 is a view showing a scan signal waveform for the stored data shown in FIG. 73.

Moreover, the combination of the orthogonal functions may change in each frame. FIG. 73 shows an example of an address map stored in the scan function ROM 199 in this case. FIG. 76 shows the scan signal waveforms appearing in the scan electrodes Y1 to Y4 for the address map shown in FIG. 73.

Figure 74:
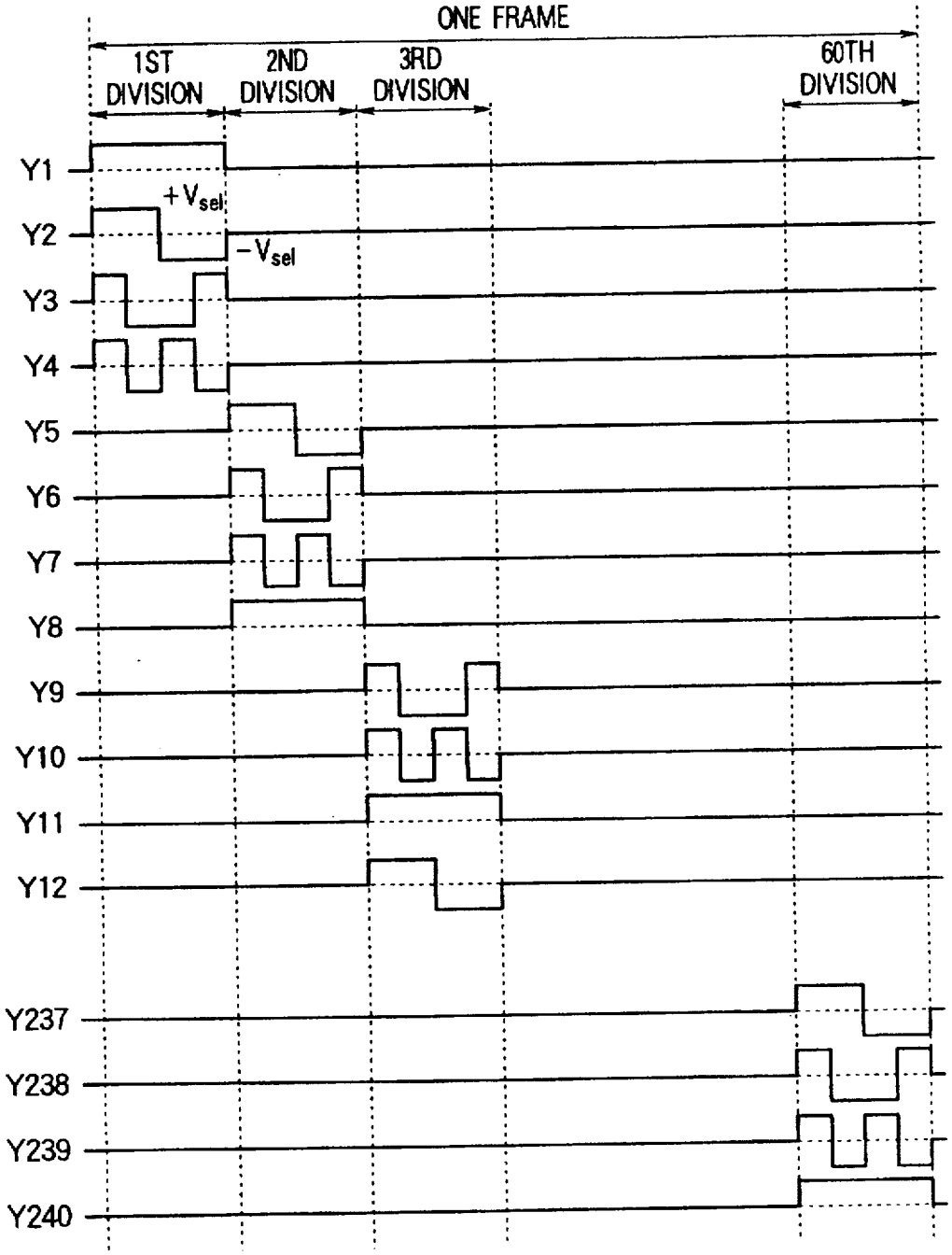
FIG. 74 is a view showing a scan signal waveform for the stored data shown in FIG. 71.
Figure 75:
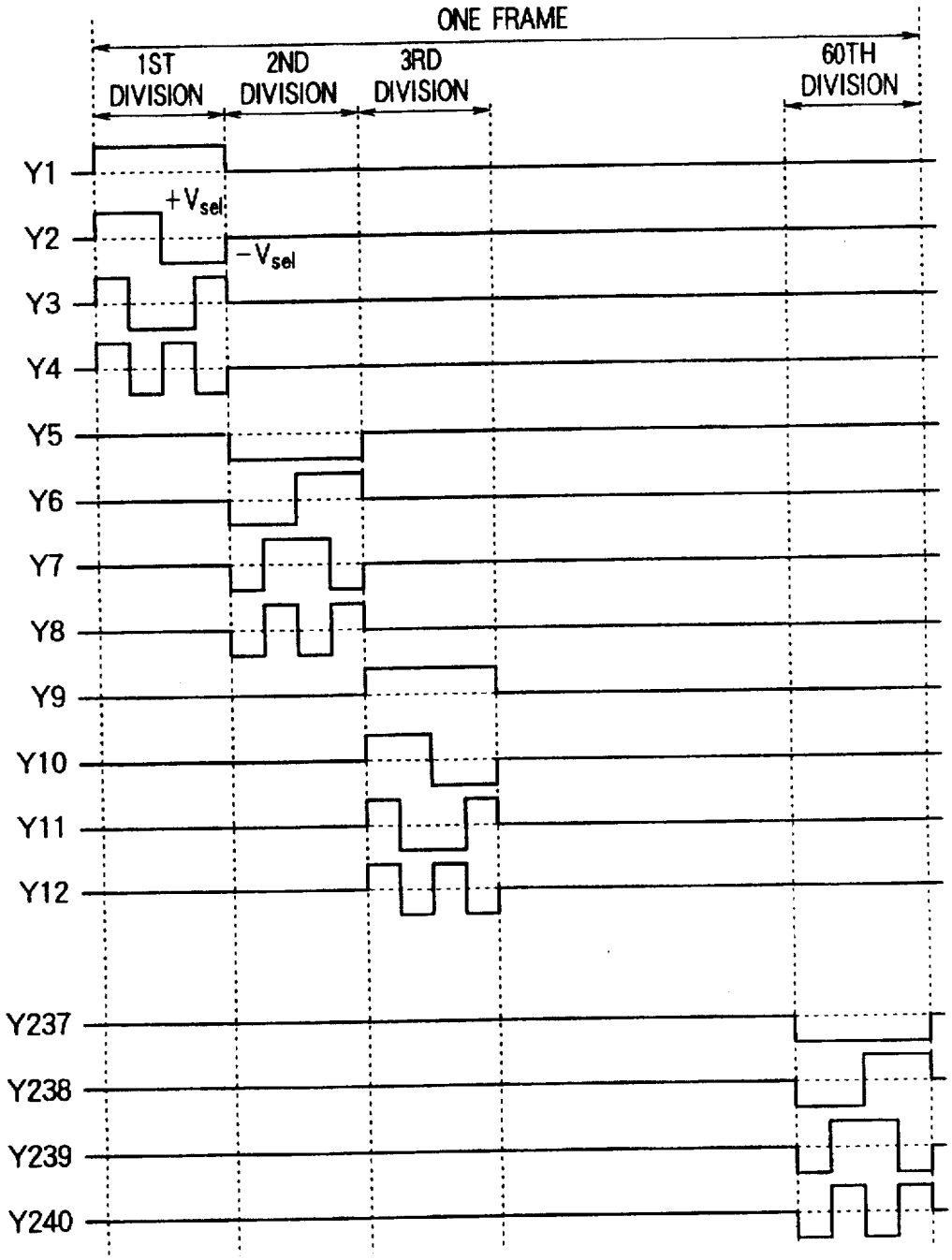
FIG. 75 is a view showing a scan signal waveform for the stored data shown in FIG. 72.

As shown in FIGS. 74 to 76, totally four selecting pulses are prepared. That is, a pulse with no voltage change in the divisional interval, a pulse with one change of a voltage polarity, a pulse with two changes of a voltage polarity, and a pulse with three changes of a voltage polarity. The liquid crystal changes its optical characteristic according to the frequency of the voltage applied thereto. Hence, the difference of the times of changing the voltage polarity of the selecting pulse corresponds to the difference of the frequency. The difference brings about an uneven display. On the other hand, by changing the combination of the scan functions in each divisional interval, reversing the polarity of the voltage, or changing the combination of the scan functions for each frame, the unevenness on the display is allowed to be reduced.

As described above, the fourth embodiment may implement the method for selecting scan electrodes at a time by using the foregoing data driver, scan driver, power supply circuit and scan function generator. In particular, since the withstand voltage of the data driver may be reduced, the power consumption of the display system may be reduced as well.

Further, the input interface for the display data and various kinds of clocks to be inputted to the data driver may be the same as the conventional one. It may be compatible with the interface of the conventional liquid crystal panel. Hence, the fourth embodiment is very convenient when it is used with the conventional LCD device.

In the simple matrix type liquid crystal display device, the change of the voltage to be applied onto the data electrode appears as a crosstalk on the scan electrode. In particular, in the non-selecting interval, a spike noise appears as a crosstalk though a constant 0 voltage is kept in that interval. Hence, the effective value of the voltage to be applied to the liquid crystal is made so variable that the display may be uneven. This is because the output impedance of the scan driver and the impedance of the power supply circuit connected to the scan driver inhibit absorption of the spike noise. Like this embodiment, therefore, to reduce the impedance of the power supply to a small value, it is possible to make the voltage in the non-selecting interval zero (grounded). This is effective in absorbing the spike noise and thereby reducing the display unevenness resulting from the crosstalk. Further, this does not need some components such as an operation amplifier for generating the voltage in the non-selecting interval, which results in reducing the power supply circuit and its cost.

The power supply circuit according to the fourth embodiment is applicable to the first and the second embodiments.

Moreover, this fourth embodiment is applicable to the data electrode driving circuit having the display memory indicated about the first embodiment. This application is realized by replacing the arrangement from the four-line shift register 163 to the voltage selector 172 of the overall data driver shown in FIG. 58 with the arrangement from the read latch 44 to the output circuit 47 of the data driver shown in FIG. 5. In this case, the four-line shift register 163 operates to latch one-line data from the display memory four times, finally four-line data in total. The detailed operation of the applied embodiment will be easily understood by those skilled in the art from the descriptions about the first to the fourth embodiments.

Further, the power supply circuit provides the dc-to-dc converter. Hence, a simple power supply of +5 volts enables to feed the sufficient power to the display device. It is effective in improving the way of using the liquid crystal panel. The power supply is not limited to a simple power supply of +5 volts but to another simple power supply of 3.3 volts or 3 volts. The power supply may be selected according to the system where the liquid crystal panel is incorporated.

Moreover, this embodiment independently provides the scan function generator. In place, the generator may be built in the data driver or the scan driver. This may reduce the necessary components in number, thereby reducing the liquid crystal display device and its cost.

The fourth embodiment has been described on the method for selectively driving four lines at a time. However, the number of lines to be selectively driven at a time is not limited to four but any other number. That is, the number of lines may be increased or decreased by considering the cost of the data driver or the scan driver or the mass-producing possibility.

Further, the method of this embodiment may drive the conventional medium-speed or slow responsive liquid crystal panel at low power consumption if the frame frequency (the reverse of the period of the FLM signal 20) is set to a value ranging from 60 to 70 Hz. Moreover, it may also apply to the fast responsive liquid crystal panel as described about the first and the second embodiments if the frame frequency is set to a high value. As such, this method may realize a high-contrast LCD device.

The method of this embodiment makes it possible to perform a tone display only if a tone treatment such as a frame rate control is carried out about the display data to be inputted to the data driver in advance.

The foregoing description about this embodiment has been expanded on the case where it is applied to the monochrome liquid crystal panel. This method may apply to a color liquid crystal panel. That is, it may realize a color liquid crystal panel at low power consumption.

In addition, by changing a combination of scan functions or inverting the polarity in each divisional interval or at each frame, this method may realize the liquid crystal display device which keeps its display even.

As set forth above, according to the present invention, by increasing the horizontal frequency for driving the liquid crystal by n times, dividing the horizontal interval into n partial intervals, corresponding each divided interval to each bit of the n-bit display data, allocating a voltage of an amplitude according to the logic value of the corresponding bit to each divided interval and the sequence of the bits in the display data, and making the allocated voltage serve as the data electrode driving signal of the display panel, 2n-tone display may be realized and the scan frequency may be enhanced as well. Hence, the present invention may implement a liquid crystal display device which enables to drive the fast responsive liquid crystal material at high contrast.

Further, according to the present invention, the data driver includes the display memory built therein. It is, therefore, necessary to match the frequency of the display data transferred from the display controller to the frequency of the data voltage to be outputted to the liquid crystal panel and possible to operate the display controller independently of the display. If no change takes place in the content to be displayed, hence, the present invention may reduce the operating frequency of the display controller or stop the display controller itself for lowering the power consumption.

Further, according to the present invention, by changing the voltage to be applied to the liquid crystal in each one horizontal interval, it is possible to reduce the unevenness on the display resulting from the frequency characteristic of the threshold value of the liquid crystal.

Moreover, the present invention makes it possible to display the fast responsive liquid crystal at high contrast and greatly reduce the power consumed in the data electrode driving circuit.

What is claimed is:

1. A data electrode driving circuit provided in a matrix type liquid crystal display device, said matrix type liquid crystal display device including N (N is a positive integer except zero) data electrodes, M (M is a positive integer except zero) scan electrodes, and a matrix type liquid crystal display panel having pixels located at crosspoints between said data electrodes and said scan electrodes, said data electrode driving circuit comprising:

a memory unit from or into which display information may be read or written;

control means for controlling a write of said display information into a memory area of said memory unit;

read control means for reading the display information corresponding to said N data electrodes from said memory area at a time, said display information for one screen being written in said memory area at a first frequency and said display information being read from said memory area at a second frequency different from said first frequency; and an output circuit for converting the display information read out of said memory unit into a display voltage, and feeding said display voltage to said data electrodes.

2. A data electrode driving circuit as claimed in claim 1, wherein said memory area has a corresponding area to said pixels;

wherein said display information is sequentially inputted to said driving circuit at each n (n=N) pixels in one horizontal interval when all the pixels located on one scan electrode are driven;

wherein said write control means includes a write latch circuit for latching the inputted display information at each n (n=N) pixels, and writing in said memory area said display information read after the display information for n pixels is written therein.

3. A data electrode driving circuit as claimed in claim 2, wherein said write information is inputted in said data electrode driving circuit in response to an inputted horizontal clock signal having said first frequency;

wherein the display information for n pixels is read out of said memory area in response to a read horizontal clock signal having said second frequency.

4. A data electrode driving circuit as claimed in claim 3, further comprising a memory access control circuit for controlling said write and read control means so that said write and read control means operates to perform a reading operation first and a writing operation thereafter if a competition takes place between the operations of writing and reading the display information to and from said memory unit, and maintains constant a period at which said display information is read out of said memory area.

5. A data electrode driving circuit as claimed in any one of claims 1 to 4, wherein said read control means includes a read latch circuit for reading the display information read from said memory area;

wherein said data electrode driving circuit further comprises a decoder circuit for converting the display information latched by said read latch circuit into a voltage selecting signal for selecting said display voltage based on an ac signal; and wherein said output circuit selects one voltage from plural variable voltages based on said voltage selecting signal as said display voltage.

6. A matrix type liquid crystal display device comprising:

N (N is a positive integer except zero) data electrodes;

M (M is a positive integer except zero) scan electrodes;

a matrix type liquid crystal display panel having pixels located at crosspoints between said data electrodes and said scan electrodes;

a data electrode driving circuit as claimed in claim 5;

a scan electrode driving circuit for selectively feeding a scan selecting voltage and a non-scan selecting voltage to said scan electrodes, said scan electrode driving circuit serving to output any one of a first scan selecting voltage and a second scan selecting voltage different from one another according to said ac signal; and a voltage generator for generating plural variable display voltages, said scan selecting voltage, and said non-scan selecting voltage.

7. A matrix type liquid crystal display device as claimed in claim 6, wherein said scan electrode driving circuit operates to output according to said ac signal any one of said first and second scan selecting voltages to the scan electrode corresponding to the pixel to which said display voltage outputted from said data electrode driving circuit is fed, and to output said non-scan selecting voltage to the other scan electrodes.

8. A matrix type liquid crystal display device as claimed in claim 6, wherein said voltage generator includes:

a dc voltage generator for generating a predetermined reference voltage as said non-scan selecting voltage, and a plus voltage and a minus voltage about said reference voltage; and a voltage divider for dividing said plus and minus voltages and generating said first and second scan selecting voltages.

9. A matrix type liquid crystal display device as claimed in claim 8, wherein said dc voltage generator operates to convert a predetermined dc voltage to be fed to said liquid crystal display device into said plus and minus voltages.

10. A data electrode driving circuit as claimed in any one of claims 1 to 4, wherein said read control means includes m (m is a positive integer of 2 or more) read latch circuits for reading the display information read out of said memory area;

wherein said data electrode driving circuit further comprises an operating unit for converting the display information latched in said read latch circuits into a voltage selecting signal for selecting said display voltage based on operation data; and wherein said output circuit includes a voltage selector for selecting one of plural variable voltages based on said voltage selecting signal, and feeding said selected voltage as said display voltage to said data electrodes.

11. A matrix type liquid crystal display device comprising:

N (N is a positive integer except zero) data electrodes;

M (M is a positive integer except zero) scan electrodes;

a matrix type liquid crystal display panel having pixels located at crosspoints between said data electrodes and said scan electrodes;

a data electrode driving circuit as claimed in claim 10;

a scan electrode driving circuit for selectively feeding a scan selecting voltage and a non-scan selecting voltage to said scan electrodes, said scan electrode driving circuit serving to generate a first scan selecting voltage and a second scan selecting voltage different from one another based on said non-scan selecting voltage and predetermined operation data, and to output any one of said first and second scan selecting voltages; and a voltage generator for generating plural variable display voltages, said scan selecting voltages and said non-scan selecting voltage.

12. A matrix type liquid crystal display device as claimed in claim 11, wherein said scan electrode driving circuit operates to output according to said operation data said first and second scan selecting voltages to the scan electrodes corresponding to the pixels to which the display information read in said m read latch circuits is fed, and to output said non-scan selecting voltage to the other scan electrodes.

13. A matrix type liquid crystal display device comprising:

N (N is a positive integer except zero) data electrodes;

M (M is a positive integer except zero) scan electrodes;

a matrix type liquid crystal display panel having pixels located at crosspoints between said data electrodes and said scan electrodes;

a data electrode driving circuit as claimed in any one of claims 1 to 4;

a scan electrode driving circuit for selectively outputting a scan selecting voltage and a non-scan selecting voltage to said scan electrodes; and a voltage generator for generating plural variable display voltages, said scan selecting voltage, and said non-scan selecting voltage.

14. An information processing apparatus comprising:

a matrix type liquid crystal display device as claimed in claim 13; and another image display device;

wherein a frame frequency at which the display information for one screen is inputted to said matrix type liquid crystal display device is equal to a frame frequency of said another image display device.

* * * * *

UNITED STATES PATENT AND TRADEMARK OFFICE

CERTIFICATE OF CORRRECTION

PATENT NO. : 5,764,212
DATED : June 9, 1998
INVENTOR(S) : Nishitani et al.

It is certified that error appears in the above-identified patent and that said Letters Patent is hereby corrected as shown below:

On the title page, add the following to item [56]

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 4- | 4 | 6 | 3 | 8 | 6 | | 02/92 | Japan | | | | |
| | | 4- | 9 | 7 | 2 | 8 | 3 | | 03/92 | Japan | | | | |
| | | | | | | | | | | | | | | |

Signed and Sealed this

Sixth Day of April, 1999

*Attest:*

Q. TODD DICKINSON

*Attesting Officer*

*Acting Commissioner of Patents and Trademarks*